US009620862B2

(12) United States Patent
Maruyama et al.

(10) Patent No.: US 9,620,862 B2
(45) Date of Patent: Apr. 11, 2017

(54) REFLECTARRAY

(71) Applicant: NTT DOCOMO, INC., Chiyoda-ku (JP)

(72) Inventors: Tamami Maruyama, Chiyoda-ku (JP); Yasuhiro Oda, Chiyoda-ku (JP); Jiyun Shen, Chiyoda-ku (JP); Ngoc Hao Tran, Chiyoda-ku (JP)

(73) Assignee: NTT DOCOMO, INC., Chiyoda-ku (JP)

( * ) Notice: Subject to any disclaimer, the term of this patent is extended or adjusted under 35 U.S.C. 154(b) by 72 days.

(21) Appl. No.: 14/394,623

(22) PCT Filed: May 20, 2013

(86) PCT No.: PCT/JP2013/063977

§ 371 (c)(1),
(2) Date: Oct. 15, 2014

(87) PCT Pub. No.: WO2014/020969

PCT Pub. Date: Feb. 6, 2014

(65) Prior Publication Data

US 2015/0070246 A1 Mar. 12, 2015

(30) Foreign Application Priority Data

Jul. 31, 2012 (JP) ..... 2012-170319
Jul. 31, 2012 (JP) ..... 2012-170320
(Continued)

(51) Int. Cl.
*H01Q 15/14* (2006.01)
*H01Q 15/00* (2006.01)

(52) U.S. Cl.
CPC ..... *H01Q 15/14* (2013.01); *H01Q 15/008* (2013.01)

(58) Field of Classification Search
CPC ..... H01Q 15/14
See application file for complete search history.

(56) References Cited

U.S. PATENT DOCUMENTS 9,407,011 B2 * 8/2016 Zaghloul ..... H01Q 19/10
2009/0153391 A1 * 6/2009 Migliaccio ..... H01Q 3/46 342/5
(Continued)

FOREIGN PATENT DOCUMENTS

JP 2010-181213 8/2010
JP 2012-34331 2/2012
(Continued)

OTHER PUBLICATIONS

International Search Report issued Aug. 13, 2013, in PCT/JP13/063977 filed May 20, 2013.
(Continued)

*Primary Examiner* — Trinh Dinh
(74) *Attorney, Agent, or Firm* — Oblon, McClelland, Maier & Neustadt, L.L.P.

(57) ABSTRACT

A reflectarray reflects an incident wave in a desired direction, and the reflectarray includes a plurality of elements arranged in a first direction and in a second direction perpendicular to the first direction. The elements reflect the incident wave. A phase of a reflected wave by one element among the plurality of elements differs from a phase of the reflected wave by an element adjacent to the one element in the first direction by a predetermined value, and the phase of the reflected wave by the one element is equal to a phase of the reflected wave by an element adjacent to the one element in the second direction. Gap sizes between patches of a predetermined plural number of elements arranged in the
(Continued)

first direction vary from a smallest value to a largest value. Here, an oblique TM incidence is utilized at a spurious resonance frequency.

2 Claims, 60 Drawing Sheets

(30) Foreign Application Priority Data

Aug. 27, 2012 (JP) ..... 2012-186988
Aug. 27, 2012 (JP) ..... 2012-186989

(56) References Cited

U.S. PATENT DOCUMENTS

2010/0085272 A1* 4/2010 Legay ..... H01Q 3/46 343/913
2011/0210904 A1 9/2011 Maruyama et al.
2011/0210905 A1 9/2011 Maruyama et al.
2011/0210906 A1 9/2011 Maruyama et al.
2012/0105305 A1 5/2012 Maruyama et al.
2015/0229029 A1* 8/2015 Maruyama ..... H01Q 15/14 343/912

FOREIGN PATENT DOCUMENTS

JP 2012-34332 2/2012
JP 2012-34333 2/2012
WO WO 2010/137713 A1 12/2010

OTHER PUBLICATIONS

Japanese Office Action issued Oct. 29, 2013 in Japanese Patent Application No. 2012-170319 filed Jul. 31, 2012 (with English Translation).
Japanese Office Action issued Oct. 29, 2013 in Japanese Patent Application No. 2012-170320 filed Jul. 31, 2012 (with English Translation).
Japanese Office Action issued Feb. 12, 2014 in Japanese Patent Application No. 2012-186989 filed Aug. 27, 2012 (with English Translation).
Japanese Office Action issued Apr. 1, 2014 in Japanese Patent Application No. 2012-170319 filed Jul. 31, 2012 (with English Translation).
Yang, et al., "Single-Layer Multi-band Circularly Polarized Reflectarray Antenna: Concept, Design, and Measurement", URSI General Assembly, Aug. 7-16, 2008, 4pages.
Maruyama, et al., "Dual Frequency Selective Reflectarray for Propagation Improvement", IEEE iWAT, 2010, 5464764, Mar. 2010, 4 pages.
Maruyama, et al., "Capacitance Value Control for Metamaterial Reflectarray using Multi-layer Mushroom Structure with Parasitic Patches", Aces Journal, vol. 27, No. 1, Jan. 2012, pp. 28-41.
Maruyama, et al., "Multi-band Reflectarray using Mushroom Structure", IEEE ICWITS, 2012, 4 pages.
Maruyama, et al., "Design of Wide Angle Reflection Reflectarray Using Multi-layer Mushroom Structure to Improve Propagation", IEEE URSI General Assembly and Scientific Symposium, 2011 XXXth URSI, Aug. 2011, 4 pages.
Shen, et al., "A Novel Approach for Capacity Improvement of 2x2 MIMO in LOS Channel Using Reflectarray", VTC 2011 spring, 10.1109/VETECS.2011.5956339, May 2011, 5 pages.
Pozar, et al., "Design of Millimeter Wave Microstrip Reflectarrays", IEEE Transactions on Antennas and Propagation, vol. 45, No. 2, Feb. 1997, pp. 287-296.
Li, et al., "Frequency Selective Reflectarray Using Crossed-Dipole Elements With Square Loops for Wireless Communication Applications", IEEE Transactions on Antennas and Propagation, vol. 59, No. 1, Jan. 2011, pp. 89-99.
Nayeri, et al., Single-Feed Multi-Beam Reflectarray Antennas, IEEE AP-S, 2010, 4 pages.
Maruyama, et al., "The design of Reflectarray using Dual Resonant Characteristics of Mushroom like Structure", ACES2012, 2012, 6 pages.
Extended European Search Report issued Feb. 22, 2016 in Patent Application 13825417.2.

* cited by examiner

FIG.16

| y[mm] \ x[mm] | 0 | 4 | 8 | 12 | 16 | 20 |
|---|---|---|---|---|---|---|
| 0 | 0 | −18 | −36 | −54 | −72 | −90 |
| −4 | 0 | −18 | −36 | −54 | −72 | −90 |
| −8 | 0 | −18 | −36 | −54 | −72 | −90 |
| −12 | 0 | −18 | −36 | −54 | −72 | −90 |
| −16 | 0 | −18 | −36 | −54 | −72 | −90 |
| −20 | 0 | −18 | −36 | −54 | −72 | −90 |

---- THEORETICAL VALUE FOR $\theta_i$ = 30 DEGREES
—— THEORETICAL VALUE FOR $\theta_i$ = 70 DEGREES
● HFSS SIMULATION VALUE FOR $\theta_i$ = 30 DEGREES
■ HFSS SIMULATION VALUE FOR $\theta_i$ = 70 DEGREES

FIG.35

| GAP SIZE[mm] | REFLECTION PHASE[DEGREE] |
|---|---|
| 0.529128462 | 0 |
| 0.475568404 | −18 |
| 0.424777069 | −36 |
| 0.375703115 | −54 |
| 0.323009479 | −72 |
| 0.275019015 | −90 |
| 0.206953545 | −108 |
| 0.149065482 | −126 |
| 0.114108239 | −144 |
| 0.069163317 | −162 |
| | −180 |
| | 162 |
| | 144 |
| | 126 |
| 1.509708956 | 108 |
| 1.135799907 | 90 |
| 0.920175801 | 72 |
| 0.773751625 | 54 |
| 0.679217317 | 36 |
| 0.596024815 | 18 |

FIG.41

| GAP SIZE[mm] | REFLECTION PHASE[DEGREE] |
|---|---|
| 0.490598558 | 0 |
| 0.454031441 | -18 |
| 0.413447857 | -36 |
| 0.365070738 | -54 |
| 0.322738186 | -72 |
| 0.259956009 | -90 |
| 0.222165292 | -108 |
| 0.173651505 | -126 |
| 0.122540842 | -144 |
| 0.076550672 | -162 |
| 0.000555591 | -180 |
| 1.347206607 | 162 |
| 1.27877118 | 144 |
| 1.157979194 | 126 |
| 1.005460368 | 108 |
| 0.86013403 | 90 |
| 0.754133992 | 72 |
| 0.661387115 | 54 |
| 0.614063262 | 36 |
| 0.549661131 | 18 |

FIG.44 x → y ↓

| COORDI-NATES | 0 | 4.5 | 9 | 13.5 | 18 | 22.5 | 27 | 31.5 | 36 | 40.5 | 45 | 49.5 |
|---|---|---|---|---|---|---|---|---|---|---|---|---|
| 0.000 | 0.00 | 0.00 | 0.00 | 0.00 | 0.00 | 0.00 | 0.00 | 0.00 | 0.00 | 0.00 | 0.00 | 0.00 |
| −4.500 | 36.00 | 36.00 | 36.00 | 36.00 | 36.00 | 36.00 | 36.00 | 36.00 | 36.00 | 36.00 | 36.00 | 36.00 |
| −9.000 | 72.00 | 72.00 | 72.00 | 72.00 | 72.00 | 72.00 | 72.00 | 72.00 | 72.00 | 72.00 | 72.00 | 72.00 |
| −13.500 | 108.00 | 108.00 | 108.00 | 108.00 | 108.00 | 108.00 | 108.00 | 108.00 | 108.00 | 108.00 | 108.00 | 108.00 |
| −18.000 | 144.00 | 144.00 | 144.00 | 144.00 | 144.00 | 144.00 | 144.00 | 144.00 | 144.00 | 144.00 | 144.00 | 144.00 |
| −22.500 | −180.00 | −180.00 | −180.00 | −180.00 | −180.00 | −180.00 | −180.00 | −180.00 | −180.00 | −180.00 | −180.00 | −180.00 |
| −27.000 | −144.00 | −144.00 | −144.00 | −144.00 | −144.00 | −144.00 | −144.00 | −144.00 | −144.00 | −144.00 | −144.00 | −144.00 |

FIG.48 x y

| COORDI-NATES | 0.0 | 4.5 | 9.0 | 13.5 | 18.0 | 22.5 | 27.0 | 31.5 | 36.0 | 40.5 |
|---|---|---|---|---|---|---|---|---|---|---|
| 0.0 | 0.0 | −36.0 | −72.0 | −108.0 | −144.0 | −180.0 | 144.0 | 108.0 | 72.0 | 36.0 |
| −4.5 | 36.0 | 0.0 | −36.0 | −72.0 | −108.0 | −144.0 | 180.0 | 144.0 | 108.0 | 72.0 |
| −9.0 | 72.0 | 36.0 | 0.0 | −36.0 | −72.0 | −108.0 | −144.0 | 180.0 | 144.0 | 108.0 |
| −13.5 | 108.0 | 72.0 | 36.0 | 0.0 | −36.0 | −72.0 | −108.0 | −144.0 | −180.0 | 144.0 |
| −18.0 | 144.0 | 108.0 | 72.0 | 36.0 | 0.0 | −36.0 | −72.0 | −108.0 | −144.0 | 180.0 |
| −22.5 | −180.0 | 144.0 | 108.0 | 72.0 | 36.0 | 0.0 | −36.0 | −72.0 | −108.0 | −144.0 |
| −27.0 | −144.0 | −180.0 | 144.0 | 108.0 | 72.0 | 36.0 | 0.0 | −36.0 | −72.0 | −108.0 |
| −31.5 | −108.0 | −144.0 | −180.0 | 144.0 | 108.0 | 72.0 | 36.0 | 0.0 | −36.0 | −72.0 |
| −36.0 | −72.0 | −108.0 | −144.0 | −180.0 | 144.0 | 108.0 | 72.0 | 36.0 | 0.0 | −36.0 |
| −40.5 | −36.0 | −72.0 | −108.0 | −144.0 | −180.0 | 144.0 | 108.0 | 72.0 | 36.0 | 0.0 |

FIG.52 x y

| COORDI-NATES | 0 | 4.5 | 9 | 13.5 | 18 | 22.5 | 27 | 31.5 | 36 | 40.5 |
|---|---|---|---|---|---|---|---|---|---|---|
| 0 | 0 | −36 | −72 | −108 | −144 | −180 | 0 | 0 | 0 | 0 |
| −4.5 | 36 | 0 | −36 | −72 | −108 | −144 | 36 | 36 | 36 | 36 |
| −9 | 72 | 36 | 0 | −36 | −72 | −108 | 72 | 72 | 72 | 72 |
| −13.5 | 108 | 72 | 36 | 0 | −36 | −72 | 108 | 108 | 108 | 108 |
| −18 | 144 | 108 | 72 | 36 | 0 | −36 | 144 | 144 | 144 | 144 |
| −22.5 | −180 | 144 | 108 | 72 | 36 | 0 | −180 | −180 | −180 | −180 |
| −27 | −144 | −180 | 144 | 108 | 72 | 36 | −144 | −144 | −144 | −144 |
| −31.5 | −108 | −144 | −180 | 144 | 108 | 72 | −108 | −108 | −108 | −108 |
| −36 | −72 | −108 | −144 | −180 | 144 | 108 | −72 | −72 | −72 | −72 |
| −40.5 | −36 | −72 | −108 | −144 | −180 | 144 | −36 | −36 | −36 | −36 |

< FIRST REGION >

<SECOND REGION>

<SECOND REGION>

FIG.53

| GAP SIZE[mm] | REFLECTION PHASE |
|---|---|
| 0.880254929 | 0 |
| 0.736266 | −36 |
| 0.592563674 | −72 |
| 0.420094809 | −108 |
| 0.21061028 | −144 |
| 2.95 | −180 |
| 2.85 | 144 |
| 1.922123656 | 108 |
| 1.298532643 | 72 |
| 1.044524438 | 36 |

FIG.54 x → y ↓

| COORDI-NATES | 0 | 4.5 | 9 | 13.5 | 18 | 22.5 | 27 | 31.5 | 36 | 40.5 | 45 | 49.5 | 54 | 58.5 | 63 | 67.5 | 72 | 76.5 | 81 | 85.5 |
|---|---|---|---|---|---|---|---|---|---|---|---|---|---|---|---|---|---|---|---|---|
| 0 | 0 | −36 | −72 | −108 | −144 | −180 | 0 | 0 | 0 | 0 | 0 | −36 | −72 | −108 | −144 | −180 | 0 | 0 | 0 | 0 |
| −4.5 | 36 | 0 | −36 | −72 | −108 | −144 | 36 | 36 | 36 | 36 | 36 | 0 | −36 | −72 | −108 | −144 | 36 | 36 | 36 | 36 |
| −9 | 72 | 36 | 0 | −36 | −72 | −108 | 72 | 72 | 72 | 72 | 72 | 36 | 0 | −36 | −72 | −108 | 72 | 72 | 72 | 72 |
| −13.5 | 108 | 72 | 36 | 0 | −36 | −72 | 108 | 108 | 108 | 108 | 108 | 72 | 36 | 0 | −36 | −72 | 108 | 108 | 108 | 108 |
| −18 | 144 | 108 | 72 | 36 | 0 | −36 | 144 | 144 | 144 | 144 | 144 | 108 | 72 | 36 | 0 | −36 | 144 | 144 | 144 | 144 |
| −22.5 | −180 | 144 | 108 | 72 | 36 | 0 | −180 | −180 | −180 | −180 | −180 | 144 | 108 | 72 | 36 | 0 | −180 | −180 | −180 | −180 |
| −27 | −144 | −180 | 144 | 108 | 72 | 36 | −144 | −144 | −144 | −144 | −144 | −180 | 144 | 108 | 72 | 36 | −144 | −144 | −144 | −144 |
| −31.5 | −108 | −144 | −180 | 144 | 108 | 72 | −108 | −108 | −108 | −108 | −108 | −144 | −180 | 144 | 108 | 72 | −108 | −108 | −108 | −108 |
| −36 | −72 | −108 | −144 | −180 | 144 | 108 | −72 | −72 | −72 | −72 | −72 | −108 | −144 | −180 | 144 | 108 | −72 | −72 | −72 | −72 |
| −40.5 | −36 | −72 | −108 | −144 | −180 | 144 | −36 | −36 | −36 | −36 | −36 | −72 | −108 | −144 | −180 | 144 | −36 | −36 | −36 | −36 |
| −45 | 0 | −36 | −72 | −108 | −144 | −180 | 0 | 0 | 0 | 0 | 0 | −36 | −72 | −108 | −144 | −180 | 0 | 0 | 0 | 0 |
| −49.5 | 36 | 0 | −36 | −72 | −108 | −144 | 36 | 36 | 36 | 36 | 36 | 0 | −36 | −72 | −108 | −144 | 36 | 36 | 36 | 36 |
| −54 | 72 | 36 | 0 | −36 | −72 | −108 | 72 | 72 | 72 | 72 | 72 | 36 | 0 | −36 | −72 | −108 | 72 | 72 | 72 | 72 |
| −58.5 | 108 | 72 | 36 | 0 | −36 | −72 | 108 | 108 | 108 | 108 | 108 | 72 | 36 | 0 | −36 | −72 | 108 | 108 | 108 | 108 |
| −63 | 144 | 108 | 72 | 36 | 0 | −36 | 144 | 144 | 144 | 144 | 144 | 108 | 72 | 36 | 0 | −36 | 144 | 144 | 144 | 144 |
| −67.5 | −180 | 144 | 108 | 72 | 36 | 0 | −180 | −180 | −180 | −180 | −180 | 144 | 108 | 72 | 36 | 0 | −180 | −180 | −180 | −180 |
| −72 | −144 | −180 | 144 | 108 | 72 | 36 | −144 | −144 | −144 | −144 | −144 | −180 | 144 | 108 | 72 | 36 | −144 | −144 | −144 | −144 |
| −76.5 | −108 | −144 | −180 | 144 | 108 | 72 | −108 | −108 | −108 | −108 | −108 | −144 | −180 | 144 | 108 | 72 | −108 | −108 | −108 | −108 |
| −81 | −72 | −108 | −144 | −180 | 144 | 108 | −72 | −72 | −72 | −72 | −72 | −108 | −144 | −180 | 144 | 108 | −72 | −72 | −72 | −72 |
| −85.5 | −36 | −72 | −108 | −144 | −180 | 144 | −36 | −36 | −36 | −36 | −36 | −72 | −108 | −144 | −180 | 144 | −36 | −36 | −36 | −36 |

<SECOND REGION> <FIRST REGION> <SECOND REGION> <FIRST REGION> <SECOND REGION>

FIG.61 x → y ↓

| COORDI-NATES | 0 | 4.1 | 8.2 | 12.3 | 16.4 | 20.5 | 24.6 | 28.7 | 32.8 | 36.9 | 41 | 45.1 | 49.2 | 53.3 | 57.4 |
|---|---|---|---|---|---|---|---|---|---|---|---|---|---|---|---|
| 0 | 0 | −24 | −48 | −72 | −96 | −120 | −144 | −168 | 168 | 144 | 120 | 96 | 72 | 48 | 24 |
| −4.1 | 24 | 0 | −24 | −48 | −72 | −96 | −120 | −144 | −168 | 168 | 144 | 120 | 96 | 72 | 48 |
| −8.2 | 48 | 24 | 0 | −24 | −48 | −72 | −96 | −120 | −144 | −168 | 168 | 144 | 120 | 96 | 72 |
| −12.3 | 72 | 48 | 24 | 0 | −24 | −48 | −72 | −96 | −120 | −144 | −168 | 168 | 144 | 120 | 96 |
| −16.4 | 96 | 72 | 48 | 24 | 0 | −24 | −48 | −72 | −96 | −120 | −144 | −168 | 168 | 144 | 120 |
| −20.5 | 120 | 96 | 72 | 48 | 24 | 0 | −24 | −48 | −72 | −96 | −120 | −144 | −168 | 168 | 144 |
| −24.6 | 144 | 120 | 96 | 72 | 48 | 24 | 0 | −24 | −48 | −72 | −96 | −120 | −144 | −168 | 168 |
| −28.7 | 168 | 144 | 120 | 96 | 72 | 48 | 24 | 0 | −24 | −48 | −72 | −96 | −120 | −144 | −168 |
| −32.8 | −168 | 168 | 144 | 120 | 96 | 72 | 48 | 24 | 0 | −24 | −48 | −72 | −96 | −120 | −144 |
| −36.9 | −144 | −168 | 168 | 144 | 120 | 96 | 72 | 48 | 24 | 0 | −24 | −48 | −72 | −96 | −120 |
| −41 | −120 | −144 | −168 | 168 | 144 | 120 | 96 | 72 | 48 | 24 | 0 | −24 | −48 | −72 | −96 |
| −45.1 | −96 | −120 | −144 | −168 | 168 | 144 | 120 | 96 | 72 | 48 | 24 | 0 | −24 | −48 | −72 |
| −49.2 | −72 | −96 | −120 | −144 | −168 | 168 | 144 | 120 | 96 | 72 | 48 | 24 | 0 | −24 | −48 |
| −53.3 | −48 | −72 | −96 | −120 | −144 | −168 | 168 | 144 | 120 | 96 | 72 | 48 | 24 | 0 | −24 |
| −57.4 | −24 | −48 | −72 | −96 | −120 | −144 | −168 | 168 | 144 | 120 | 96 | 72 | 48 | 24 | 0 |

REFLECTARRAY

TECHNICAL FIELD

The disclosed invention relates to a reflectarray and the like.

BACKGROUND ART

A reflectarray is often used to improve a propagation environment and an area in a mobile communication system. When a reflectarray reflects an incident wave, the reflectarray can cause the incident wave to reflect in a desired direction as well as a direction of specular reflection. Patent Document 1 discloses a reflectarray according to related art.

RELATED ART DOCUMENT

Patent Document

[Patent Document 1] Japanese Unexamined Patent Publication No. 2012-34331

SUMMARY OF THE INVENTION

Problem to be Solved by the Invention

For a reflectarray according to related art, it is necessary that an incident wave; a specular reflected wave; and a reflected wave in a desired direction be in the same plane. It may not be possible to reflect the incident wave in a suitable direction which is different from a direction on a surface, which surface is defined by the incident wave and the specular reflected wave. It may not be possible to reflect the incident wave in a suitable plurality of directions. Accordingly, it is possible that a degree of freedom on designing the reflectarray is restricted. Since all of the incident wave, the specular reflected wave, and the reflected wave in the desired direction are on the same surface, it is possible that the reflected wave in the desired direction is degraded due to the specular reflection.

In order to reflect an incident wave in a desirable direction, it may be necessary to change the reflection phase in both an x-axis direction and in a y-axis direction. In a reflectarray according to related art, a design is adopted such that a total of reflection phases by the predetermined number of elements arranged in one of either the direction of the x-axis or the direction of the y-axis is 360 degrees. With this structure, it may not be possible to vary the reflection phase both in the x-axis direction and in the y-axis direction.

An object of the disclosed invention is to provide a reflectarray that can reflect an incident wave from a first direction into a desirable second direction. Another object of the disclosed invention is to provide a multi-beam reflectarray that can reflect an incident wave in a desirable plurality of directions.

Means for Solving the Problem

A reflectarray that reflects an incident wave in a desired direction, the reflectarray including a plurality of elements, wherein the elements are arranged in a first axial direction and in a second axial direction which is perpendicular to the first axial direction, wherein a first phase of a first reflected wave by a suitable first element included in the plurality of the elements is different by a predetermined value from a second phase of a second reflected wave by a second element neighboring the first element in the first axial direction, and the first phase is equal to a third phase of a third reflected wave by a third element neighboring the first element in the second axial direction, wherein the sizes of gaps between patches of a predetermined plurality of elements arranged in the first axial direction gradually vary along the first axial direction from a minimum value to a maximum value, wherein phases of reflected waves by the predetermined plurality of elements vary in a range of 360 degrees in units of the predetermined value, and wherein the incident wave obliquely enters the reflectedarray as a transverse magnetic (TM) wave, wherein a direction of an amplitude of an electric field of the incident wave is along a reflection surface of the reflectarray, and a frequency of the incident wave and a distance between the neighboring elements among the plural elements are fixed to cause a spurious resonance to be caused.

Effect of the Present Invention

According to an embodiment of the disclosed invention, a reflectarray can be provided such that it can reflect an incident wave to a desirable direction. In addition, a multi-beam reflectarray can be provided such that it can reflect an incident wave in a desirable plurality of directions.

BRIEF DESCRIPTION OF THE DRAWINGS

FIG. 16 is a diagram showing an example of reflection phases of corresponding elements included in the reflectarray;

FIG. 35 is a diagram showing a relationship between the gap sizes of the 16 elements and the reflection phases in a form of a table;

FIG. 41 is a diagram showing correspondence between the gap sizes of the 20 elements and the reflection phases in the form of table;

FIG. 44 is a diagram showing reflection phases which are achieved by corresponding individual elements;

FIG. 48 is a diagram showing reflection phases which are achieved by corresponding individual elements included in the reflectarray;

FIG. 52 is a diagram showing reflection phases which are achieved by individual elements included in the multi-beam reflectarray;

FIG. 53 is a diagram showing gap sizes which are necessary for the individual elements to achieve corresponding predetermined reflection phases;

FIG. 54 is a diagram showing reflection phases which are achieved by corresponding individual elements included in the multi-beam reflectarray;

FIG. 61 is a diagram showing reflection phases which are achieved by corresponding individual elements included in the reflectarray.

EMBODIMENTS FOR CARRYING OUT THE INVENTION

Figure 1:
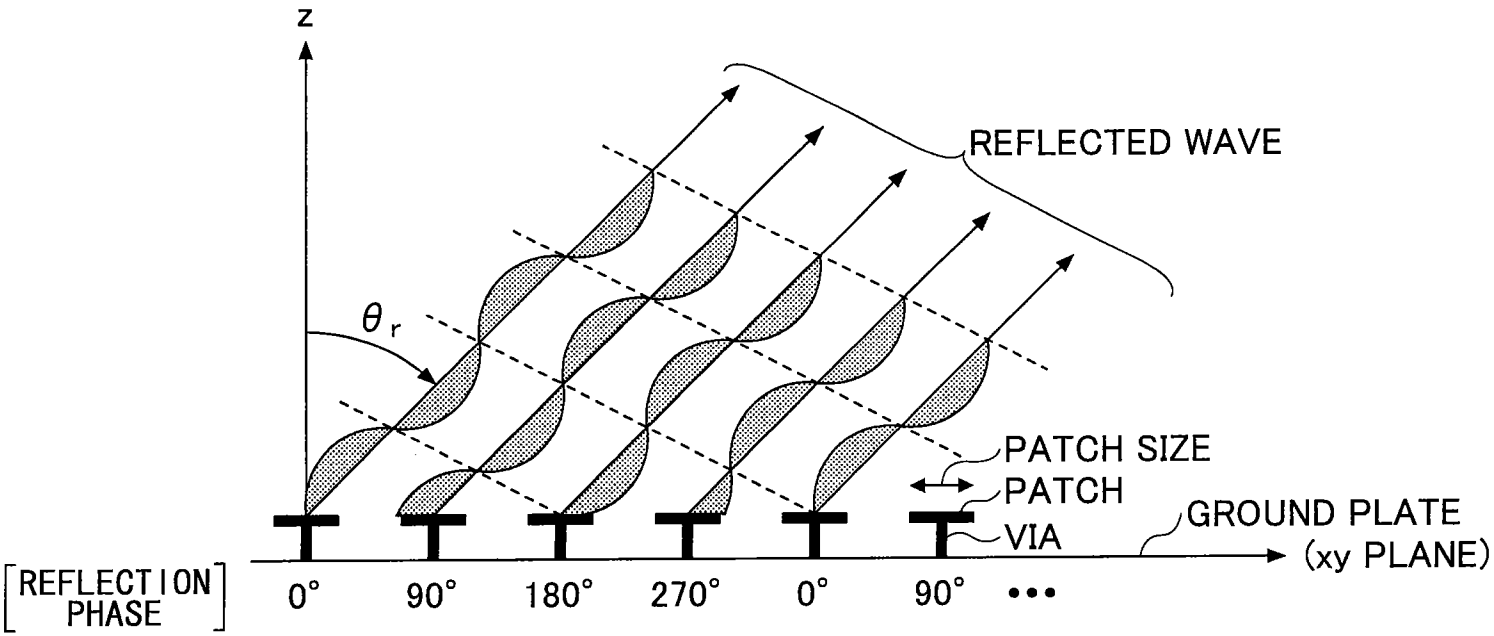
FIG. 1 is a schematic diagram illustrating a principle of a reflectarray.

An embodiment is explained from the following perspectives, while referring to the accompanying drawings. In the drawings, the same reference numeral or the same reference symbol is attached to the same elements.

1. Reflectarray
2. Phase difference control
2.1 One-dimensional phase difference control
2.2 Two-dimensional phase difference control
3. Simulation result
4. Gap-variable spurious resonance
4.1 Reflection phase
4.2 Dual resonance
4.3 Design method
4.4 Difference as to whether a spurious portion is utilized
5. Multi-beam reflectarray The separations of the items are not essential to the present invention. Depending on necessity, subject matter described in two or more items may be combined and used, and subject matter described in an item may be applied to subject matter described in another item (provided that they do not contradict).

<1. Reflectarray>

First, a reflectarray is explained. The reflectarray is assumed in the disclosed invention. FIG. 1 is a schematic diagram illustrating a principle of a reflectarray. Supposed that, as depicted, a phase of a reflected wave by a plurality of elements arranged on a ground plate is gradually varied between the neighboring elements. For a case of the depicted example, a phase difference between reflected waves by the corresponding neighboring elements is 90 degrees. Since a radio wave propagates in a direction perpendicular to an equiphasic surface (which is shown by a dashed line), an incident wave can be reflected in a desired direction by forming a reflectarray by suitably adjusting reflection phases from corresponding elements and by two-dimensionally arranging the elements.

Figure 2:
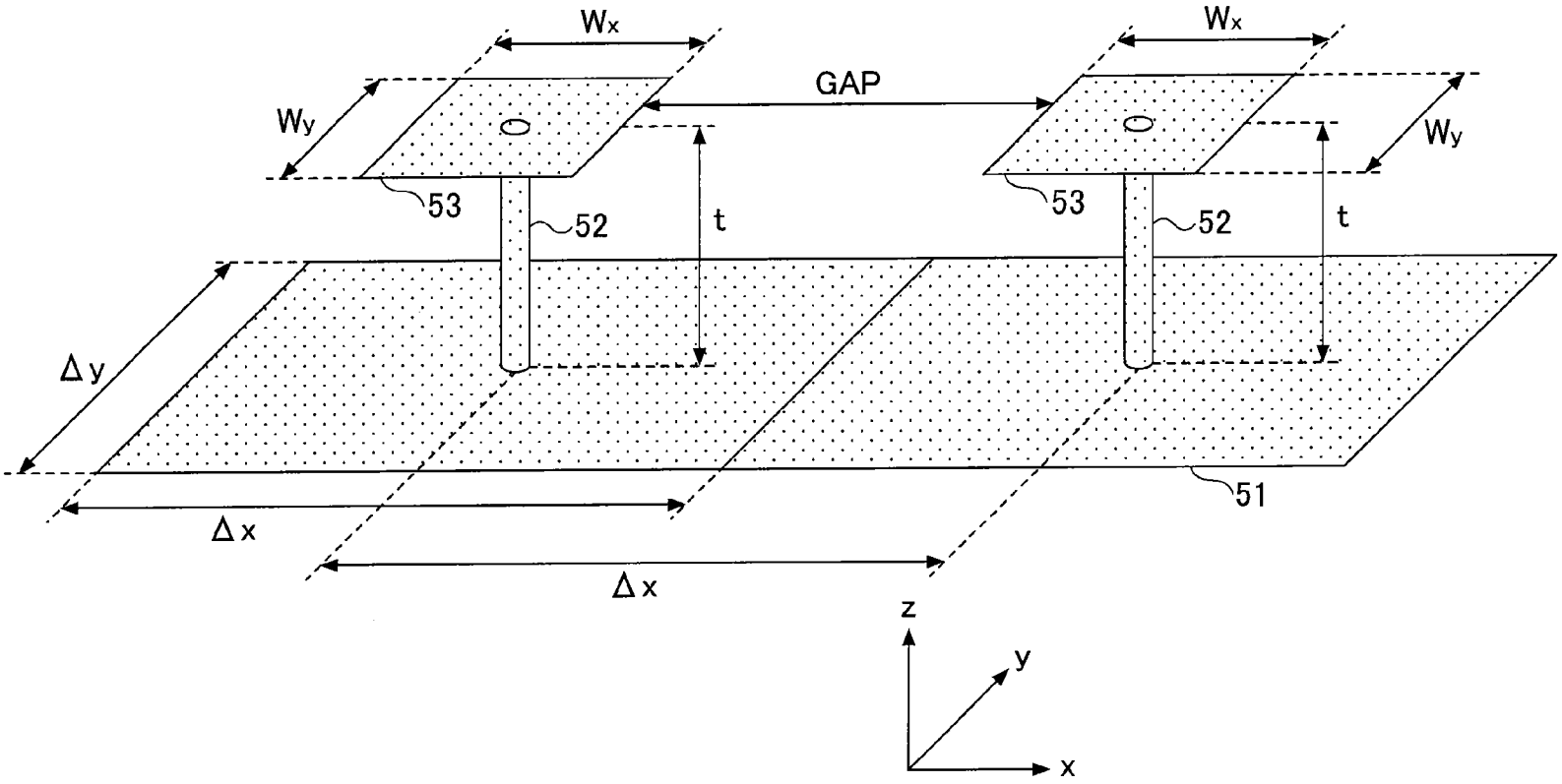
FIG. 2 is a diagram showing a situation in which elements are formed by mushroom-like structures.

FIG. 2 shows a mushroom-like structure which can be used as an element of the reflectarray. The mushroom-like structure includes a ground plate 51; a via 52; and a patch 53. The ground plate 51 is a conductor which provides a common potential to a plurality of the mushroom-like structures. Δx shows a distance between the vias of the corresponding neighboring mushroom-like structures in an x-axis direction. Δy shows a distance between the vias of the corresponding neighboring mushroom-like structures in an y-axis direction. Δx and Δy represent a size of the ground plate 51 corresponding to a single mushroom-like structure. In general, the ground plate 51 is as large as the array in which a plurality of mushroom-like structures is arranged. The via 52 is disposed so as to electrically short circuit the ground plate 51 and the patch 53. The patch 53 has a length of Wx in the x-axis direction, and a length of Wy in the y-axis direction. The patch 53 is arranged in parallel with the ground plate 51, and the patch 53 is separated from the ground plate 51 by a distance t. The patch 53 is short-circuited to the ground plate 51 through the via 52. For simplification of the depiction, only two mushroom-like structures are shown in FIG. 2. However, in the reflectarray, a plurality of such mushroom-like structures is arranged in the x-axis direction and in the y-axis direction.

Figure 3:
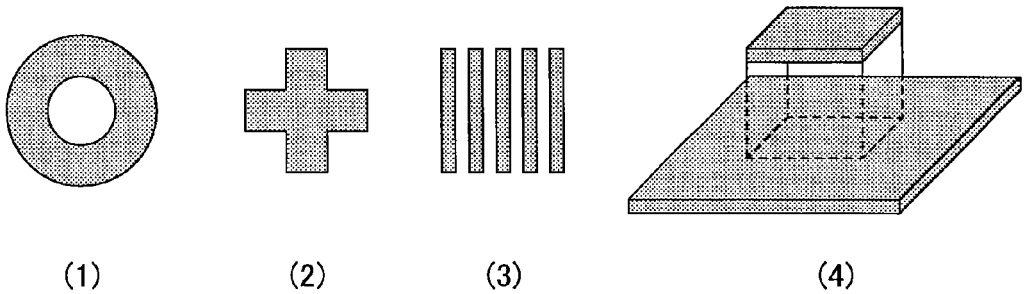
FIG. 3 is a diagram exemplifying alternative structures of the element.

For the example shown in FIG. 2, each element included in the reflectarray is formed to have the mushroom-like structure. However, it is not essential to the embodiment. The reflectarray may be formed of suitable elements which can reflect a radio wave. For example, instead of a patch having a perfect square shape, an element including a conductive pattern having a ring shape ((1) of FIG. 3), a conductive pattern having a cross shape ((2) of FIG. 3), a plurality of parallel conductive patterns ((3) of FIG. 3), or the like may be utilized. In the mushroom-like structure, a structure may be utilized which does not include a via for connecting a patch to a ground plate ((4) of FIG. 3). However, the mushroom-like structure can preferably be adopted for the element as described above, from the perspective that a small reflection element can be easily designed.

Figure 4:
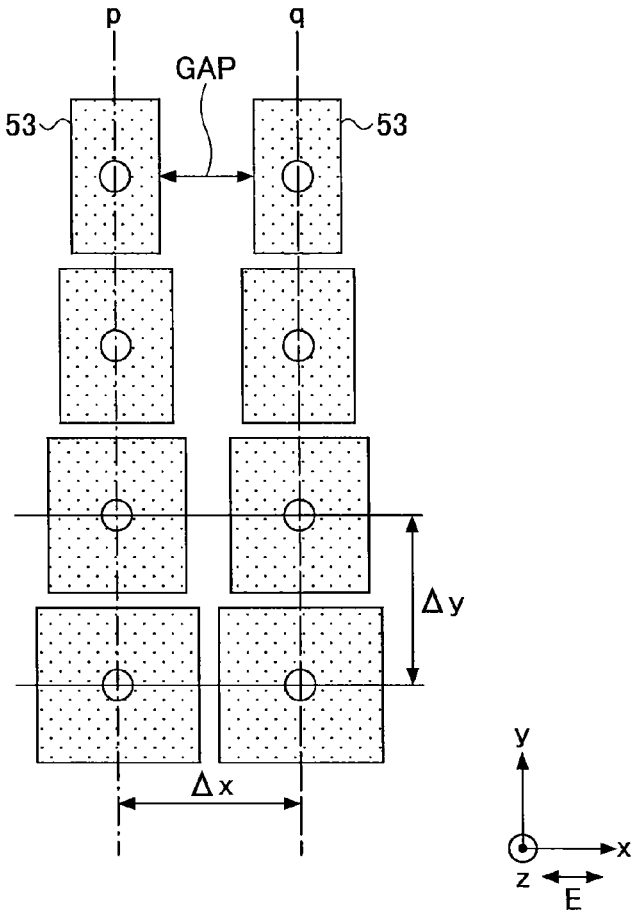
FIG. 4 is an enlarged plane view of the reflectarray.
Figure 5:
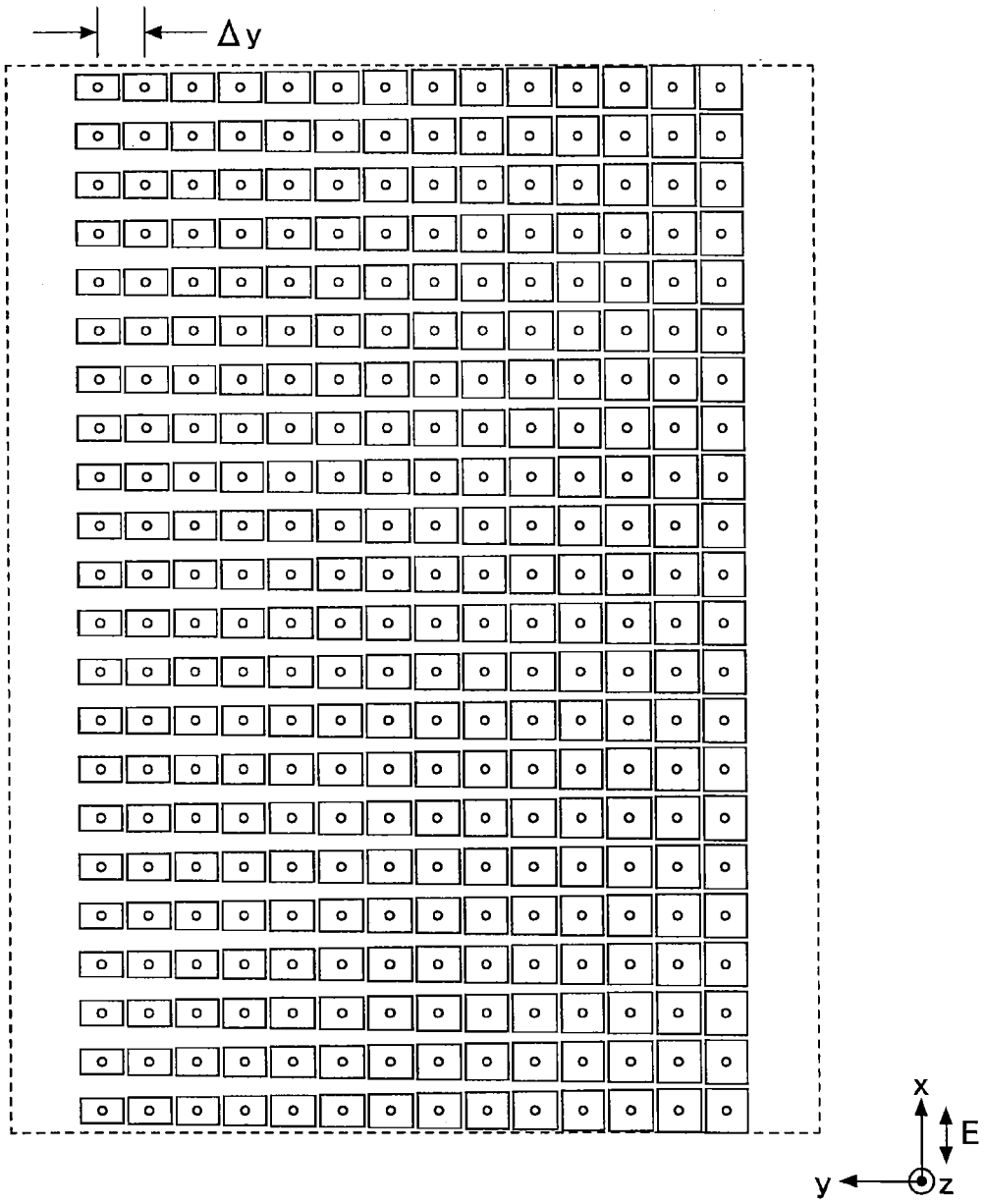
FIG. 5 is a plane view of the reflectarray.

FIG. 4 shows an enlarged plane view of the reflectarray such as shown in FIG. 2. There are shown four patches 53 arranged in a line along a line p. Further, there are shown four patches 43 neighboring to the line. The four patches 43 are arranged along a line q. The number of the patches can be any suitable number. FIG. 5 shows a state in which multiple elements such as shown in FIGS. 2 and 4 are arranged on an xy plane, thereby forming a reflectarray.

Figure 6:
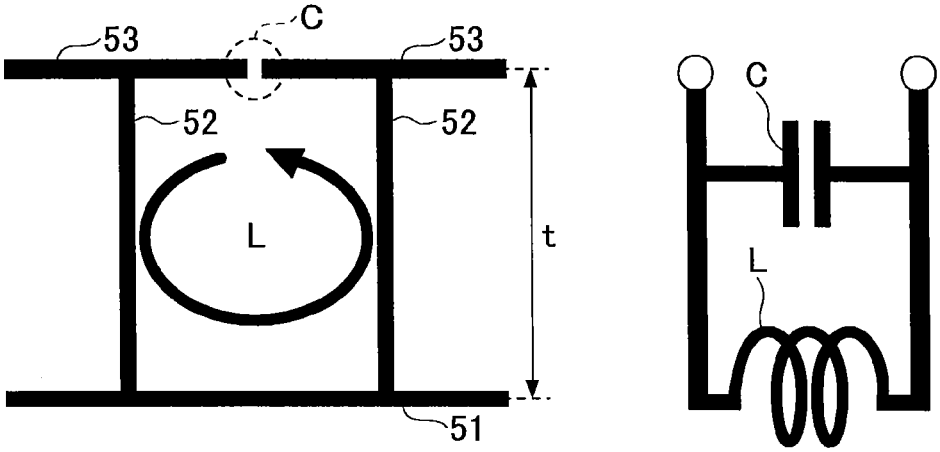
FIG. 6 is a diagram of an equivalent circuit of the element formed by the mushroom-like structure.

FIG. 6 shows an equivalent circuit of the mushroom-like structure such as shown in FIGS. 2, 4, and 5. Due to the gaps between the patches 53 of the mushroom-like structures arranged along the line p and the patches 53 of the mushroom-like structures arranged along the line q of FIG. 4, capacitance C occurs. Additionally, due to the vias 52 of the mushroom-like structures arranged along the line p and the vias 52 of the mushroom-like structures arranged along the line q, inductance L occurs. Accordingly, an equivalent circuit of the neighboring mushroom-like structures is a circuit such as shown in the right side of FIG. 6. Namely, in the equivalent circuit, the inductance L and the capacitance C are connected in parallel. The capacitance C, the inductance L, a surface impedance Zs and a reflection coefficient Γ can be represented as follows.

[Expression 1]

$$C = \frac{\varepsilon_0(1+\varepsilon_r)W_y}{\pi}\operatorname{arccosh}\left(\frac{\text{ELEMENT DISTANCE}}{GAP}\right) \tag{1}$$

$$L = \mu \cdot t \tag{2}$$

$$Z_s = \frac{j\omega L}{1-\omega^2 LC} \tag{3}$$

$$\Gamma = \frac{Z_s - \eta}{Z_s + \eta} = |\Gamma|\exp(j\varphi) \tag{4}$$

In Formula (1), $\in_0$ denotes the vacuum permittivity, and $\in_r$ denotes relative permittivity of a material which is disposed between the patches. For the above-described example, the distance between the elements is the distance between the vias Δx in the x-axis direction. The gap is spacing between the neighboring patches. For the above-described example, it is (Δx−Wx). Wx represents a length of the patch in the x-axis direction. Namely, the argument of the arccosh function represents a ratio between the distance between the elements and the gap. In Formula (2), μ represents magnetic permeability of a material disposed between vias, and t represents a height of the patch 53 (a distance from the ground plate 51 to the patch 53). In Formula (3), ω represents an angular frequency, and j represents the imaginary unit. In Formula (4), η represents free space impedance, and ϕ represents a phase difference.

Figure 7:
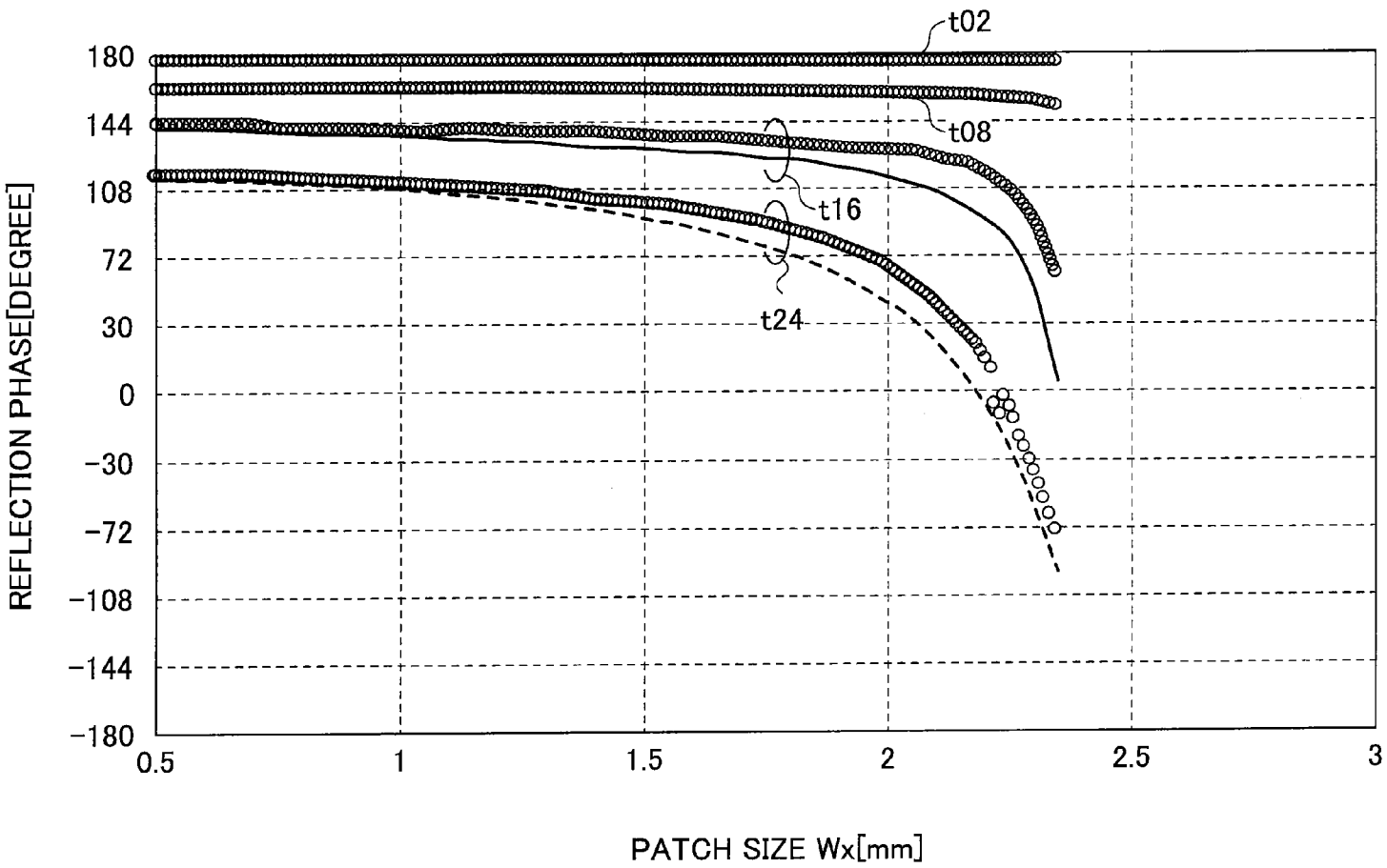
FIG. 7 is a diagram showing a relationship between a size Wx of a patch of the element formed by the mushroom-like structure and a reflection phase.

FIG. 7 shows a relationship between the size of the patch Wx of the mushroom-like structure (such as shown in FIGS. 2, 4, and 5) and the reflection phase. In general, the reflection phase of the mushroom-like structure (element) becomes 0 in the vicinity of a resonance frequency. The resonance frequency is determined by the above-described capacitance C and inductance L. Accordingly, for designing a reflectarray, the capacitance C and the inductance L can be suitably adjusted, so that the individual elements may achieve suitable corresponding reflection phases. In the figure, solid lines indicate theoretical values, and circular marks indicate simulation values obtained by finite element method analysis. FIG. 7 shows, for each of four different heights of the vias or thicknesses t, a relationship between the size of the patch Wx and the reflection phase. A reference symbol t02 shows a graph for a case in which the distance t is 0.2 mm. A reference symbol t08 shows a graph for a case in which the distance t is 0.8 mm. A reference symbol t16 shows a graph for a case in which the distance t is 1.6 mm. A reference symbol t24 shows a graph for a case in which the distance t is 2.4 mm. The distances between the vias Δx and Δy are 2.4 mm, for example.

From the graph t02, it can be found that the reflection phase can be adjusted to be in the vicinity of 175 degrees, when the thickness of a substrate is 0.2 mm. However, even if the size of the patch is varied from 0.5 mm to 2.3 mm, a variation of the reflection phase is less than or equal to 1 degree. There is almost no change in the value of the reflection phase. According to the graph t08, when the thickness of the substrate is 0.8 mm, the phase can be adjusted to be in the vicinity of 160 degrees. At this time, when the size of the patch Wx varies from 0.5 mm to 2.3 mm, the reflection phase varies from approximately 162 degrees to 148 degrees. However, a variation range is 14 degrees, which is small. According to the graph t16, when the thickness of the substrate is 1.6 mm, the phase can be less than or equal to 145 degrees. When the size of the patch Wx varies from 0.5 mm to 2.1 mm, the reflection phase slowly decreases from 144 degrees to 107 degrees. However, when the size Wx becomes greater than 2.1 mm, the reflection phase rapidly decreases. When the size Wx is 2.3 mm, the simulation value (the circular mark) of the reflection phase becomes 54 degrees, and the theoretical value (the solid line) of the reflection phase becomes 0 degrees. For the case of the graph t24, when the size of the patch Wx varies from 0.5 mm to 1.7 mm, the reflection phase slowly decreases from 117 degrees to 90 degrees. However, when the size Wy becomes greater than 1.7 mm, the reflection phase rapidly decreases. When the size Wx is 2.3 mm, the reflection phase becomes −90 degrees.

When the elements are formed to have the mushroom-like structures such as shown in FIGS. 2, 4, and 5, the size of the patch Wy in the y-axis direction is the same for all the elements, and the size of the patch Wx in the x-axis direction varies depending on the position of the element. However, it is not required that the size Wy of the patch is common for all the elements. A design can be made such that the size of the patch varies depending on the element. However, designing can be facilitated when the design is made by using the mushroom-like structures in which the size Wy of the patch is the same for all the elements. In this case, it suffices that the size Wx of the patch in the x-axis direction is determined depending on the position of the element. Specifically, among various heights of the via and thicknesses t of the substrate, one of them is selected which is used for designing (e.g., t24). The size of each of a plurality of patches to be arranged is determined depending on the reflection phase which is required at the position of the patch. For example, for a case in which t24 is selected, when a reflection phase which is required at a position of a patch is 72 degrees, the size Wx of the patch is approximately 2 mm. Similarly, sizes are determined for other patches. Ideally, the sizes of the patches can be designed, so that the variation of the reflection phase by the whole group of elements arranged in the reflectarray is 360 degree.

Figure 8:
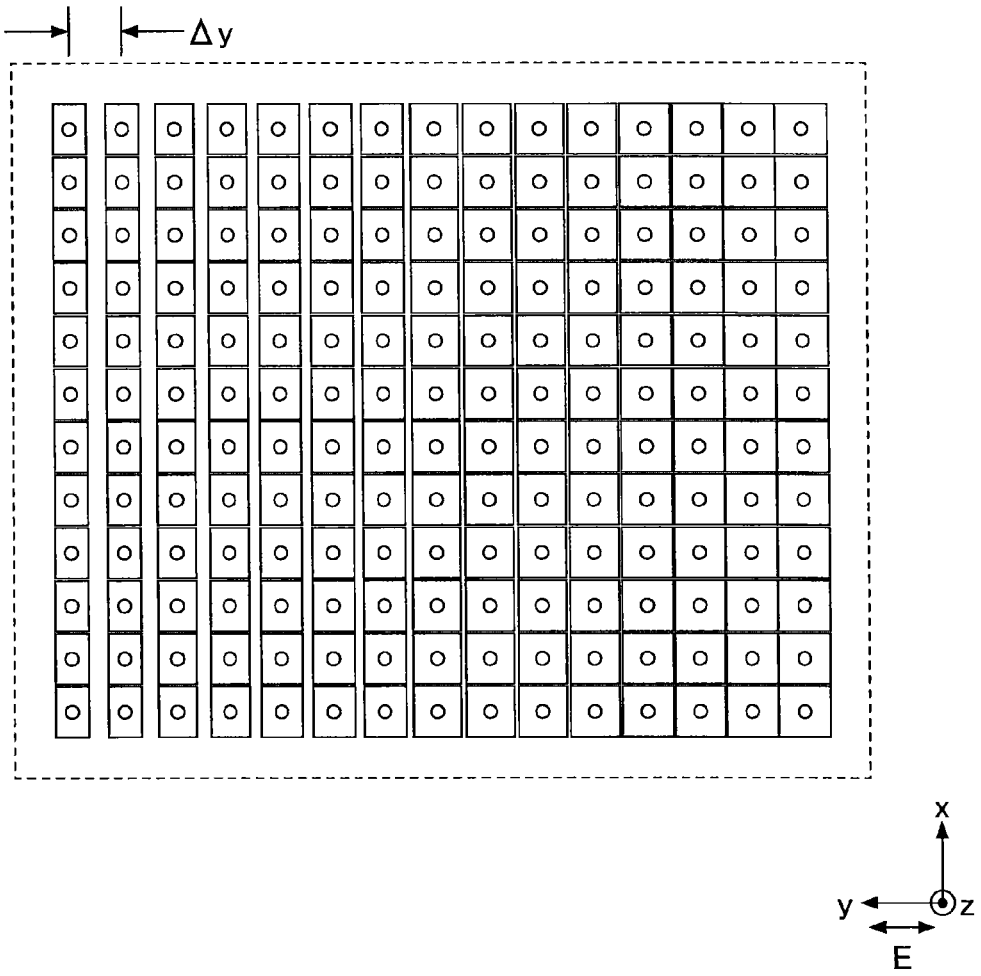
FIG. 8 is a plane view of the reflectarray for a case in which vertical control is performed.
Figure 9:
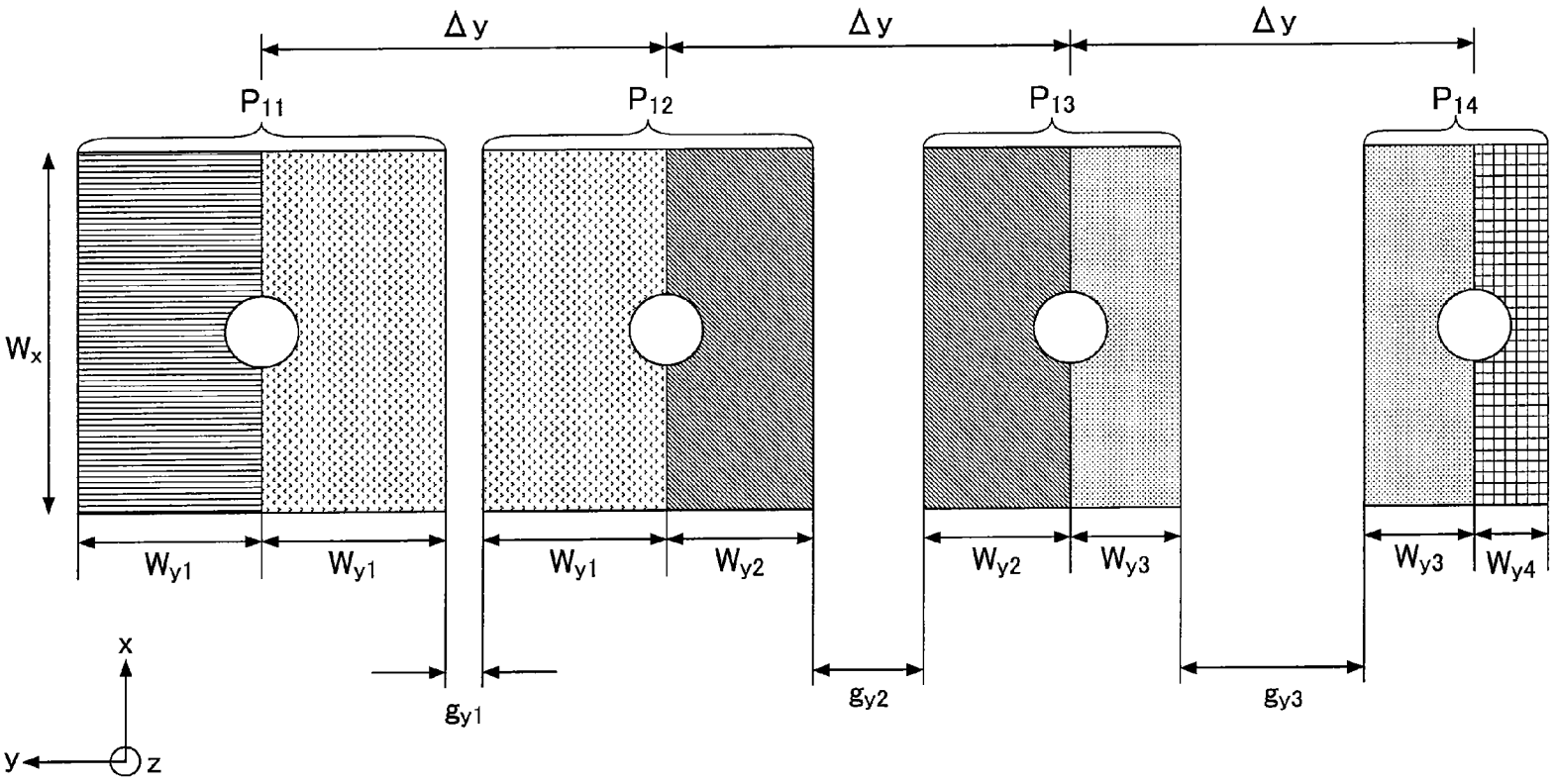
FIG. 9 is a diagram showing an example of patches for the vertical control.
Figure 10:
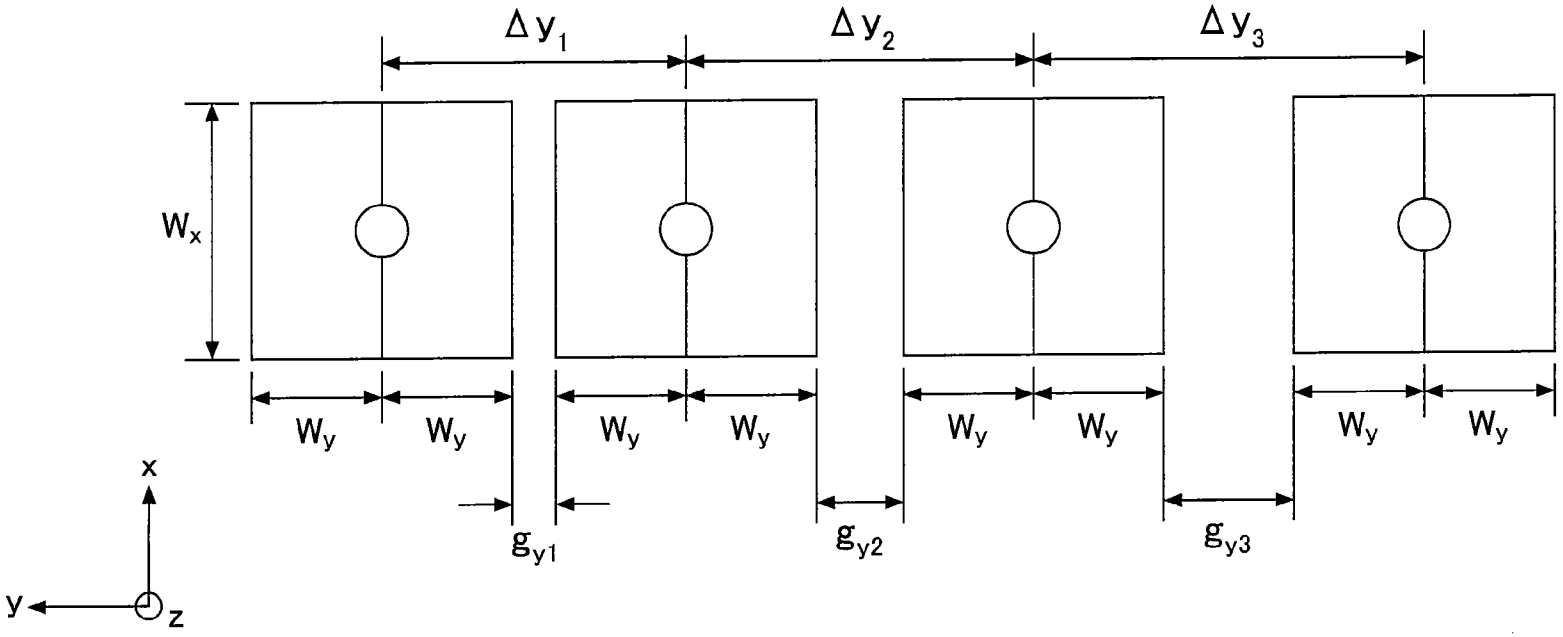
FIG. 10 is a diagram showing another example of patches for the vertical control.
Figure 11:
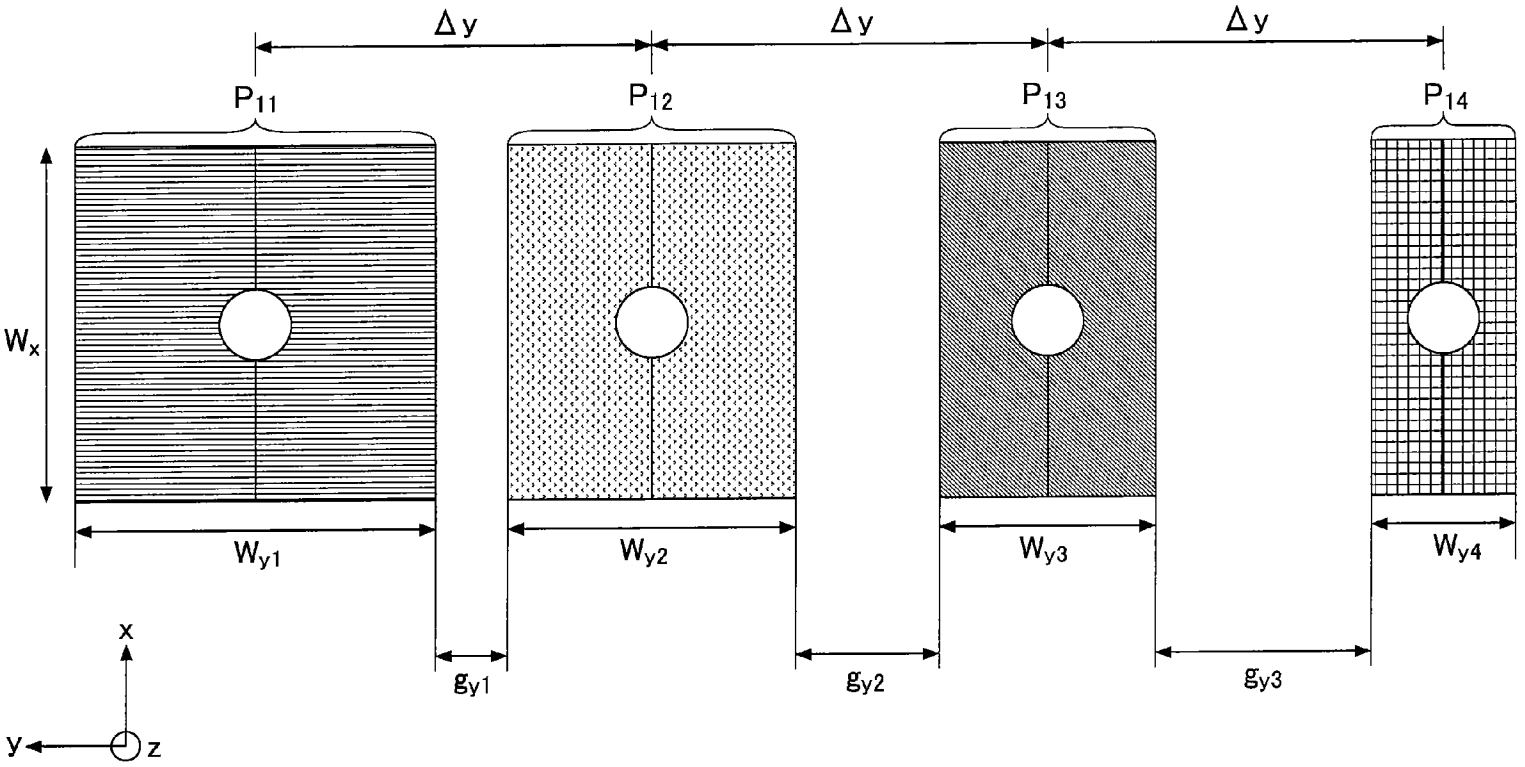
FIG. 11 is a diagram showing another example of patches for the vertical control.

In the structure which is shown in FIGS. 4 and 5, when a radio wave, in which an amplitude direction of an electric field E is in the x-axis direction, enters the reflectarray, the reflected wave travels in a direction in which the reflection phase varies, namely, in a traverse direction (the y-axis direction) with respect to the x-axis direction. For convenience, such control of the reflected wave is referred to as the "horizontal control." However, the present invention is not limited to the horizontal control. For example, instead of the structure shown in FIGS. 4 and 5, the reflectarray can be formed to have the structure such as shown in FIG. 8. In this case, a radio wave, in which an amplitude direction of an electric field is in the y-axis direction, can be reflected in a direction which is in parallel with the direction of the electric field, namely, in the longitudinal direction (the y-axis direction). For convenience, such control of the reflected wave is referred to as the "vertical control." For a case in which the vertical control is performed, the size of the patch and the gap may be determined by some methods. For example, as shown in FIG. 9, while setting the distance Δy between the elements to be common, each of the patches may be made asymmetric. Alternatively, as shown in FIG. 10, while making each of the patches to be symmetric, the distance between the elements may be varied. Alternatively, as shown in FIG. 11, while setting the distance Δy between the elements to be common, each of the patches may be designed to be symmetric. These are for exemplifying purposes only, and the size of the patch and the gap may be determined by any suitable method.

<2. Phase Difference Control>

Figure 12:
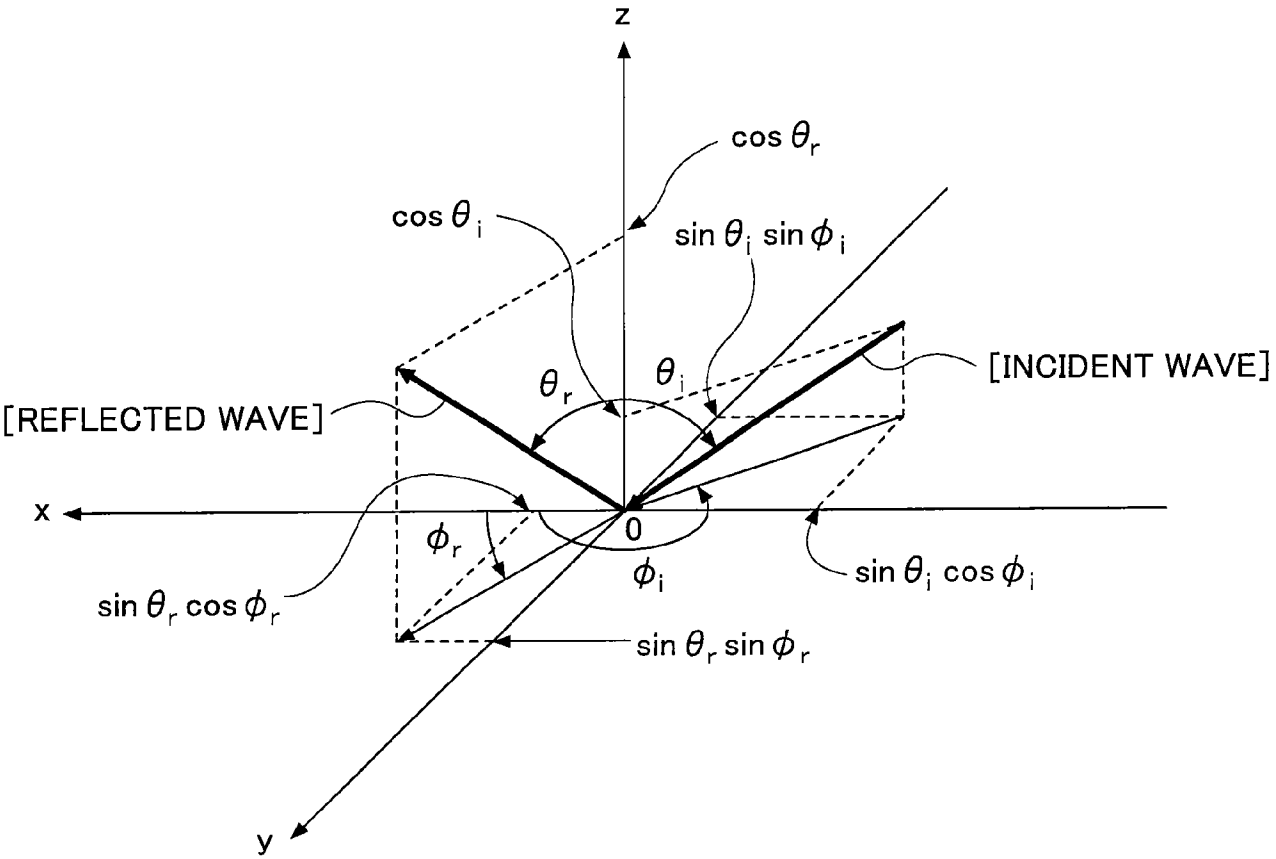
FIG. 12 is a diagram showing, in general, a relationship in the reflectarray between an incident wave and a reflected wave.

FIG. 12 generally shows a relationship between an incident wave entering a reflectarray and a reflected wave which is reflected by the reflectarray. For the case of the depicted example, in (r, θ, ϕ) polar coordinates, the incident wave arrives from a direction defined by $\theta=\theta_i$ and $\phi=\phi_i$, and the reflected wave propagates in a direction defined by $\theta=\theta_r$ and $\phi=\phi_r$. The origin corresponds to one element of the reflectarray. As described above, the element is typically an element having the mushroom-like structure. However, the embodiment is not limited to this. An incident unit vector $u_i$ along the direction in which the incident wave propagates can be denoted as follows.

$$u_i=(u_{ix},u_{iy},u_{iz})=(\sin\theta_i\cos\phi_i,\ \sin\theta_i\sin_{\phi i},\ \cos\theta_i) \tag{5}$$

A reflection unit vector $u_r$ can be denoted as follows.

$$u_r=(u_{rx},u_{ry},u_{rz})=(\sin\theta_r\cos\phi_r,\ \sin\theta_r\sin\phi_r,\ \cos\theta_r) \tag{6}$$

Figure 13:
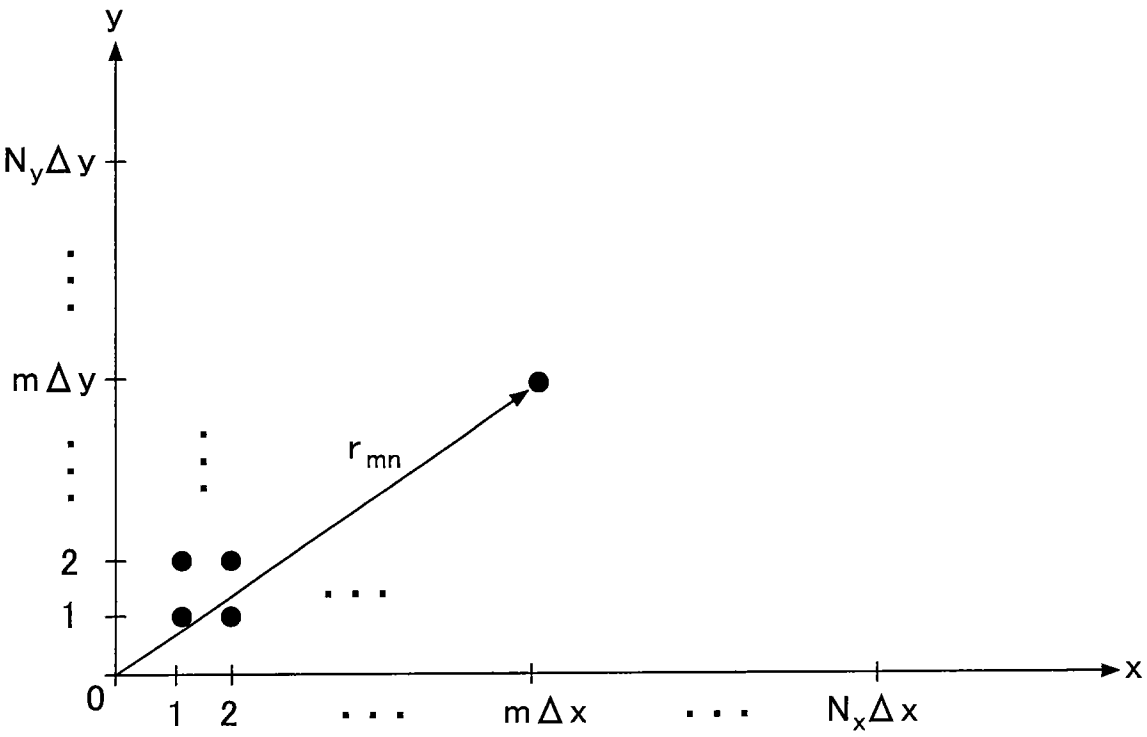
FIG. 13 is a diagram showing a state in which center coordinates of each of the elements included in the reflectarray are at (mΔx, nΔy, 0)

As shown in FIG. 13, suppose that the center coordinates of each of the elements included in the reflectarray is at (mΔx, nΔy, 0). Here, m=0, 1, 2, . . . , $N_x$, and n=0, 1, 2, . . . , $N_r$. $N_x$ is the maximum value of m, and $N_r$ is the maximum value of n. A position vector $r_{mn}$ of an element located at an m-th position in the x-axis direction and an n-th position in the y-axis direction (which is referred to as the "mn-th element," for convenience) can be denoted as follows.

$$r_{mn}=(m\Delta x,n\Delta y,0) \tag{7}$$

In this case, the reflection phase $\alpha_{mn}$ to be achieved by the mn-th element can be denoted as follows.

$$\alpha_{mn}=k_0(r_{mn}\cdot u_i-r_{mn}\cdot u_r)+2\pi N \tag{8}$$

Here, "·" represents an inner product of vectors. $k_0$ represents a wave number (2π/λ) of a radio wave, and λ represents a wavelength of the radio wave. By substituting Formulae (5)-(7) in Formula (8), the following is obtained.

$$\alpha_{mn} = k_0(m\Delta x \times \sin\theta_i\cos\varphi_i + n\Delta y \times \sin\theta_i\sin\varphi_i - m\Delta x \times \sin\theta_r\cos\varphi_r - n\Delta y \times \sin\theta_r\sin\varphi_r) = k_0 m\Delta x(\sin\theta_i\cos\varphi_i - \sin\theta_r\cos\varphi_r) + k_0 n\Delta y(\sin\theta_i\sin\varphi_i - \sin\theta_r\sin\varphi_r) \quad (9)$$

Here, without losing generality, it is assumed that $2\pi N=0$. Further, $\alpha_{mn}$ can be set to be any suitable value by Formula (9). However, from a perspective of forming the reflectarray by repeatedly arranging an element array of one period on the xy plane, a phase difference between neighboring elements (which is "$\alpha_{mn}-a_{m-1n}$" or "$\alpha_{mn}-\alpha_{mn-1}$") can preferably be a divisor of 360 degrees (e.g., 18 degrees).

Referring to Formula (9), in general, the reflection phase $\alpha_{mn}$ to be achieved by the mn-th element depends on $\Delta x$ and $\Delta y$. Which indicates that, in order for the reflectarray to reflect a radio wave in a suitable direction ($\theta_r$, $\phi_r$), in principle, the reflection phase $\alpha_{mn}$ by each of the elements gradually varies in the x-axis direction, while gradually varying in the y-axis direction. It is possible to vary the reflection phase in both the x-axis direction and in the y-axis direction. However, it is not so easy.

In the embodiment, a determination of a reflection phase to be achieved by a corresponding element is facilitated by causing the first term (the term including $\Delta x$) and the second term (the term including $\Delta y$) in the right-hand side of Formula (9) to satisfy a certain condition. Roughly classifying, there are two such conditions. A first method is such that the reflection phase is varied along one of the x-axis direction and the y-axis direction, and the reflection phase is not varied along the other direction. The first method is explained in <2.1 One-dimensional phase difference control>. A second method is such that a ratio between the first term (the term including $\Delta x$) and the second term (the term including $\Delta y$) in the right-hand side of Formula (9) is maintained to be a constant value, while setting a difference between reflection phases by the neighboring elements to be a divisor of 360 degrees ($2\pi$ radians) (more generally, which is a divisor of an integral multiple of 360 degrees). The second method is explained in <2.2 Two-dimensional phase difference control>.

<2.1 One-Dimensional Phase Difference Control>

<<Causing the Reflection Phase to Only Depend on $\Delta x$>>

In Formula (9), if ($\sin\theta_i \sin\phi_i - \sin\theta_r \sin\phi_r$), which is multiplied by $\Delta y$, is always 0, it follows that the reflection phase $\alpha_{mn}$ does not depend on $\Delta y$, and the reflection phase only depends on $\Delta x$. In such a case, the reflection phase $\alpha_{mn}$ may gradually change in the x-axis direction, but the reflection phase $\alpha_{mn}$ may be constant in the y-axis direction. In this manner, by causing the reflection phase to be achieved by each of the elements to vary in the x-axis direction and to be constant in the y-axis direction, a reflectarray can be easily made which can reflect an incident wave in a desirable direction.

When ($\sin\theta_i \sin\theta_i - \sin\theta_r \sin\phi_r$), which is multiplied by $\Delta y$, is equal to 0, the following formula is satisfied.

$$\sin\theta_i \sin\theta_i = \sin\theta_r \sin\phi_r \quad (10)$$

This shows that, in FIG. 12, an absolute value of the y component of the incident unit vector $u_i$ and an absolute value of the y component of the reflection unit vector $u_r$ are equal. Namely, when the y components of the incident unit vector and the reflection unit vector are equal, the reflection phase to be achieved by each of the elements can be caused to vary in the x-axis direction, while the reflection phase can be maintained to be constant in the y-axis direction. Formula (10) can also be expressed as follows.

$$\sin\theta_r = \sin\theta_i \sin\phi_i / \sin\phi_r \quad (11)$$

$$\theta_r = \arcsin(\sin\theta_i \sin\theta_i / \sin\phi_r) \quad (12)$$

Thus, an argument $\theta_r$ of the reflected wave with respect to the z-axis can be uniquely determined, based on an argument $\phi_r$ of the reflected wave with respect to the x-axis. For the current example, the reflection phase $\alpha_{mn}$ to be achieved by the mn-th element can be expressed as follows.

$$\alpha_{mn} = k_0 m\Delta x(\sin\theta_i\cos\varphi_i - \sin\theta_r\cos\varphi_r) = k_0 m\Delta x[\sin\theta_i\cos\varphi_i - (\sin\theta_i\sin\varphi_i / \sin\varphi_r) \times \cos\varphi_r] \quad (13)$$

Accordingly, the reflection phase $\alpha_{mn}$ to be achieved by the mn-th element can be uniquely determined by the argument $\phi_r$ of the reflected wave with respect to the x-axis. For example, suppose that the argument $\phi_i$ of the incident wave with respect to the x-axis is $3\pi/2=270$ degrees. In this case, since $\sin\phi_i=-1$ and $\cos\phi_i=0$, $\theta_r$ and $\alpha_{mn}$ can be expressed as follows.

$$\theta_r = \arcsin(-\sin\theta_i / \sin\phi_r) \quad (14)$$

$$\alpha_{mn} = k_0 m\Delta x[(\sin\theta_i / \sin\phi_r) \times \cos\phi_r] \quad (15)$$

Figure 14:
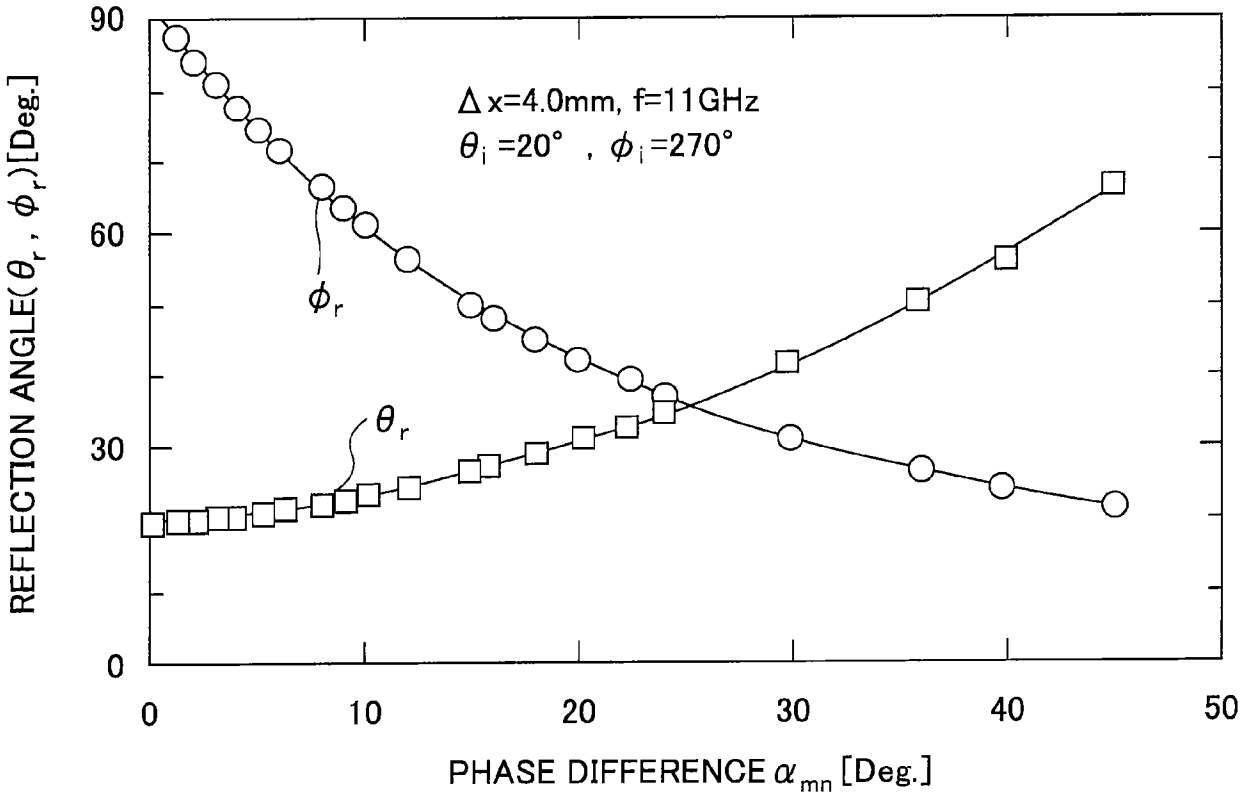
FIG. 14 is a diagram showing a relationship between a phase difference $\alpha_{mn}$ and a reflected wave ($\theta_r$, $\phi_r$)

FIG. 14 shows a relationship (which is the above-described Formula (13)) between the reflection phase or the phase difference $\alpha_{mn}$ and the reflected wave ($\theta_r$, $\phi_r$). In the simulation, the distance $\Delta x$ between elements of the reflectarray was set to 4 mm, and the frequency of the radio wave was set to 11 GHz. Additionally, the argument $\theta_i$ of the incident wave with respect to the x-axis was set to 20 degrees, and the argument $\phi_i$ of the incident wave with respect to the x-axis was set to 270 degrees. When the phase difference $\alpha_{mn}$ was 0, the argument $\theta_r$ of the reflected wave with respect to the z-axis was 20 degrees, and the argument $\phi_r$ of the reflected wave with respect to the x-axis was 90 degrees. That indicates specular reflection. As depicted, as the phase difference $\alpha_{mn}$ increased from 0 to 45 degrees, the argument $\theta_r$ of the reflected wave with respect to the z-axis gradually increased until approximately 67 degrees, while the argument $\phi_r$ of the reflected wave with respect to the x-axis gradually decreased from 90 degrees until approximately 22 degrees.

Figure 15:
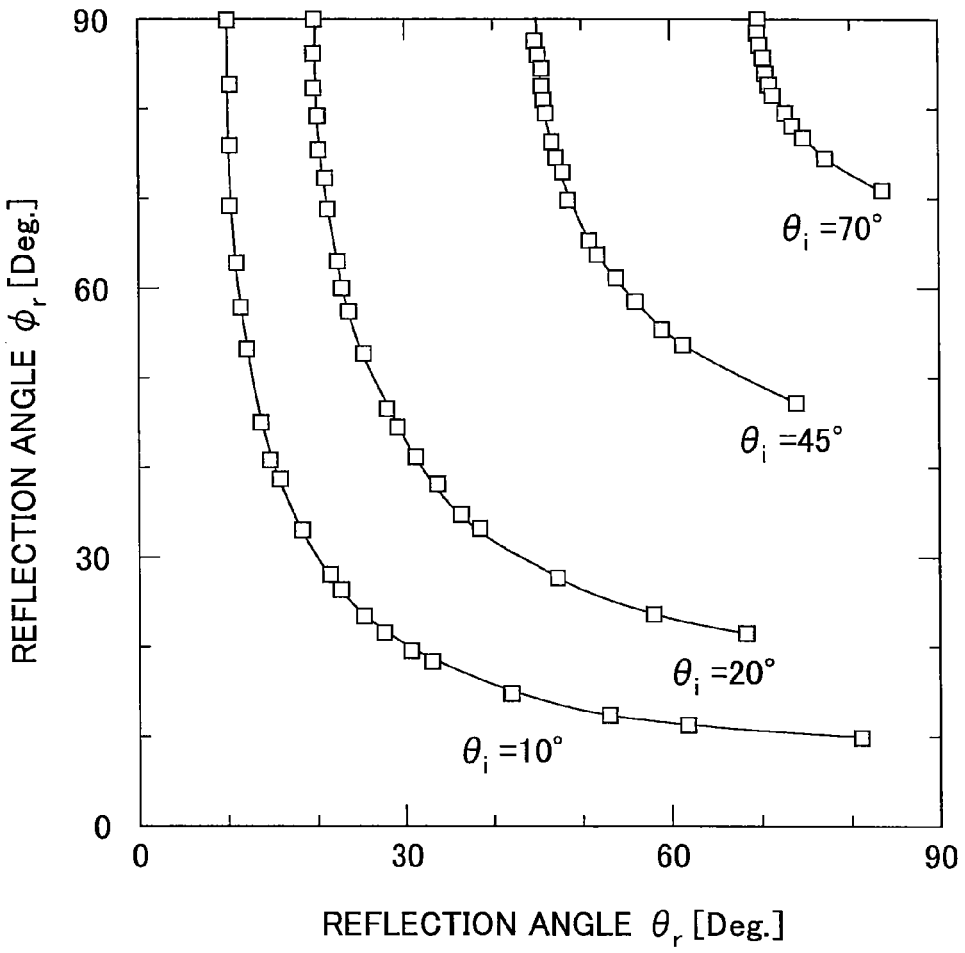
FIG. 15 is a diagram showing a relationship between reflection angles $\theta_r$ and $\phi_r$ for a case in which an argument $\theta_i$ of an incident wave from a z-axis is fixed.

FIG. 15 shows relationships between the reflection angles $\theta_r$ and $\phi_r$ for cases in which the argument $\theta_i$ of the incident angle with respect to the z-axis is fixed. In the depicted example, the relationships between the reflection angles $\theta_r$ and $\phi_r$ are shown for the corresponding cases in which the incident angle $\theta_i$ is 10 degrees, 20 degrees, 45 degrees, and 70 degrees. The argument $\phi_i$ of the incident wave with respect to the x-axis is 270 degrees. For the case in which the incident angle $\theta_i$ is 10 degrees, when the argument $\theta_r$ of the reflected wave with respect to the z-axis is 10 degrees, the argument $T_r$ of the reflected wave with respect to the x-axis is 90 degrees. This corresponds to specular reflection. For the depicted example, a state in which the reflection angle $\phi_r$ is 90 degrees indicates specular reflection. In general, for each of the incident angles $\theta_i$, the reflection angle $\phi_r$ decreases as the reflection angle $\theta_r$ increases and approaches 90 degrees.

FIG. 16 shows a situation in which reflection phases of corresponding elements included in a reflectarray are determined by using a relational expression such as Formula (13).

The elements included in the reflectarray are arranged in the x-axis direction while they are evenly spaced apart by a distance of 4 mm ($\Delta x$=4 mm). At the same time, the elements are arranged in the y-axis direction while they are evenly spaced apart by a distance of 4 mm ($\Delta x=\Delta y$=4 mm). As described above, when Formula (10) is satisfied, the reflection phase $\alpha_{mn}$ to be achieved by the corresponding element gradually changes in the x-axis direction. However, the reflection phase $\alpha_{mn}$ may be constant in the y-axis direction. Accordingly, for the depicted example, the reflection phase changes once per 18 degrees in the x-axis direction. However, the reflection phase does not change in the y-axis direction.

Figure 17:
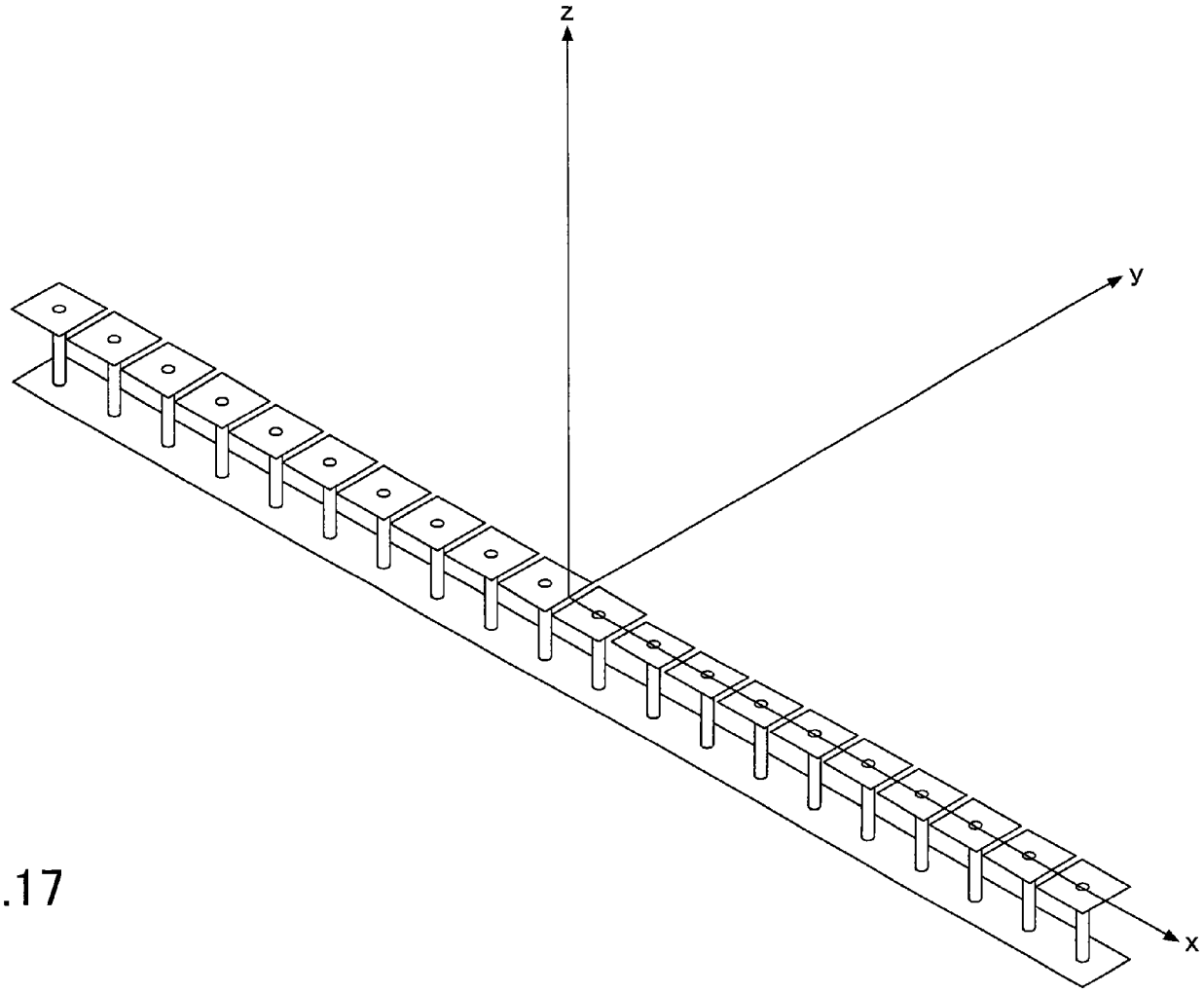
FIG. 17 is a diagram showing one sequence of elements, which are arranged so as to form the reflectarray.

FIG. 17 shows a portion of the elements which are arranged by a method such as shown in FIG. 16, so that the reflection phases of the corresponding elements are achieved. In FIG. 17, only one line of the elements arranged in the x-axis direction is shown. Actually, similar sequences of elements exist in the y-axis direction, and thereby the reflectarray is formed. In the simulation, a reflectarray of 80 mm×80 mm was assumed. The intensity of the reflected wave was calculated under a periodic boundary condition and the following conditions.

Frequency of a radio wave=11 GHz

Dielectric constant of a material disposed between a ground plate and a patch=$8.85\times10^{-12}$ Magnetic permeability of the material disposed between the ground plate and the patch=$1.26\times10^{-6}$ Argument $\theta_i$ of the incident wave with respect to the z-axis=20 degrees Argument $\phi_i$ of the incident wave with respect to the x-axis=270 degrees Incident direction ($\theta_i$, $\phi_i$) of the incident wave=(20 degrees, 270 degrees)

Desired direction ($\theta_r$, $\phi_r$) of the reflected wave=(29 degrees, 45 degrees)

Figure 18:
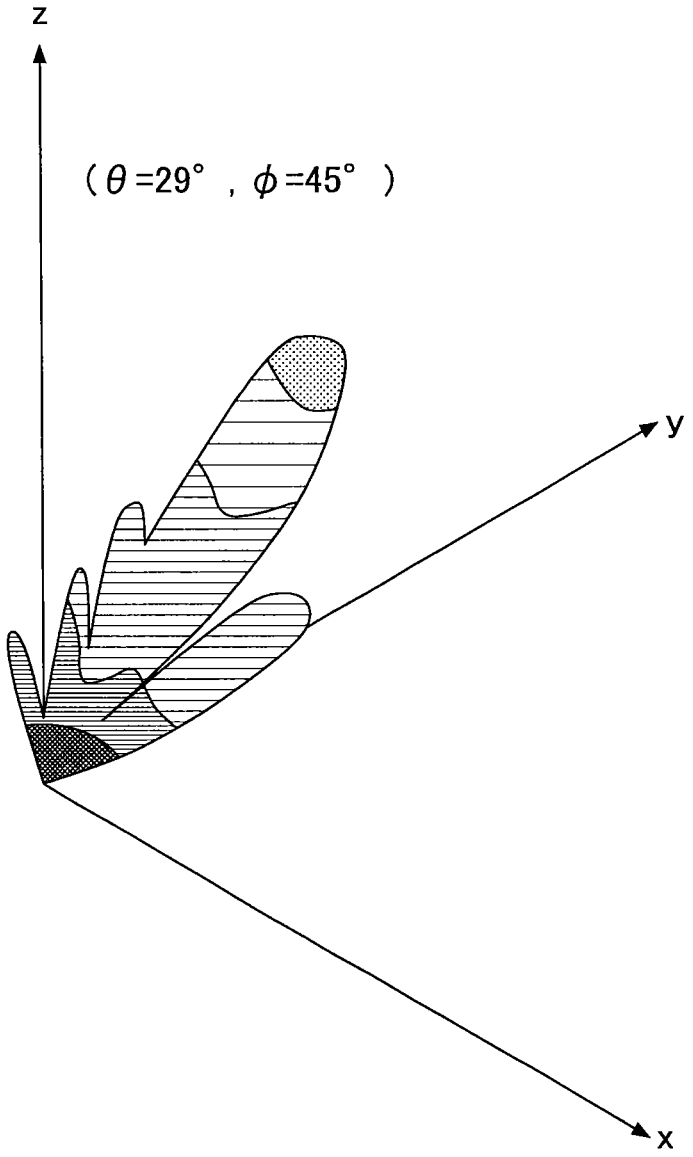
FIG. 18 is a diagram showing intensity of the reflected wave.

In this case, as shown in FIG. 18, the argument $\theta_r$ of a main beam of the reflected wave with respect to the z-axis is 29 degrees, and the argument $\phi_r$ with respect to the x-axis is 45 degrees, which correspond to the desired direction.

Figure 19:
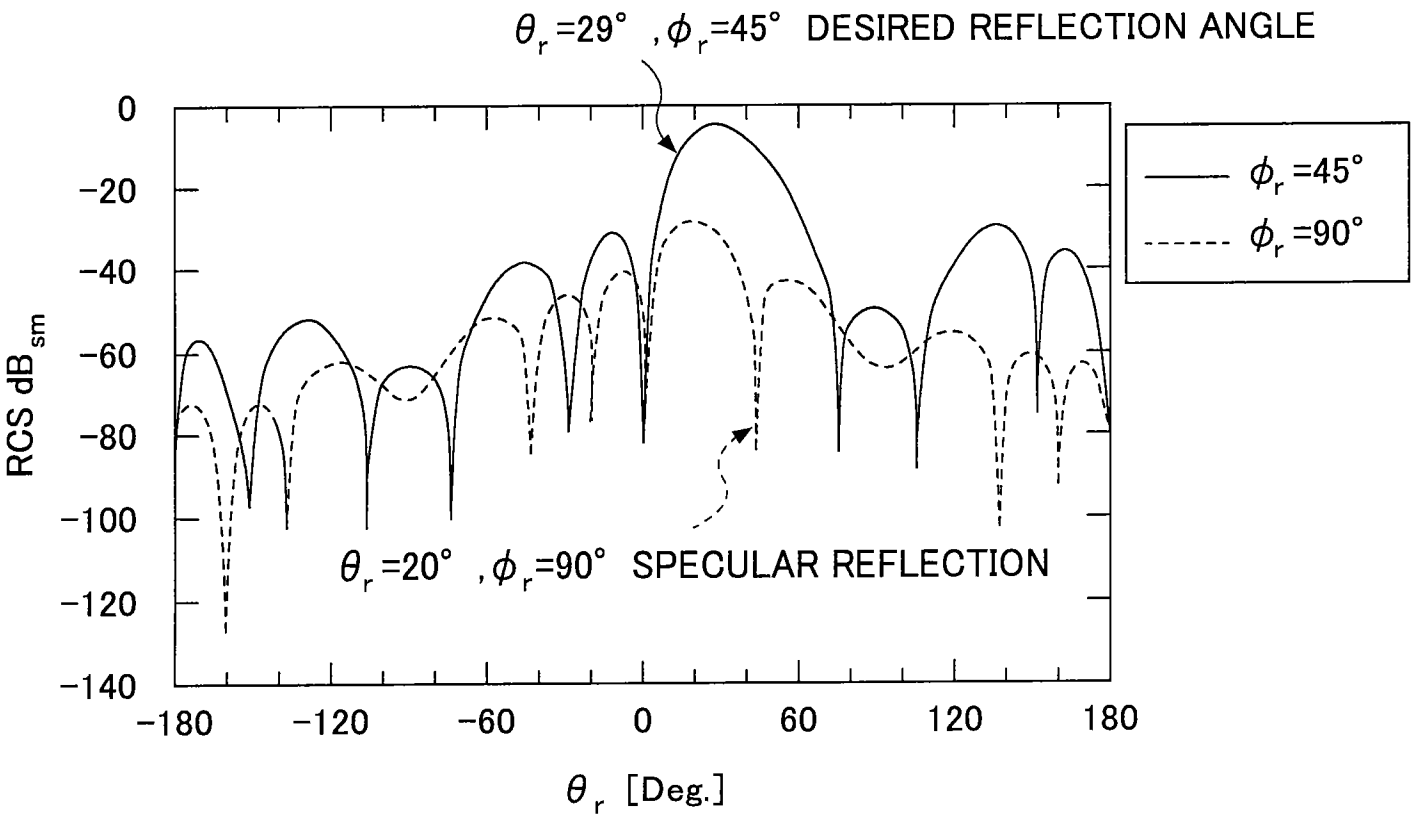
FIG. 19 is a diagram showing a scattering cross section of the reflected wave.

FIG. 19 shows a scattering cross section of the reflected wave. As shown in FIG. 18, the desired direction is a direction of ($\theta_r$, $\phi_r$)=(29 degrees, 45 degrees). The incident direction is ($\theta_i$, $\phi_i$)=(20 degrees, 270 degrees). Accordingly, a direction of specular reflection is ($\theta_i$, $\phi_i$)=(20 degrees, 90 degrees). In FIG. 19, the scattering cross section in a plane on which the specular reflection occurs (the dashed line) is compared with the scattering cross section in the desired direction (the solid line). As depicted, in the vicinity of $\theta_r$=29 degrees, the level in the desired direction is greater than the level in the specular reflection direction by approximately 20 dB. In this manner, according to the embodiment, a reflected wave can be strongly formed in any desired direction.

<<Causing the Reflection Phase to Only Depend on $\Delta y$>>

Next, a method is explained such that, in the first method, the reflection phase is maintained to vary only along the y-axis direction, and the reflection phase is maintained not to vary along the x-axis direction. In the above explanation, by satisfying Formula (10), the reflection phase $\alpha_{mn}$ to be achieved by the corresponding element is caused to gradually vary along the x-axis direction, but the reflection phase $\alpha_{mn}$ is caused to be constant along the y-axis direction. However, the embodiment is not limited to this example. Instead, the reflection phase $\alpha_{mn}$ to be achieved by the corresponding element can be caused to gradually vary along the y-axis direction, but the reflection phase $\alpha_{mn}$ is caused to be constant along the x-axis direction. In this case, in Formula (9), it may be necessary, for example, that ($\sin\theta_i\cos\phi_i-\sin\theta_r\cos\phi_r$) is always 0, which is the coefficient of $\Delta x$. In this case, the following formula holds.

$$\sin\theta_i\cos\phi_i=\sin\theta_r\cos\phi_r \tag{16}$$

This shows that the y component of the incident unit vector $u_i$ of the incident wave is equal to the x component of the reflection unit vector $u_r$ of the reflected wave. When the x components of the incident unit vector and the reflection unit vector are equal, the reflection phase to be achieved by the corresponding element can be caused to vary in the y-axis direction, while the reflection phase can be caused to be constant along the x-axis direction. Formula (16) can be expressed as follows.

$$\sin\theta_r=\sin\theta_i\cos\phi_i/\cos\phi_r \tag{17}$$

$$\theta_r=\arcsin(\sin\theta_i\cos\phi_i/\cos\phi_r \tag{18}$$

Accordingly, the argument $\theta_r$ of the reflected wave with respect to the z-axis can be uniquely determined from the argument $\phi_r$ of the reflected wave with respect to the x-axis. In this case, the reflection phase $\alpha_{mn}$ to be achieved by the mn-th element can be expressed as follows.

$$\begin{aligned}\alpha_{mn} &= k_0 n\Delta y(\sin\theta_i\sin\varphi_i-\sin\theta_r\sin\varphi_r) = \\ &\quad k_0 n\Delta y[\sin\theta_i\sin\varphi_i-(\sin\theta_i\cos\varphi_i/\cos\varphi_r)\times\sin\varphi_r]\end{aligned} \tag{19}$$

Accordingly, the reflection phase $\alpha_{mn}$ to be achieved by the mn-th element can be uniquely determined from the argument $\phi_r$ of the reflected wave with respect to the x-axis.

FIG. 44 shows a situation in which reflection phases of corresponding elements included in a reflectarray are determined by a relational expression such as Formula (19). The elements included in the reflectarray are arranged in the x-axis direction while evenly spaced apart by a distance of 4.5 mm. At the same time, the elements are arranged in the y-axis direction while evenly spaced apart by a distance of 4.5 mm ($\Delta x=\Delta y$=4.5 mm). As described above, when Formula (16) is satisfied, the reflection phase $\alpha_{mn}$ to be achieved by the corresponding element may gradually vary in the y-axis direction, while the reflection phase $\alpha_{mn}$ may be constant in the x-axis direction. Accordingly, for the depicted example, the reflection phase varies once per 36 degrees in the y-axis direction, while the reflection phase does not vary in the x-axis direction. In the simulation, the intensity of the reflected wave was calculated under a periodic boundary condition and the following conditions.

Frequency of a radio wave=11 GHz

Dielectric constant of a material disposed between a ground plate and a patch=$8.85\times10^{-12}$ Magnetic permeability of the material disposed between the ground plate and the patch=$1.26\times10^{-6}$ Incident direction ($\theta_i$, $\phi_i$) of the incident wave=(10 degrees, 270 degrees)

Desired direction ($\theta_r$, $\phi_r$) of the reflected wave=(51.2 degrees, 90 degrees)

Figure 45:
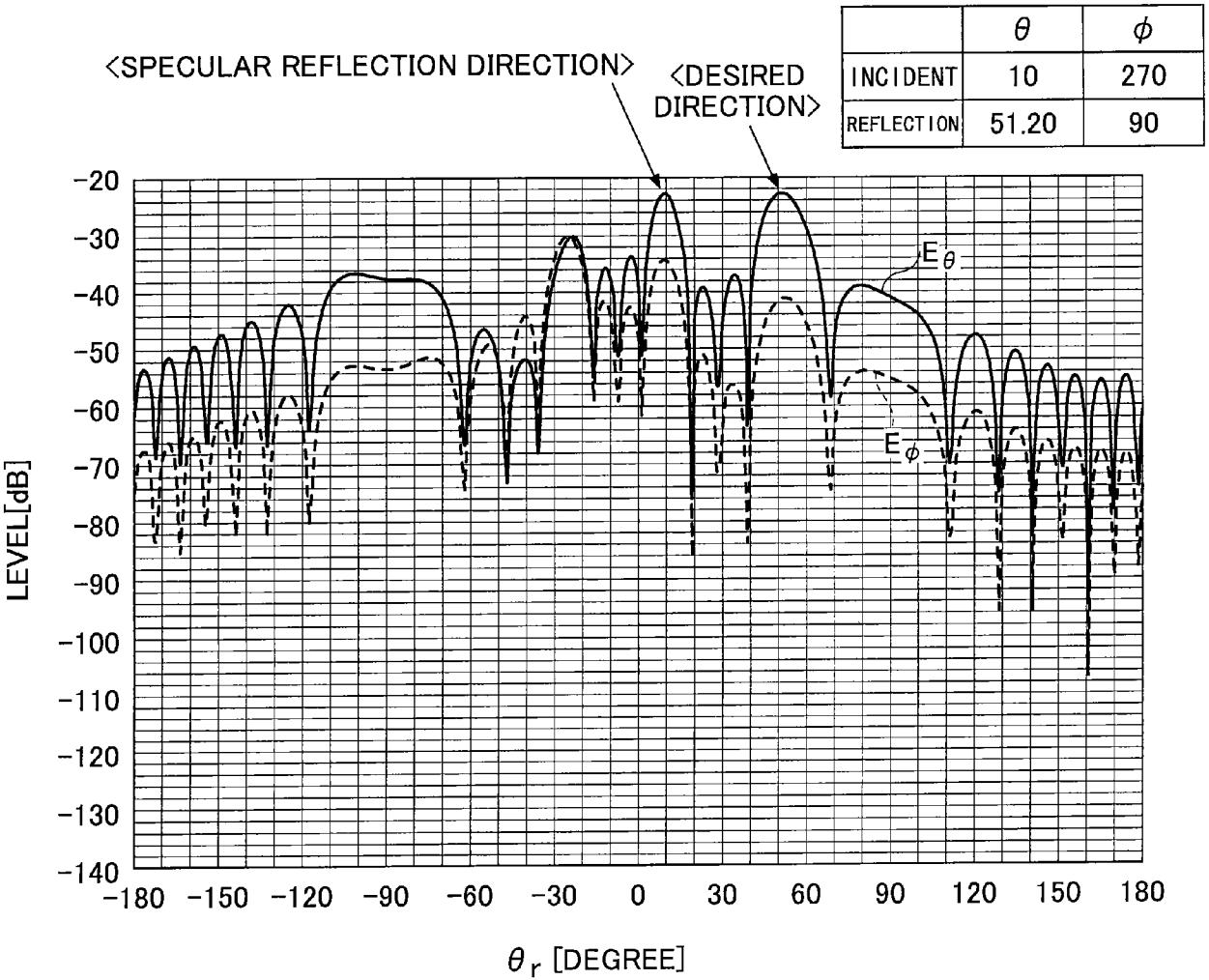
FIG. 45 is a diagram showing a result of a simulation for a case in which a radio wave enters the reflectarray and the radio wave is reflected (a yz-surface)

FIG. 45 shows a scattering cross section of the reflected wave on the yz plane. The desired direction is a direction of ($\theta_r$, $\phi_r$)=(51.2 degrees, 90 degrees). The incident direction is ($\theta_i$, $\phi_i$)=(10 degrees, 270 degrees). Accordingly, a direction of specular reflection is ($\theta_i$, $\phi_i$)=(10 degrees, 90 degrees). In the figure, the graph of $E_\theta$ indicates a level of a component in the O-direction of an electric field vector when the electric field vector is expressed in the (r, θ, φ) polar coordinates.

The graph of $E_\phi$ indicates a level of a component in the $\phi$-direction of the electric field vector when the electric field vector is expressed in (r, θ, $\phi$) polar coordinates. It can be found that, in both cases, a strong peak occurs in the desired direction of $\phi_r$=51.2 degrees.

To put the above-described explanations (for the case in which the reflection phase only depends on x and for the case in which the reflection phase only depends on y) together, the phase of the reflected wave by an element (mn) included in a plurality of elements forming a reflectarray is different from a phase of the reflected wave by an element adjacent to the element (mn) in a first axis (the x-axis or the y-axis) direction by a predetermined value (in the above-described example, 18 degrees or 36 degrees), and the phase of the reflected wave by the element (mn) is the same as a phase of the reflected wave by an element adjacent to the element (mn) in a second axis (the y-axis or the x-axis) direction. Further, the absolute value of the incident unit vector $u_i$ in the second axis direction is the same as the absolute value of the reflection unit vector $u_r$ in the second axis direction.

<<Case in which a Desired Reflection Phase May not be Achieved>>

Figure 20:
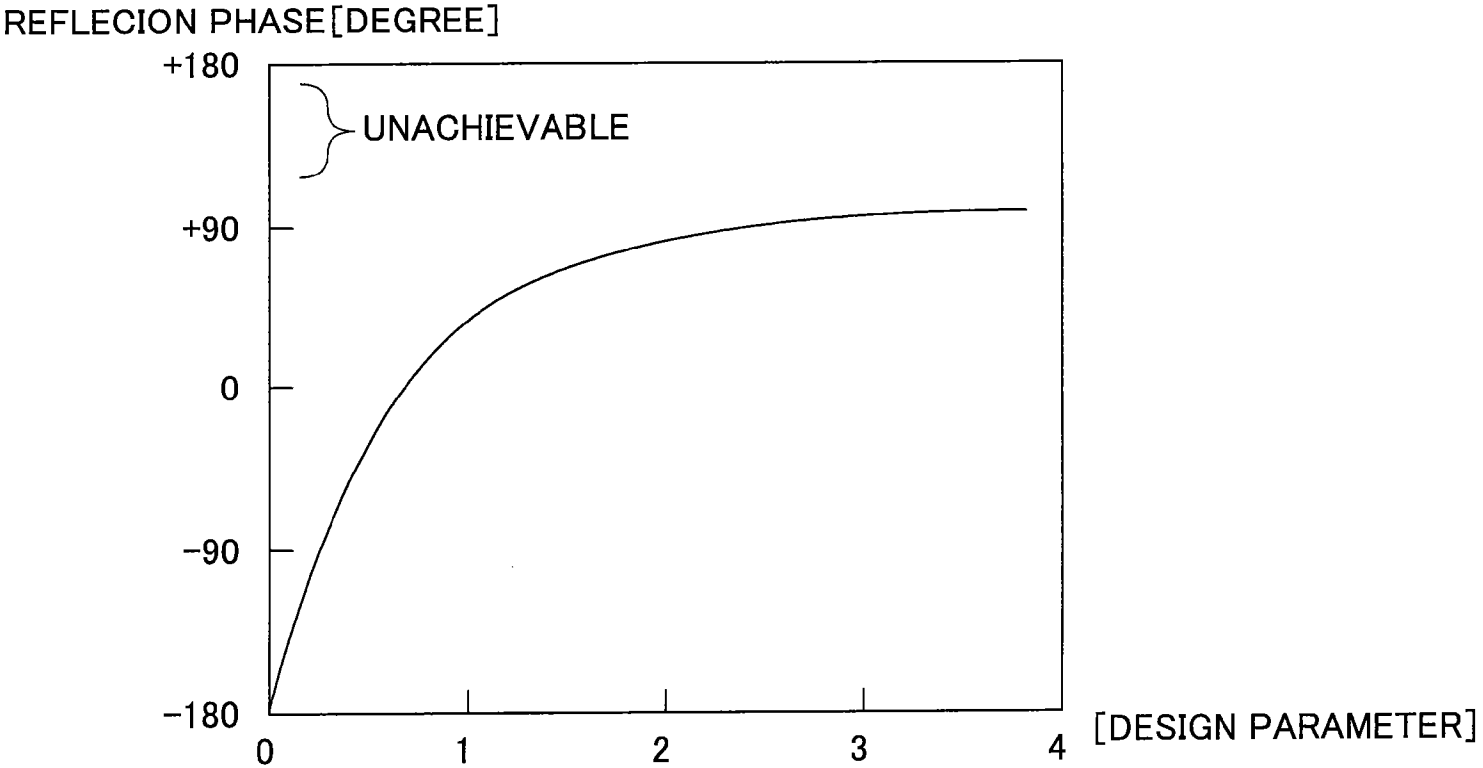
FIG. 20 is a diagram showing a mutual relationship between a design parameter and a reflection phase.

In order for a reflectarray to suitably reflect a radio wave in a desired direction, a total of reflection phase differences by a corresponding predetermined number (e.g., N) of elements (which is N×A$\phi$) can preferably be 360 degrees (in general, which is a natural number multiple of 360 degrees). However, due to a restriction in a manufacturing process, a reflection phase in a range from 0 degrees to 360 degrees may not always be achieved. FIG. 20 shows a correlation between a design parameter and a reflection phase. The design parameter may be a distance (gap) between patches of neighboring elements, for example. The design parameter can be another quantity. For example, a frequency of a radio wave, a distance between elements (a distance between a center point of an element and a center point of a neighboring element), or a size of a patch may be used as the design parameter. Regardless of the design parameter to be used, it is possible that an unachievable reflection phase occurs, depending on a case. For the case of FIG. 20, a reflection phase in a range from −180 degrees to the vicinity of +90 degrees can be achieved by selecting a design parameter in a range from 0 to 4 (e.g. a gap which is greater than or equal to 0 and less than or equal to 4 mm). However, it is difficult to achieve a reflection phase in a range from approximately +90 degrees to +180 degrees.

Figure 21:
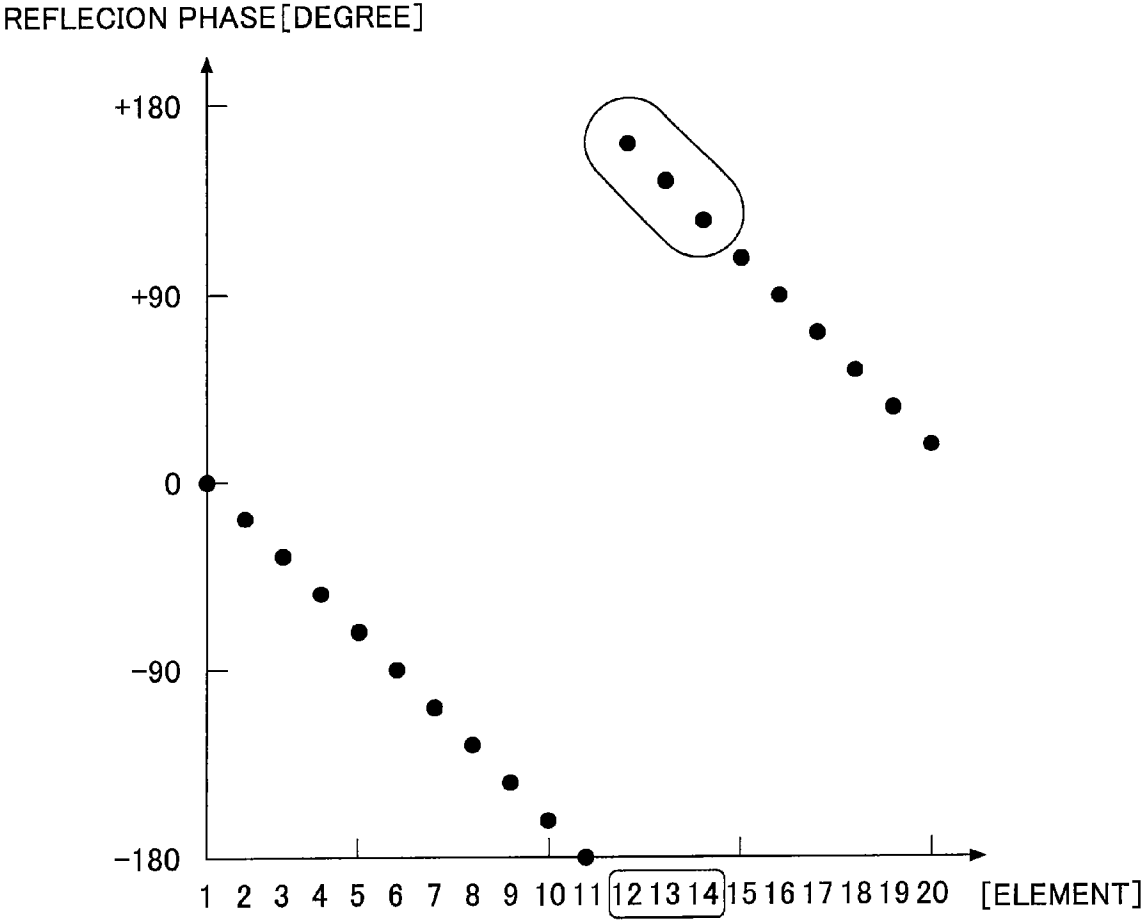
FIG. 21 is a diagram showing reflection phases which are achieved by twenty corresponding elements, which are arranged to form the reflectarray.

FIG. 21 shows reflection phases to be achieved by corresponding twenty elements, which are arranged to form a reflectarray. Since 360 degrees divided by 20 pieces equals 18 (degree/piece), a design can be made, so that a reflection phase difference by neighboring elements is 18 degrees. However, as described above, an intended reflection phase may not be achieved. For the depicted example, it is difficult to achieve the reflection phases to be achieved by the corresponding 12th to 14th elements, which are 162 degrees, 144 degrees, and 126 degrees. In this case, there are some options for designing the 12th to 14th elements.

(a) A first option is to expose a dielectric material without providing corresponding patches to the 12th to 14th elements, which may not achieve the reflection phases.

(b) A second option is to replace the elements, which may not achieve the intended reflection phases, with metal plates. In the above-described example, the 12th to 14th elements are replaced by simple metal plates. For example, the ground plate at the positions of the 12th to 14th elements is exposed. For the case of this option, the reflection phase at the positions of the 12th to 14th elements is 180 degrees.

(c) A third option is to assign some achievable reflection phases to the elements, which may not achieve the reflection phases. For the case of the above-described example, the reflection phases of three elements from the 12th element to the 14th element may be adjusted to be the same as the reflection phase of the 11th element (−180 degrees), or the reflection phase of the 15th element (+108 degrees), for example.

<2.2 Two-Dimensional Phase Difference Control>

A second method is explained which is for controlling phase differences of the elements. First, a difference between a reflection phase by an mn-th element and a reflection phase by an element adjacent to the mn-th element is considered. A reflection phase difference $\Delta\alpha_x$ by the element neighboring in the x-axis direction can be expressed as follows.

$$\begin{aligned}\Delta\alpha_x &= \alpha_{mn} - \alpha_{m-1n} \\ &= k_0 m\Delta x(\sin\theta_i\cos\varphi_i - \sin\theta_r\cos\varphi_r) + \\ &\quad k_0 n\Delta y(\sin\theta_i\sin\varphi_i - \sin\theta_r\sin\varphi_r) - \\ &\quad k_0(m-1)\Delta x(\sin\theta_i\cos\varphi_i - \sin\theta_r\cos\varphi_r) - \\ &\quad k_0 n\Delta y(\sin\theta_i\sin\varphi_i - \sin\theta_r\sin\varphi_r) \\ &= k_0\Delta x(\sin\theta_i\cos\varphi_i - \sin\theta_r\cos\varphi_r)\end{aligned} \tag{20}$$

The reflection phase difference $\Delta\alpha_y$ by the neighboring element in the y-axis direction can be expressed as follows.

$$\begin{aligned}\Delta\alpha_y &= \alpha_{mn} - \alpha_{mn-1} \\ &= k_0 m\Delta x(\sin\theta_i\cos\varphi_i - \sin\theta_r\cos\varphi_r) + \\ &\quad k_0 n\Delta y(\sin\theta_i\sin\varphi_i - \sin\theta_r\sin\varphi_r) - \\ &\quad k_0 m\Delta x(\sin\theta_i\cos\varphi_i - \sin\theta_r\cos\varphi_r) - \\ &\quad k_0(n-1)\Delta y(\sin\theta_i\sin\varphi_i - \sin\theta_r\sin\varphi_r) \\ &= k_0\Delta y(\sin\theta_i\sin\varphi_i - \sin\theta_r\sin\varphi_r)\end{aligned} \tag{21}$$

In the example in which the two-dimensional phase difference control is applied, the following relation is utilized.

$$\Delta\alpha_x = \gamma\Delta\alpha_y y = 2\pi/\kappa \tag{22}$$

Here, $\gamma$ is a rational number, $\kappa$ is a divisor of 360, i.e., an integer that divides 360. According to Formula (22), values of parameters are set, so that a ratio between the reflection phase difference $\Delta\alpha_x$ by the neighboring element in the x-axis direction and the reflection phase difference $\Delta\alpha_y$ by the neighboring element in the y-axis direction is the predetermined value $\gamma$. Further, they are set, so that the reflection phase difference $\Delta\alpha_x$ by the neighboring element in the x-axis direction is a divisor of 360 degrees (2π radians) (in general, which is a divisor of an integral multiple of 360 degrees). As a simple example, the predetermined value $\gamma$ may be 1, and K may be 10.

From Formula (20) and Formula (21), the relation $L\alpha_x = \gamma\Delta\alpha_y$ can be expressed as follows.

$$k_0\Delta x(\sin\theta_i\cos\phi_i - \sin\theta_r\cos\phi_r) = \gamma k_0\Delta y(\sin\theta_i\sin\phi_i - \sin\theta_r\sin\phi_r) \tag{23}$$

According to Formula (22) $\Delta\alpha_y=2\pi/(\in\gamma)$. Thus, the following formula is obtained.

$$k_0\Delta y(\sin\theta_i\sin\theta_r-\sin\theta_r\sin\phi_r)=2\pi/(\kappa\gamma)$$

Namely, $$\sin\theta_r\sin\phi_r=2\pi/(k_0\Delta y\kappa\gamma)+\sin\theta_i\sin\phi_i \quad (24)$$

Further, since $\Delta\alpha_x=2\pi/\kappa$, the following formula is obtained.

$$k_0\Delta x(\sin\theta_i\cos\phi_i-\sin\theta_r\cos\phi_r)=2\pi/\kappa$$

Namely, $$\sin\theta_r\cos\phi_r=-2\pi/(k_0\Delta x\kappa)+\sin\theta_i\cos\phi_i \quad (25)$$

By dividing Formula (24) by Formula (25), the following formula is obtained.

$$\phi_r=\arctan([-2\pi/(k_0\Delta y\kappa\gamma)+\sin\theta_i\sin\phi i]/[-2\pi/(k_0\Delta x\kappa)+\sin\theta_i\cos\phi_i]) \quad (26)$$

According to Formula (26), the argument $\phi_r$ of the reflected wave can be calculated from the arguments $\theta_i$ and $\phi_i$ of the incident wave. Further, according to Formula (24) and Formula (25), the argument $\theta_r$ of the reflected wave can be calculated from the arguments $\theta_i$ and $\phi_i$ of the incident wave and the argument $\phi_r$ of the reflected wave.

Suppose that the argument $\phi_i$ of the incident wave with respect to the x-axis is $\phi_i=3\pi/2=270$ degrees, and that the distances between the elements satisfies $\Delta x=\Delta y$. Then, Formula (26) can be expressed as follows.

$$\varphi_r=\arctan([-2\pi/(k_0\Delta y\kappa\gamma)-\sin\theta_i]/[-2\pi/(k_0\Delta x\kappa)])=\arctan[1/\gamma+(k_0\Delta x\kappa\sin\theta_i)/(2\pi)] \quad (27)$$

Further, for the case of $\phi_i=3\pi/2=270$ degrees, the following formulae are obtained from Formula (24) and Formula (25).

$$\theta_r=\arcsin([-2\pi/(k_0\Delta y\kappa\gamma)-\sin\theta_i]/\sin\varphi_r) \quad (28)$$

$$=\arcsin[-2\pi/(k_0\Delta x\kappa\cos\varphi_r)] \quad (29)$$

In this manner, since the example uses a restriction or a condition such as Formula (22), a ratio between the reflection phase difference $\Delta\alpha_x$ of the elements neighboring in the x-axis direction and the reflection phase difference $\Delta\alpha_y$ of the elements neighboring in the y-axis direction is a constant value $\gamma$, and $\Delta\alpha_x$ is a divisor of 360 degrees (more generally, which is a divisor of an integral multiple of 360 degrees). Since $\Delta\alpha_x$ is a divisor of 360 degrees (e.g., $360/\kappa_x$), a periodic boundary condition can be defined in the x-axis direction by the $\kappa$ pieces of elements which are arranged in the x-axis direction. Further, since $\Delta\alpha_y$ is also a divisor of 360 degrees (e.g., $360/(\kappa\gamma)$) (more generally, which is a divisor of an integral multiple of 360 degrees), a periodic boundary condition can also be defined in the y-axis direction by the $\kappa\gamma$ pieces of elements which are arranged in the y-axis direction. Accordingly, a unit structure or a basic structure can be easily formed for a reflectarray, which has a periodic boundary condition both in the x-axis direction and y-axis direction. By repeatedly forming the unit structure or the basic structure in the x-axis direction and in the y-axis direction, a reflectarray having a desired size can be achieved. In this regard, it is significantly different from a reflectarray according to related art, for which a boundary condition can only be defined in one direction by elements which are arranged in the one direction, which is either the x-axis direction or the y-axis direction. According to the embodiment, by varying the phase difference both in the x-axis direction and in the y-axis direction, the incident wave can be reflected in any desired direction.

<3. Simulation Result>

Figure 46:
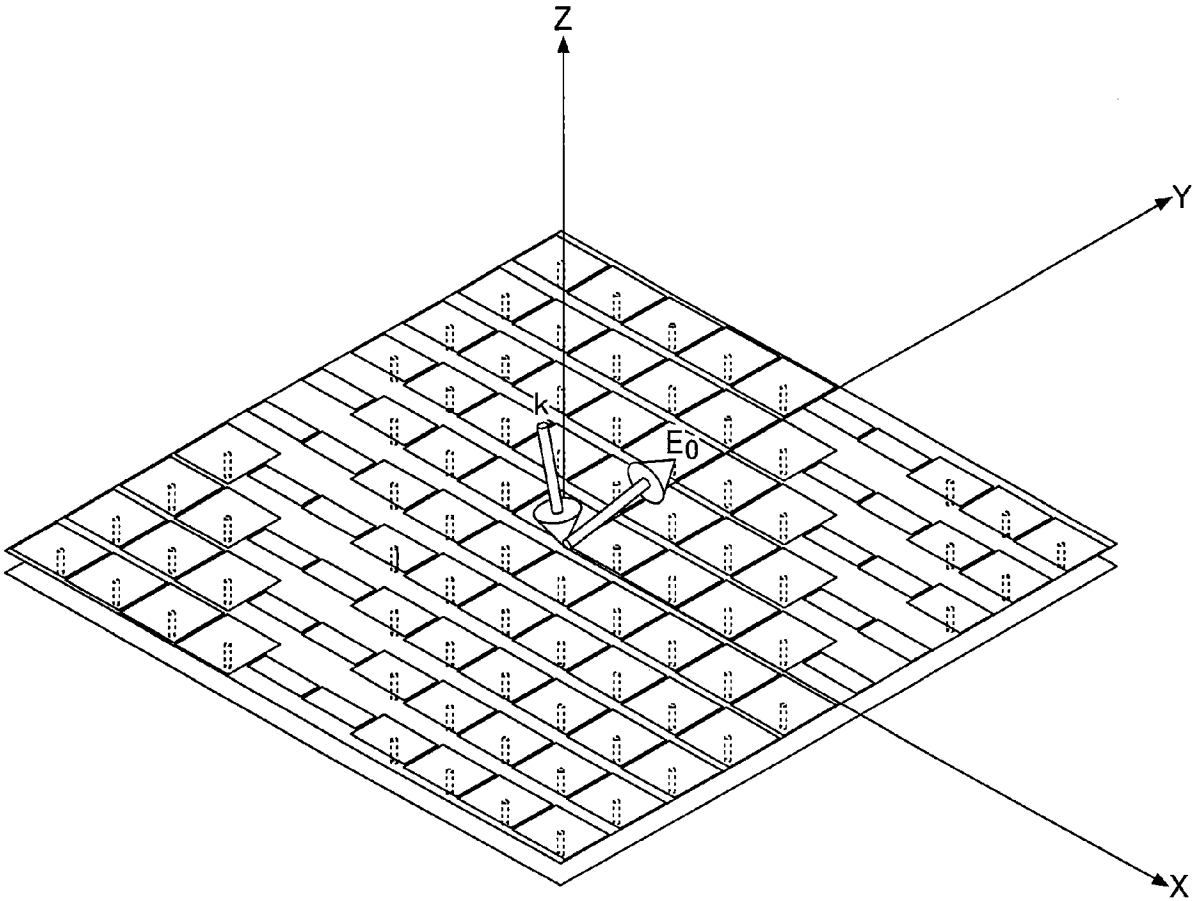
FIG. 46 is a diagram showing a structure of the reflectarray, which is used for a simulation.

FIG. 46 shows a unit structure which was used for simulation of a reflectarray, which reflects a radio wave based on the principle explained in <2. Phase difference control>. In the depicted unit structure, 10 pieces of elements are arranged in the x-axis direction, and 10 pieces of elements are also arranged in the y-axis direction. In the simulation, it was assumed that a plurality of the unit structures were arranged on the xy plane. The direction of the incident wave is indicated by k, and the direction of the reflected wave is indicated by $E_0$. In the simulation, the following parameters were used.

Frequency of a radio wave=11 GHz

Incident direction ($\theta_i$, $\phi_i$) of the incident wave=(10 degrees, 270 degrees)

Desired direction ($\theta_r$, $\phi_r$) of the reflected wave=(81 degrees, 52 degrees)

Distances between elements $\Delta x=\Delta y=4.5$ mm

Figure 47:
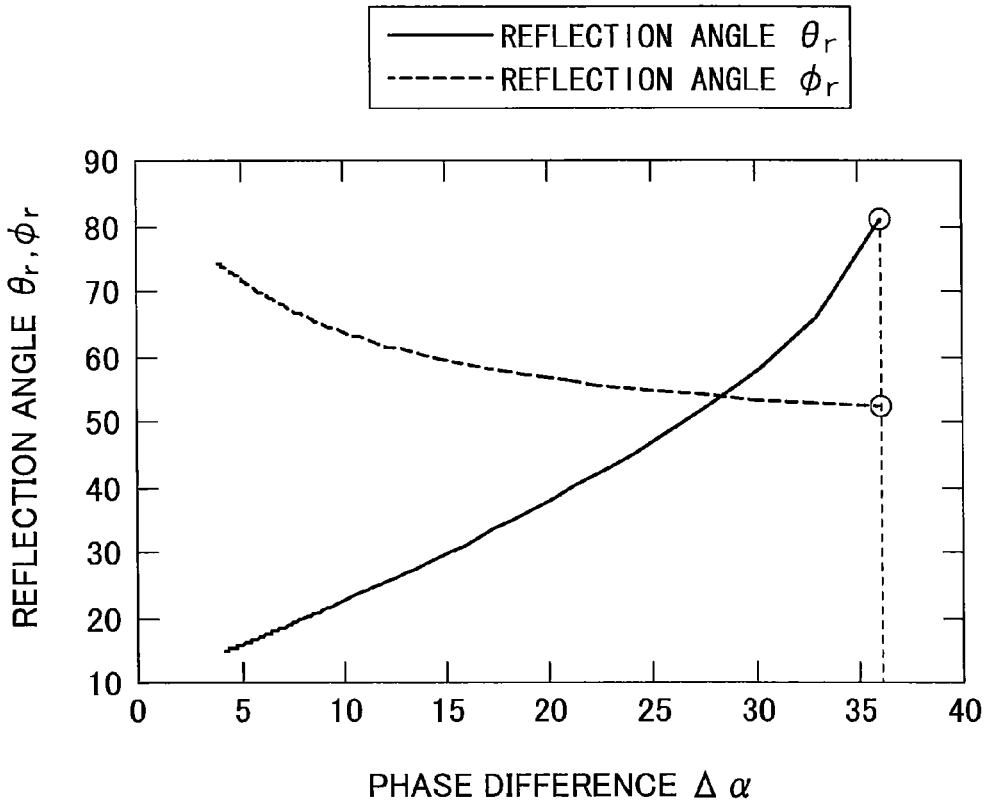
FIG. 47 is a diagram showing a relationship between a direction of reflection and a phase difference.

A ratio between reflection phase differences by corresponding elements neighboring in the x-axis direction and in the y-axis direction $\gamma(=\Delta\alpha_x/\Delta\alpha_y)=1$ A number of divisions per one period $\kappa=10$ FIG. 47 is a simulation result showing a relationship between the direction of the reflected wave ($\theta_r$, $\phi_r$) and the reflection phase difference of the neighboring elements ($\Delta\alpha=\Delta\alpha_x=\Delta\alpha_y$). The direction of the incident wave is $\theta_i=10$ degrees and $\phi_i=270$ degrees, and the distances between elements are $\Delta x=\Delta y=4.5$ mm. It can be found from FIG. 47 that, when the desired direction of the reflected wave is $\theta_r=81$ degrees and $\phi_r=52$ degrees, the corresponding phase difference $\Delta\alpha$ is 36 degrees. In this case, since phase differences in the whole range of 360 degrees are achieved by 10 pieces of elements, a number of divisions per one period $\kappa$ can be 10.

FIG. 48 shows the reflection phases to be achieved by corresponding elements included in a reflectarray such as shown in FIG. 47. For this example, 10 elements are arranged in the x-axis direction, and 10 elements are arranged in the y-axis direction, $\Delta\alpha_x=\Delta\alpha_y=36$ degrees, $\gamma=1$, and $\kappa=10$.

Figure 49:
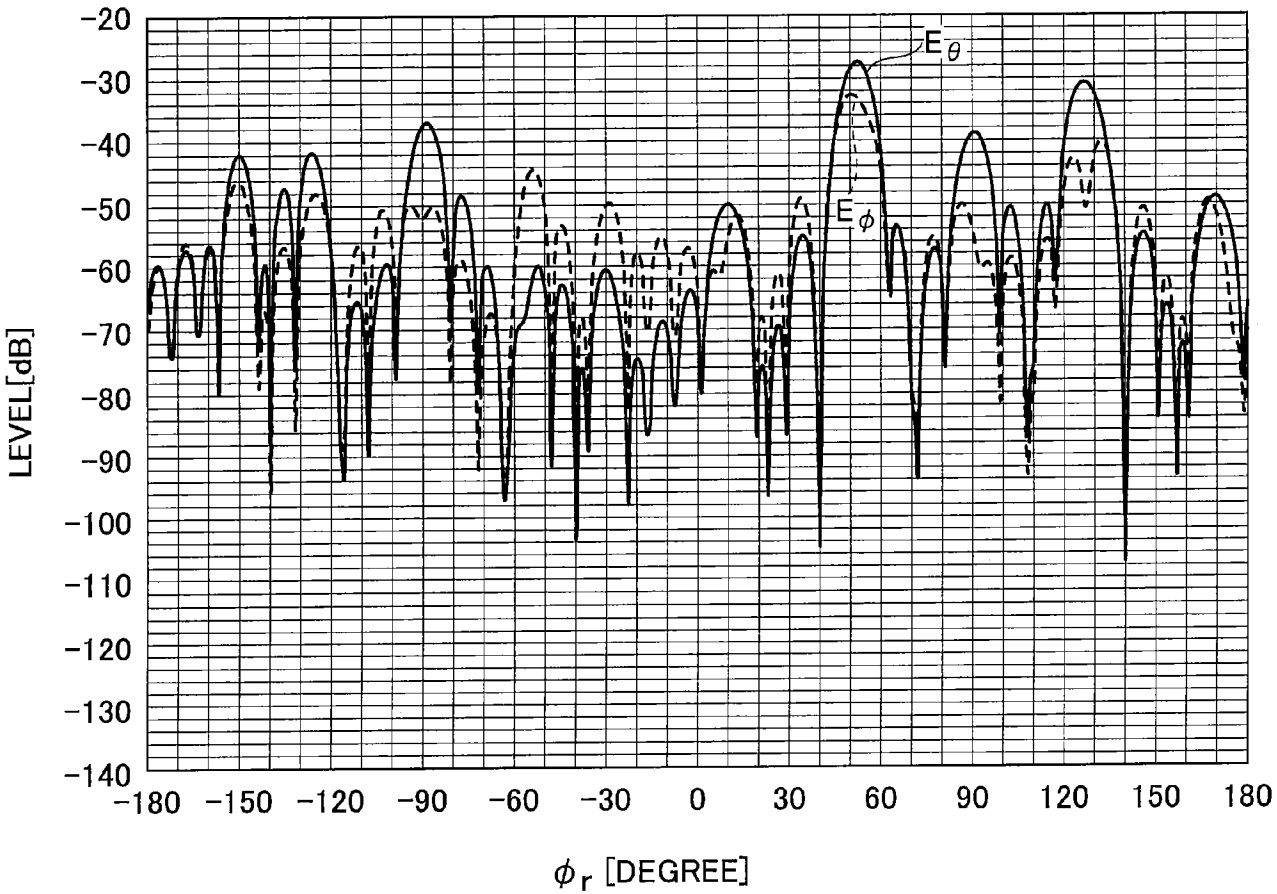
FIG. 49 is a diagram showing a result of a simulation for a case in which a radio wave enters the reflectarray and the radio wave is reflected ($\theta_r$=81 degrees)
Figure 50:
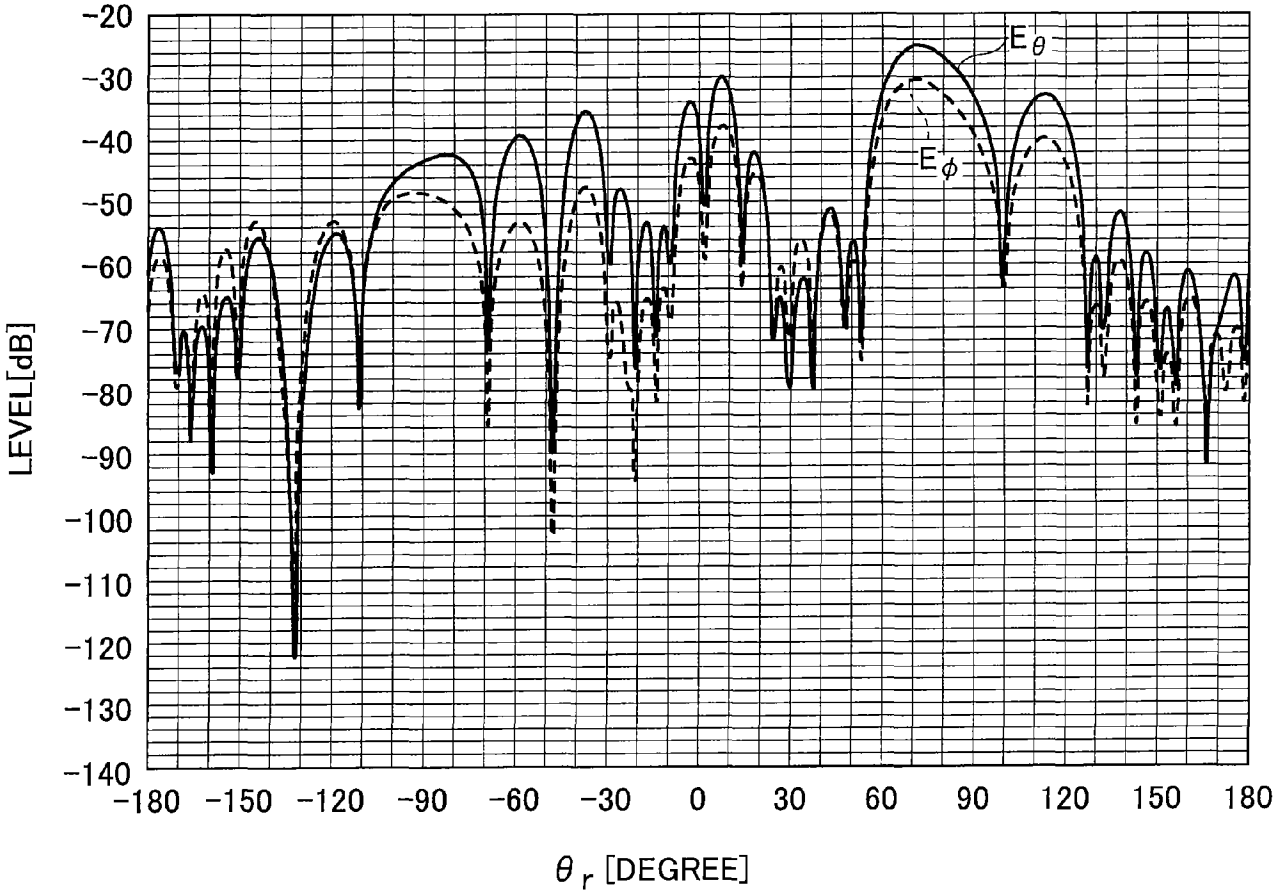
FIG. 50 is a diagram showing a result of a simulation for a case in which a radio wave enters the reflectarray and the radio wave is reflected ($\phi_r$=52 degrees)

FIG. 49 shows an electric field level of the reflected wave when a radio wave enters the reflectarray shown in FIG. 46. Here, the electric field level is observed within a conical surface, which forms 81 degrees with respect to the x-axis. As described above, $\theta_r=81$ degrees is a desired direction. The graph of $E_\theta$ indicates a level of the $\theta$-direction component, when the electric field vector of the reflected wave is expressed in the (r, $\theta$, $\phi$) polar coordinates. The graph of $E_\phi$ indicates a level of the $\phi$-direction component, when the electric field vector of the reflected wave is expressed in the (r, $\theta$, $\phi$) polar coordinates. In both of them, a strong peak occurs in the direction of $\phi_r=52$ degrees, and levels in other directions are regulated to be low. FIG. 50 shows an electric field level of the reflected wave, which is observed in a plane whose argument with respect to the x-axis is $\phi_r=52$ degrees, when a radio wave enters the reflectarray shown in FIG. 46. As described above, $\phi_r=52$ degrees is a desired direction. The graph of $E_\theta$ indicates a level of the $\theta$-direction component, when the electric field vector of the reflected wave is expressed in the (r, θ, ϕ) polar coordinates. The graph of $E_\phi$ indicates a level of the ϕ-direction component, when the electric field vector of the reflected wave is expressed in the (r, θ, ϕ) polar coordinates. In both of them, a strong peak occurs in the vicinity of the direction of $\phi_r$=81 degrees, and levels in other directions are regulated to be low. Accordingly, it can be found that the reflectarray reflects the incident wave strongly in the desired direction.

Figure 59:
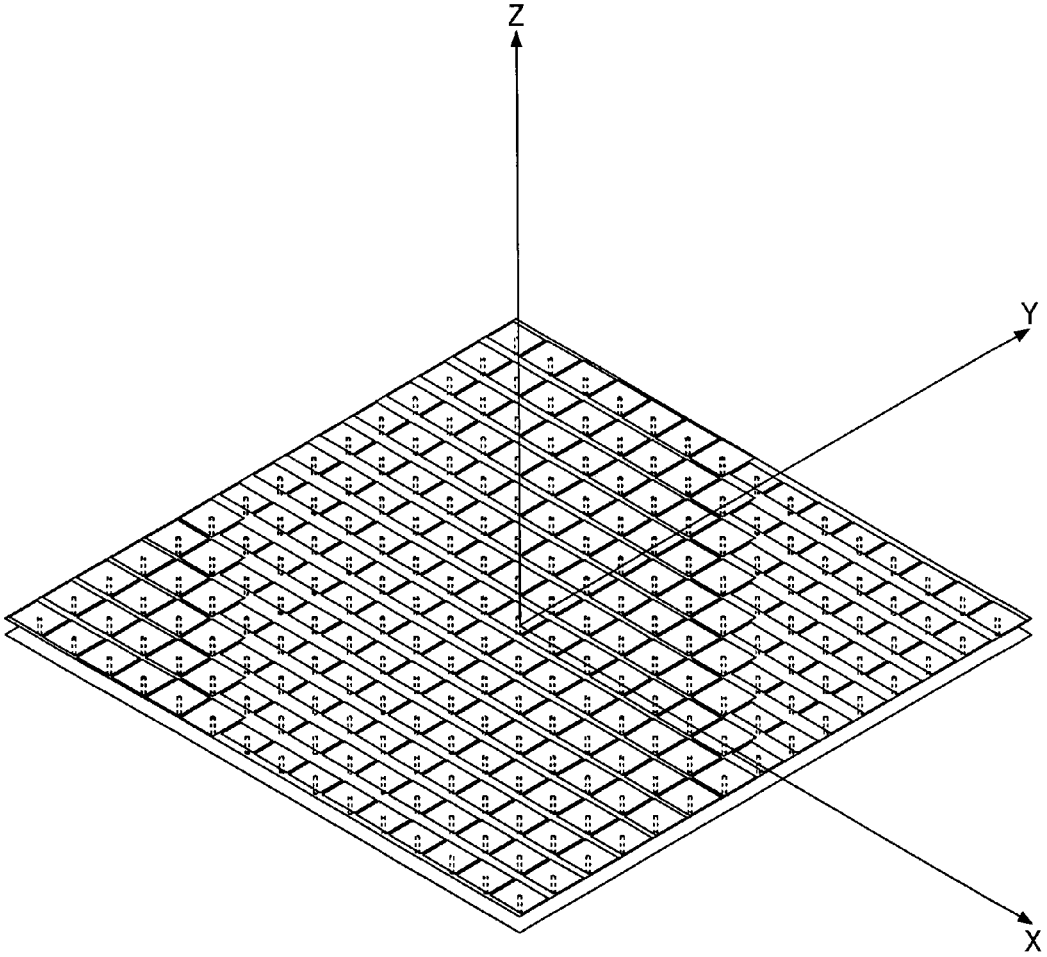
FIG. 59 is a diagram showing another structure of the reflectarray.
Figure 60:
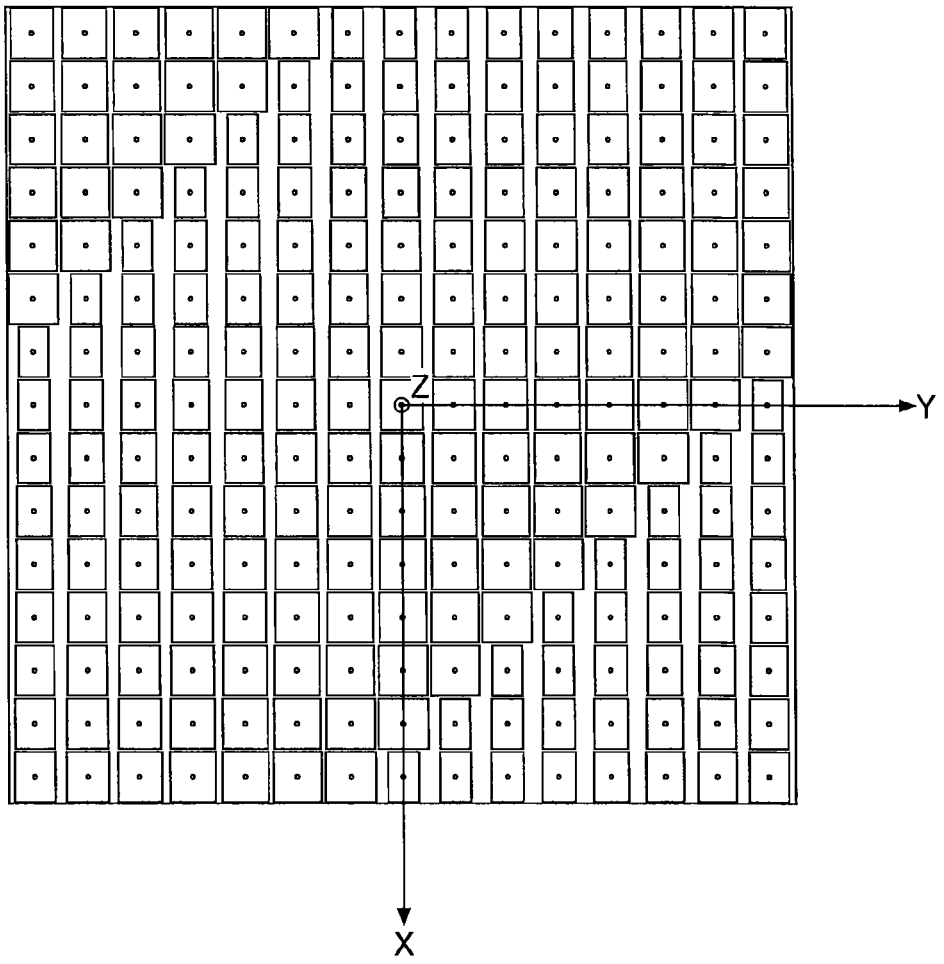
FIG. 60 is a plane view of the reflectarray having the other structure.

In the reflectarray shown in FIGS. 46 and 48, the number of elements arranged in the x-axis direction is 10 and the number of elements arranged in the y-axis direction is 10. However, the embodiment is not limited to this example, and another numerical example may be used. FIG. 59 shows a structure of a reflectarray, which can be used instead of the structure shown in FIG. 46. In the depicted example, 15 pieces of elements are arranged in the x-axis direction, and 15 pieces of elements are arranged in the y-axis direction. FIG. 60 shows a plane view of the structure shown in FIG. 18. FIG. 61 shows reflection phases which are to be achieved by corresponding elements included in the reflectarray shown in FIGS. 59 and 60. For this example, a frequency of a radio wave is 11 GHz, arguments of an incident wave are $\theta_i$=20 degrees and $\phi_i$=270 degrees, and a desired direction of a reflected wave is $\theta_r$=64 degrees and $\phi_r$=61 degrees. Distances between the elements are Δx=Δy=4.1 mm. For the case of this structure, since reflection phases within a range of 360 degrees are to be achieved by corresponding 15 pieces of elements, a reflection phase by the neighboring elements is 24 degrees (which is 360 degrees divided by 15).

Here, it is not required that a ratio γ between $\Delta\alpha_x$ and $\Delta\alpha_y$ is equal to one. For example, in Formula (12) (which shows $\Delta\alpha_x=\gamma\Delta\alpha_y=2\pi/\kappa$), it is possible to set κ=10, $\Delta\alpha_x$=36 degrees, γ=2, and $\Delta\alpha_y$=18 degrees. In this case, a unit structure of the reflectarray is formed such that 10 pieces of elements, whose reflection phases are different from each other by 36 degrees, are arranged in the x-axis direction, and 20 pieces of elements, whose reflection phases are different from each other by 18 degrees, are arranged in the y-axis direction.

<4. Gap-Variable Spurious Resonance>

<4.1 Reflection Phase>

Figure 22:
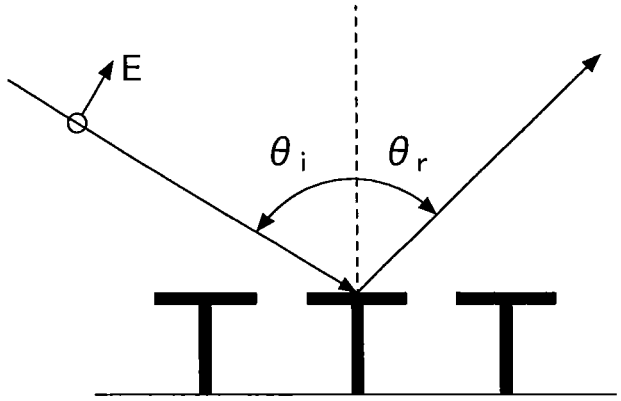
FIG. 22 is a diagram showing a situation in which a radio wave enters with an incident angle of $\theta_i$ and is reflected with a reflection angle of $\theta_r$.
Figure 23:
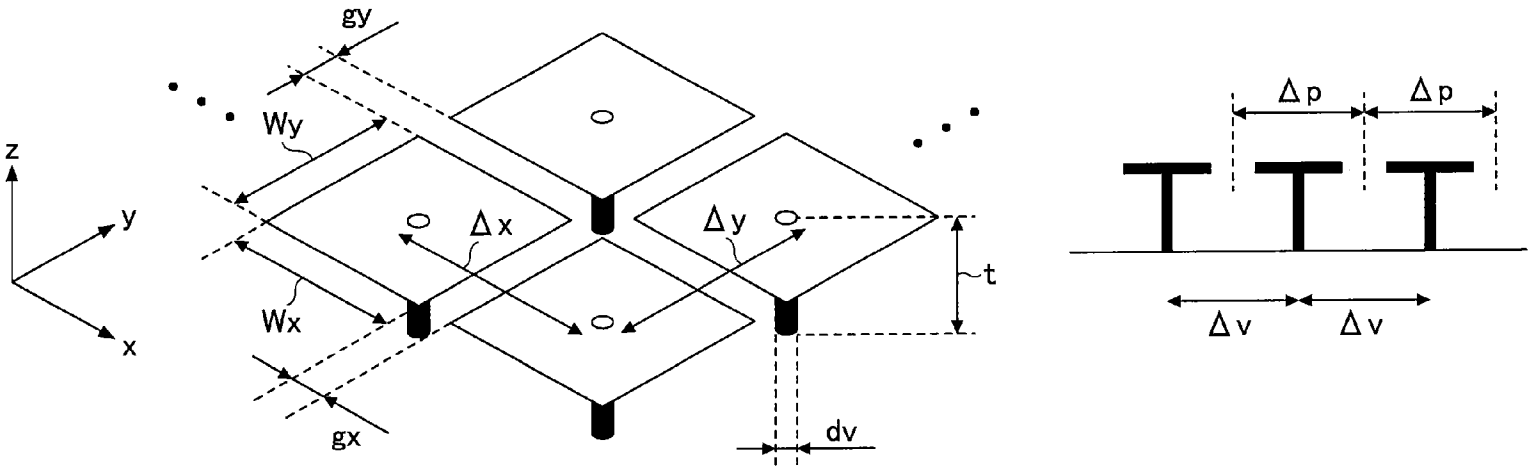
FIG. 23 is a diagram showing a portion of the reflectarray.

Next, there is considered a relationship between a reflection phase of a reflected wave by an element included in a reflectarray and a design parameter. The design parameter may be, for example, a frequency of a radio wave (f), distances between elements (Δx, Δy), sizes of a patch (Wx, Wy), distances or gaps between patches of neighboring elements (gx, gy), or the like. However, the design parameter is not limited to these. In the explanation below, it is assumed that a radio wave that enters the reflectarray and reflected by the reflectarray is a transverse magnetic wave (TM wave) such that an amplitude direction of an electric field is along a reflection surface. The reflection surface is a plane including the incident wave and the reflected wave. The reflectarray includes a plurality of elements. Each of the elements is formed to have a mushroom-like structure. As shown in FIG. 22, it is assumed that a radio wave enters the reflectarray from a direction of an incident angle $\theta_i$, and the radio wave is reflected in a direction of a reflection angle $\theta_r$. The reflectarray has a structure such that many elements are disposed on a substrate. Each element is formed to have the mushroom-like structure including a ground plate, a patch, and a dielectric substrate disposed between them. The ground plate and the patch are connected through a via. The ground plate may also be referred to as a grounding plate or a grounding surface. FIG. 23 shows a portion of the reflectarray. In the figure, only 4 pieces of elements are shown. Actually, there are many more elements. For convenience of explanation, a direction perpendicular to the ground plate of the element included in the reflectarray is assumed to be the z-axis in the present application. However, a way of defining coordinate axes is optional.

When a TM wave enters the reflectarray having the structure shown in FIG. 23 with an incident angle $\theta_i$ with respect to the z-axis, a reflection phase γ of the reflected wave can be expressed as follows.

[Expression 2]

$$\Gamma = \frac{\frac{\varepsilon_{zz}^{TM}}{\gamma_{TM}}\coth(\gamma_{TM}t) + \frac{\varepsilon_{zz}^{TM}-\varepsilon_h}{k}\cot(kt) + \frac{\eta_0}{jk_0}Z_g^{-1} - \frac{1}{jk_z}}{\frac{\varepsilon_{zz}^{TH}}{\gamma_{TM}}\coth(\gamma_{TM}t) + \frac{\varepsilon_{zz}^{TM}-\varepsilon_h}{k}\cot(kt) + \frac{\eta_0}{jk_0}Z_g^{-1} + \frac{1}{jk_z}} \tag{30}$$

$$\gamma_{TM} = \sqrt{k_p^2 + k_t^2 - k^2} \tag{31}$$

Here, it is assumed that the resonance frequency $r_f$ can be expressed by the following formula.

$$r_f = f_p/\sqrt{\in_r} \tag{32}$$

Here, $f_p$ represents a plasma frequency. $\in_r$ represents relative permittivity of the dielectric substrate disposed between the patch and the ground plate. The plasma frequency $f_p$ and a plasma wave number $k_p$ satisfy the following relation.

$$f_p = k_p c/(2\pi) \tag{33}$$

Here, c represents the speed of light. The plasma wave number $k_p$ and the distance between elements Δx satisfy the following relation.

[Expression 3]

$$(k_p\Delta x)^2 = \frac{2\pi}{\ln\left(\frac{\Delta x}{2\pi(dv/2)}\right) + 0.5275} \tag{34}$$

Here, dv represents a diameter of the via. In Formula (30), $\in_{zz}$ represents effective permittivity of a metallic material along the via, and it can be expressed by Formula (35) below. Relative permittivity of the substrate included in the mushroom-like structure is represented by $\in_h$, and the free space impedance is represented by $\eta_0$. A wave number in the free space is represented by $k_0$. A wave number in the material of the mushroom-like structure is represented by k, and it is expressed by Formula (36) below. The z component of the wave vector (or wavevector) is represented by $k_z$, and it is expressed by Formula (37) below.

[Expression 4]

$$\varepsilon_{zz} = \varepsilon_h\left(1 - \frac{k_p^2}{k^2 - q_z^2}\right) \tag{35}$$

$$k = k_0\sqrt{\varepsilon_h} \tag{36}$$

$$k_z = \sqrt{k_0^2 - k_t^2} \tag{37}$$

In Formula (30), $Z_g$ represents the surface impedance, and it satisfies the following relation.

[Expression 5]

$$Z_g = -j\frac{\eta_{eff}}{2\alpha} \tag{38}$$

Here, $\eta_{eff}$ represents the effective impedance, which is expressed by Formula (39) below, and $\alpha$ is a grid parameter expressed by Formula (40) below.

[Expression 6]

$$\eta_{eff} = \sqrt{\mu_0/\varepsilon_0\varepsilon_{eff}} \tag{39}$$

$$\alpha = \frac{k_{eff}\Delta_v}{\pi}\ln\left(\sin^{-1}\left(\frac{\pi g}{2\Delta_v}\right)\right) \tag{40}$$

<4.2 Dual Resonance>

Next, there is considered a frequency characteristic of the reflection phase by the element included in the reflectarray such as shown in FIG. 23. Specifically, when the design frequency was 11 GHz (wavelength=27.3 mm), the thickness of the substrate was 1 mm, the relative permittivity $E_r$ was 10.2, and the distances between elements were $\Delta x=\Delta y=2.25$ mm, the resonance frequency $r_f$ was 10.5 GHz. At this time, due to a spurious resonance phenomenon of this structure, at two frequencies, the reflection phase becomes zero. Here, the two frequencies are at a low frequency and a high frequency, respectively, and they are in phase. Accordingly, the phase rotates one cycle of 360 degrees between the two frequencies, at which the reflection phase becomes zero. The above-described numerical examples are for exemplifying purpose only, and any suitable numerical value may be used. In FIG. 23 and the explanation below, the distance between elements may be defined to be a distance between vias of neighboring elements $\Delta_v$ ($\Delta x$ or $\Delta y$), or another definition may be used. For example, the distance between elements may be defined to be a distance $\Delta_p$ from a center of a gap between neighboring patches to a center of the next gap.

Figure 24:
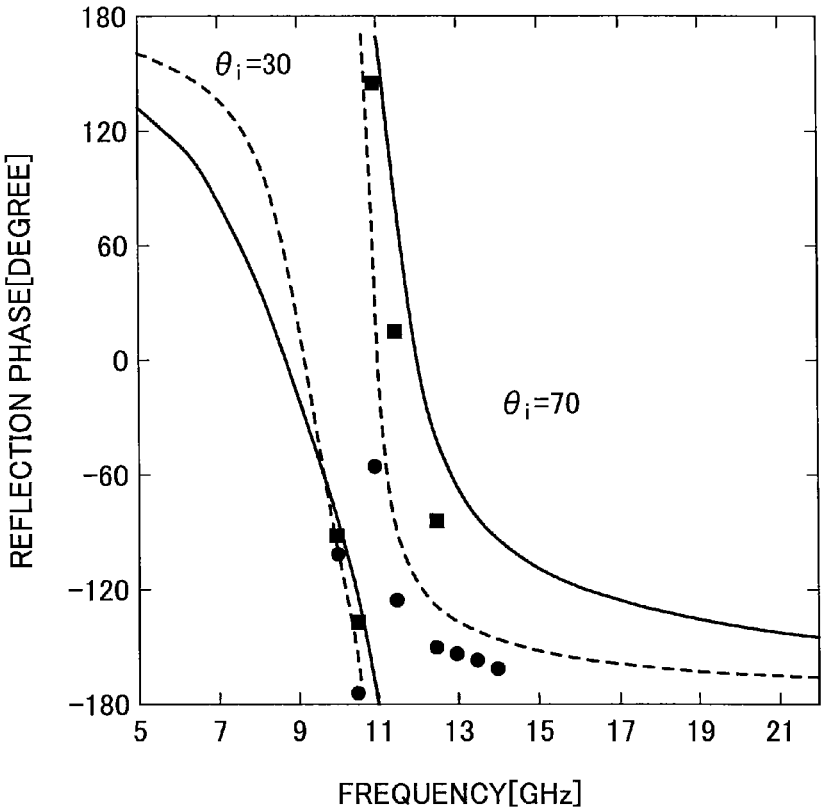
FIG. 24 is a diagram showing frequency characteristics of the reflection phase for corresponding cases in which the incident angles $\theta_i$ are 70 degrees and 30 degrees.

FIG. 24 shows frequency characteristics of the reflection phase for cases in which the incident angles $\theta_i$ are 70 degrees and 30 degrees, respectively. The dashed line shows a theoretical value for the case in which the incident angle $\theta_i$=30 degrees. The "theoretical value" in the explanation of FIG. 24 is a value that is calculated by using the above-described Formula (30). The theoretical value of the reflection phase $\phi$ can be obtained as the argument or a phase angle $\phi=\arg(\Gamma)$ of the reflection coefficient $\Gamma$ of Formula (30). The circular marks indicate simulation values of the reflection phase, which are obtained for the case of the incident angle $\theta_i$=30 degrees by an electromagnetic field analyzing tool (HFSS). The solid line indicates the theoretical values of the reflection phase for the case of the incident angle $\theta_i$=70 degrees. The square marks indicate simulation values of the reflection phase, which are obtained for the case of the incident angle $\theta_i$=70 degrees by the electromagnetic field analyzing tool (HFSS). For both the cases, the resonance occurs in the vicinity of 11 GHz. It can be found that the frequency characteristic of the reflection phase differs depending on the incident angle. In this manner, when a TM wave obliquely enters a mushroom-like structure (the case of the incidence in which the incident angle is greater than 0 degrees with respect to the z-axis), the resonance frequency $r_f$ is 10.5 GHz, and at this frequency the reflection phase (continuously) varies from −180 degrees to +180 degrees. In this case, as shown in FIG. 24, the reflection phase becomes 0 at two frequencies (the frequency at which plus and minus of the reflection phase is reversed) of approximately 8.75 GHz and 12.05 GHz. Namely, as the frequency varies from 8.75 GHz to 12.05 GHz, the phase varies 360 degrees. The frequency at which the reflection phase becomes 0 is called a resonance frequency of the mushroom-like structure, besides the above-described $r_f$. For the front incidence, the resonance occurs at one frequency of approximately 9.5 GHz. For oblique TM incidence, the resonance occurs at two frequencies. Thus, it can be referred to as the "dual resonance."

It has been found that such a dual resonance characteristic is obtained not only between the reflection phase and the frequency, but also between the reflection phase and another design parameter. The design parameter may be, for example, a frequency (f) of a radio wave, distances between elements ($\Delta x$, $\Delta y$), the size of a patch of the element (Wx, Wy), distances or gaps between patches of neighboring elements (gx, gy). However, the design parameter is not limited to these.

Figure 25:
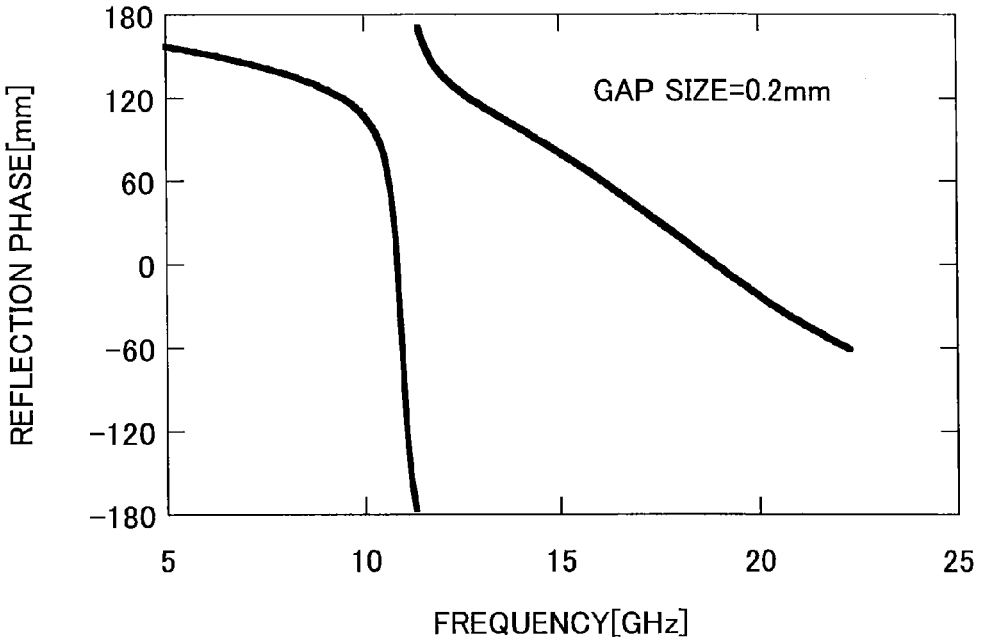
FIG. 25 is a diagram showing a frequency characteristic of a reflection phase by the elements included in the reflectarray.

FIG. 25 shows a result of simulation of the relationship between the reflection phase of the element included in the reflectarray such as shown in FIG. 23 and the frequency. Unlike the example shown in FIG. 24, the relative permittivity of the dielectric material $\in_r$ is 4.5, a diameter dv of the via hole is 0.35 mm, the gaps between the patches of the elements (the sizes of the gaps) are set to be gx=gy=0.2 mm. As depicted, the resonance occurs at the frequency of approximately 11 GHz.

Figure 26:
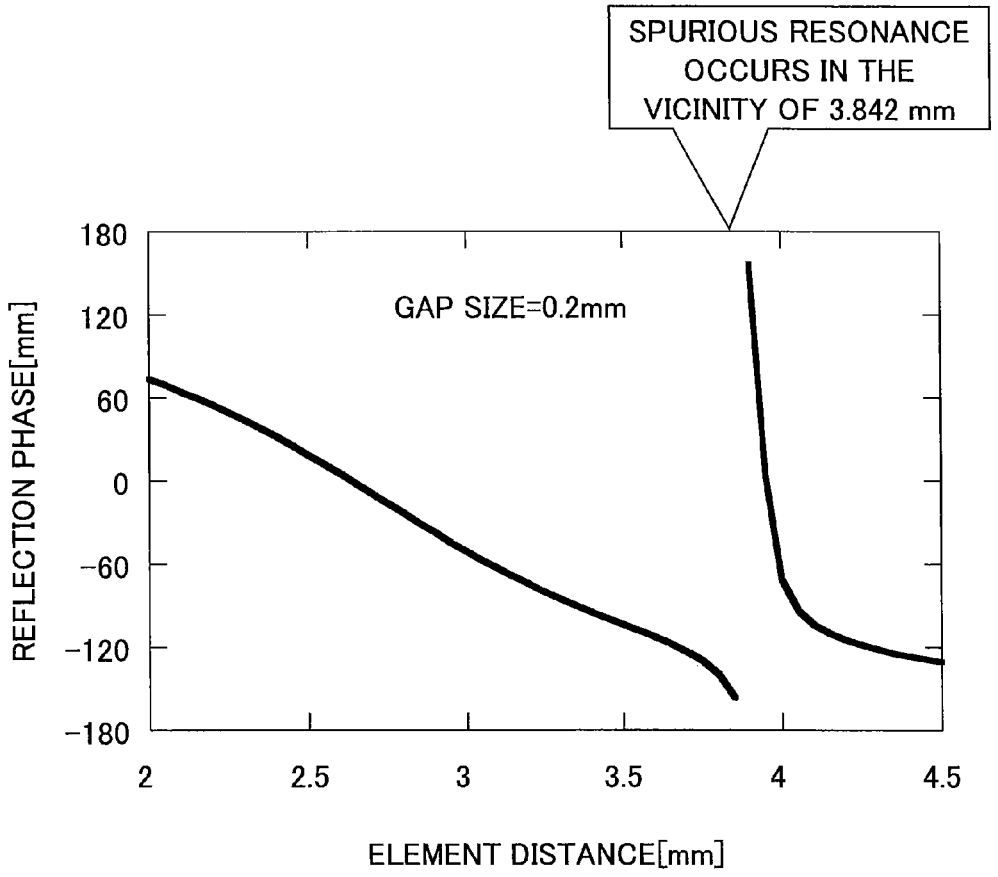
FIG. 26 is a diagram showing a relationship between the reflection phase by the elements included in the reflectarray and a distance between the elements.

FIG. 26 shows a result of the simulation for the relationship between the reflection phase of the element included in the reflectarray such as shown in FIG. 23 and the distance between elements. In this example, the relative permittivity of the dielectric material $\in_r$ is 4.5, a diameter dv of the via hole is 0.35 mm, the gaps between the patches of the elements (the sizes of the gaps) are set to be gx=gy=0.2 mm. As depicted, the resonance occurs when the distance between the elements is approximately 3.842 mm (i.e., $\Delta x=\Delta y=3.842$ mm).

Figure 27:
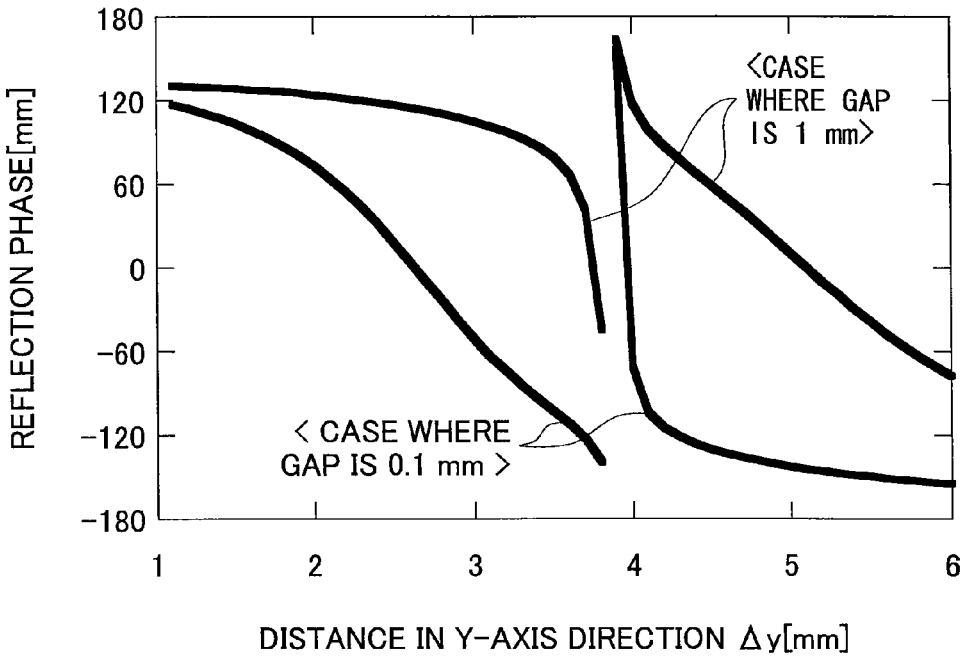
FIG. 27 is a diagram showing relationships between the reflection phase of the elements and the distance between the elements for corresponding different gap sizes.
Figure 28:
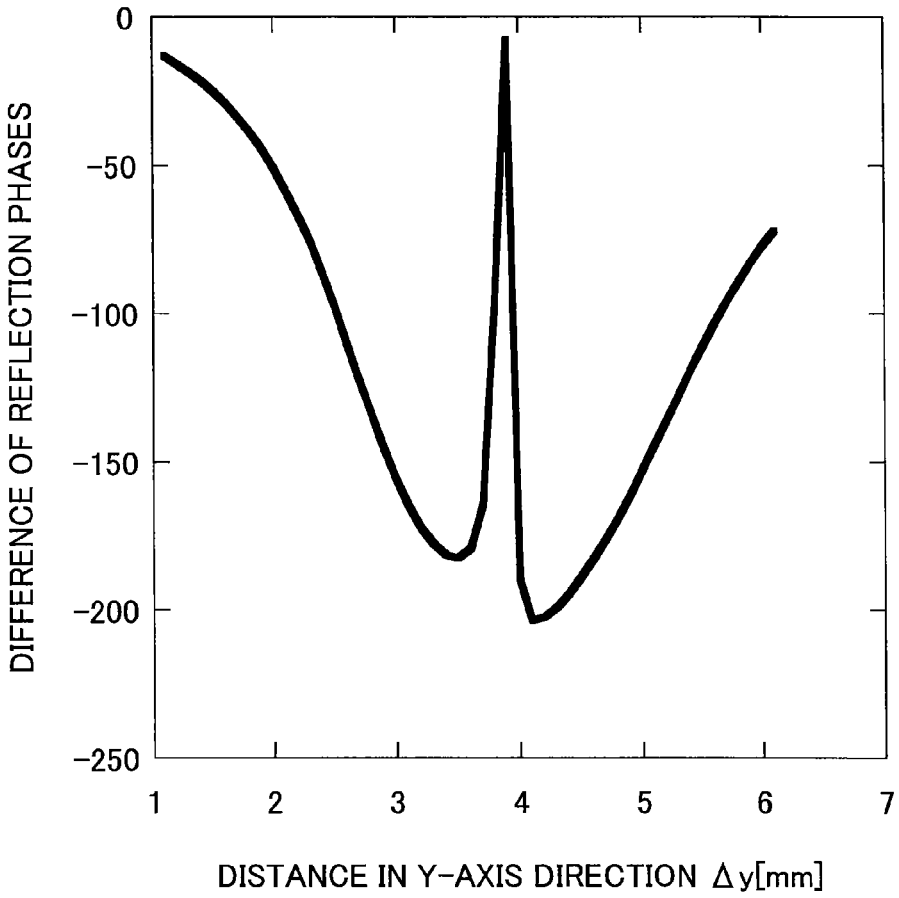
FIG. 28 is a diagram showing a relationship between a difference between the reflection phase for the case in which the gap size is 0.1 mm and the reflection phase for the case in which the gap size is 1 mm and the distance between the elements.

FIG. 27 shows a result of the simulation for the relationship between the reflection phase of the element included in the reflectarray such as shown in FIG. 23 and the distance between the elements. In this example, the relative permittivity of the dielectric material $\in_r$ is 4.5, a diameter dv of the via hole is 0.35 mm. However, the cases are compared in which the gaps between the patches of the elements (the sizes of the gaps) are set to be gx=gy=0.1 mm, and in which the gaps between the patches of the elements (the sizes of the gaps) are set to be gx=gy=1 mm, respectively. As shown in FIGS. 26 and 27, the resonance occurs when the distance between the elements is approximately 3.842 mm ($\Delta y=3.842$ mm). Further, FIG. 28 shows a relationship between the difference between the reflection phases and the distance between the elements for the case of FIG. 27 in which the gap is 0.1 mm and for the case of FIG. 27 in which the gap is 1 mm, respectively. As depicted, a difference between the reflection phases becomes zero at the distance between the elements at which a plasma resonance occurs ($\Delta y=3.842$ mm). Peaks occur in the difference between the reflection phases around such distance between the elements.

FIGS. 24-28 show correspondence relations between the reflection phase and the frequency or the distance between the elements. Specifically, when the individual elements included in the reflectarray are designed by using the correspondence relation that is held between the reflection phase and the distance between the elements, the distance between the elements may be varied for each of the reflection phases of the elements. In this case, the structure that can be designed and the axial direction in which the reflection phase is varied may be significantly restricted, and it is possible that the degree of freedom on designing becomes small. The inventors and the like of the present invention have found that, when a gap size of elements is varied while a frequency and a distance between elements are fixed with which a spurious resonance is induced by oblique TM incidence, a dual resonance characteristic is obtained at a specific gap size. Such a characteristic may not be derived from Formula (30), but it can be found only when executing simulation or conducting an experiment. In the following embodiment, a reflectarray is formed by utilizing this characteristic. Namely, at a specific frequency and at a specific distance between elements, the reflection phase and the gap size are determined by the graph which is obtained by varying the gap size. Hereinafter, there is considered a correspondence relation between the reflection phase and a distance between patches of elements (the gap size).

Figure 29:
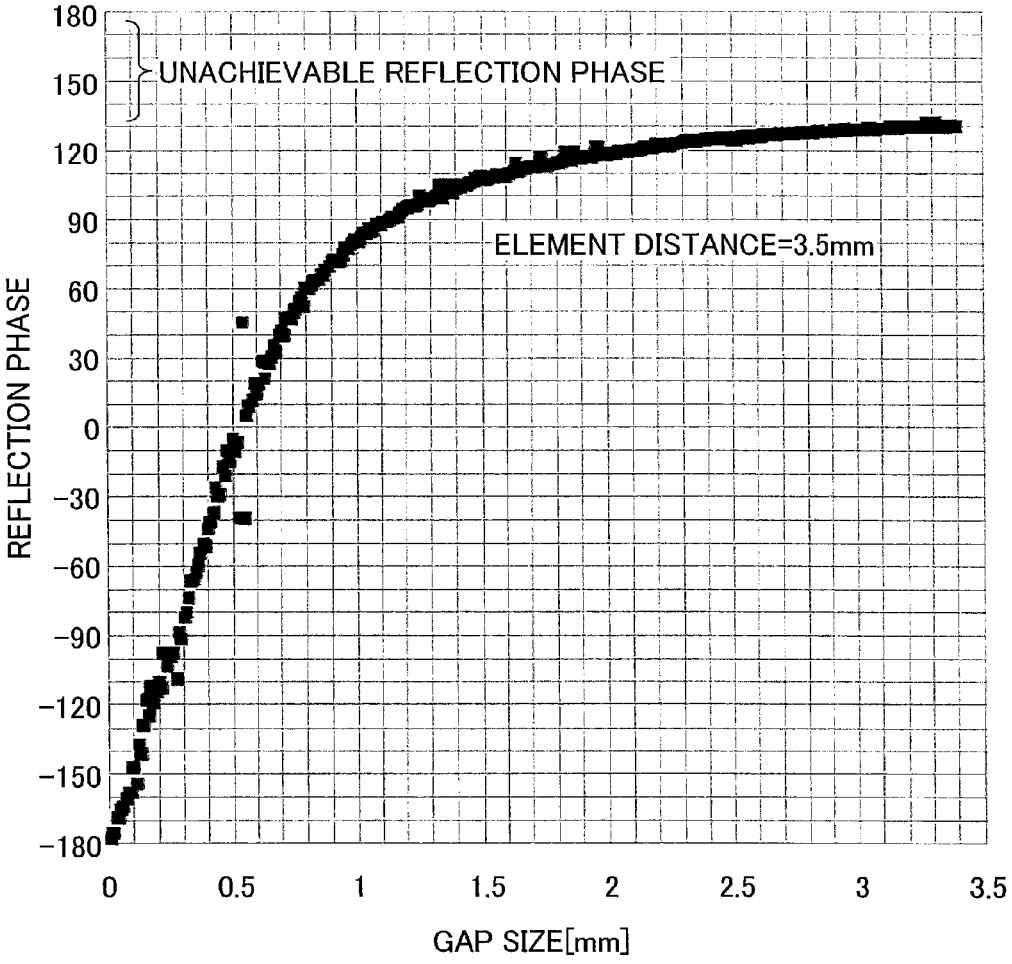
FIG. 29 shows a result of a simulation in which no spurious resonance occurs in the relationship between the reflection phase of the elements included in the reflectarray and the gap size.

FIG. 29 shows a result of the simulation for the relation between the reflection phase of the element included in the reflectarray such as shown in FIG. 23 and the gap size. The gap size is the distances between the patches of the neighboring elements (gx, gy). In this example, the relative permittivity of the dielectric material $\in_r$ is 4.5, and the diameter dv of the via hole is 0.35 mm. However, the distance between the elements is 3.5 mm. For the depicted example, as the gap size increases from 0 to 1 mm, the reflection phase rapidly increases from −180 degrees until approximately 80 degrees. Subsequently, the reflection phase increases until approximately 130 degrees at most, even if the gap size increases. Accordingly, for the case of the depicted example, it is difficult to achieve a reflection phase within a range from 130 degrees to 180 degrees.

Figure 30:
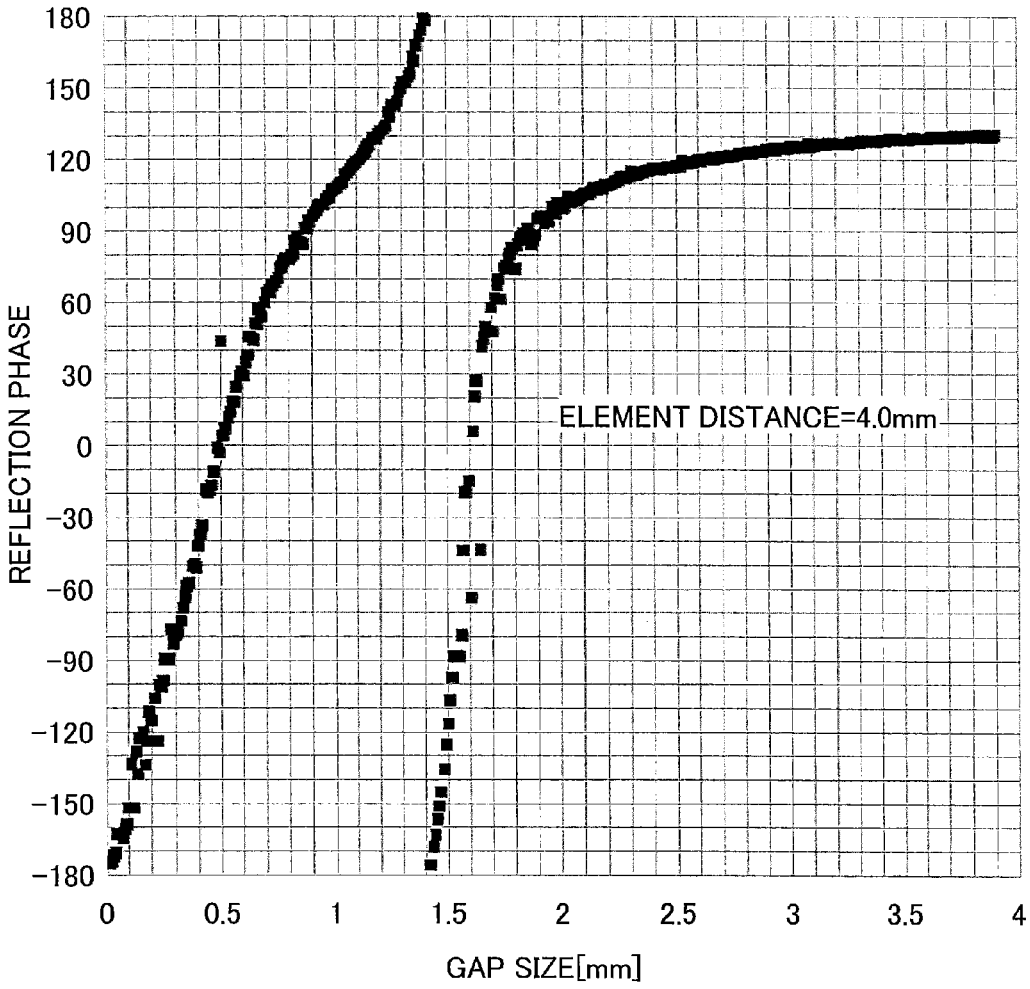
FIG. 30 shows a result of a simulation in which spurious resonance occurs in the relationship between the reflection phase of the elements included in the reflectarray and the gap size.

FIG. 30 also shows a result of the simulation between the reflection phase of the element included in the reflectarray such as shown in FIG. 23 and the gap size, similar to FIG. 29. However, it is different from the example shown in FIG. 23 in a point that the distance between the elements is 4.0 mm. For the depicted example, as the gap size increases from 0 to 1.4 mm, the reflection phase rapidly increases from −180 degrees until 180 degrees. Subsequently, as the gap size increases from 1.4 mm to 2.5 mm, the reflection phase rapidly increases from −180 degrees until approximately 120 degrees. After that, the reflection phase increases until 130 degrees at most, even if the gap size increases. According to the depicted example, it can be found that, for any reflection phase from −180 degrees to +180 degrees, there exists a gap size that can achieve the reflection phase. For a reflection phase from −180 degrees to 130 degrees, there are two gap sizes that can achieve the reflection phase. For a reflection phase from 130 degrees to 180 degrees, there is only one gap size that can achieve the reflection phase. It has been found that the dual resonance occurs when the gap size is varied at a distance between elements which is greater than the distance between the element with which the resonance occurs (which is 3.842 mm in FIGS. 26-28), and at the frequency at which the resonance occurs in FIGS. 26-28 (which is 11 GHz in FIGS. 24 and 25).

Figure 31:
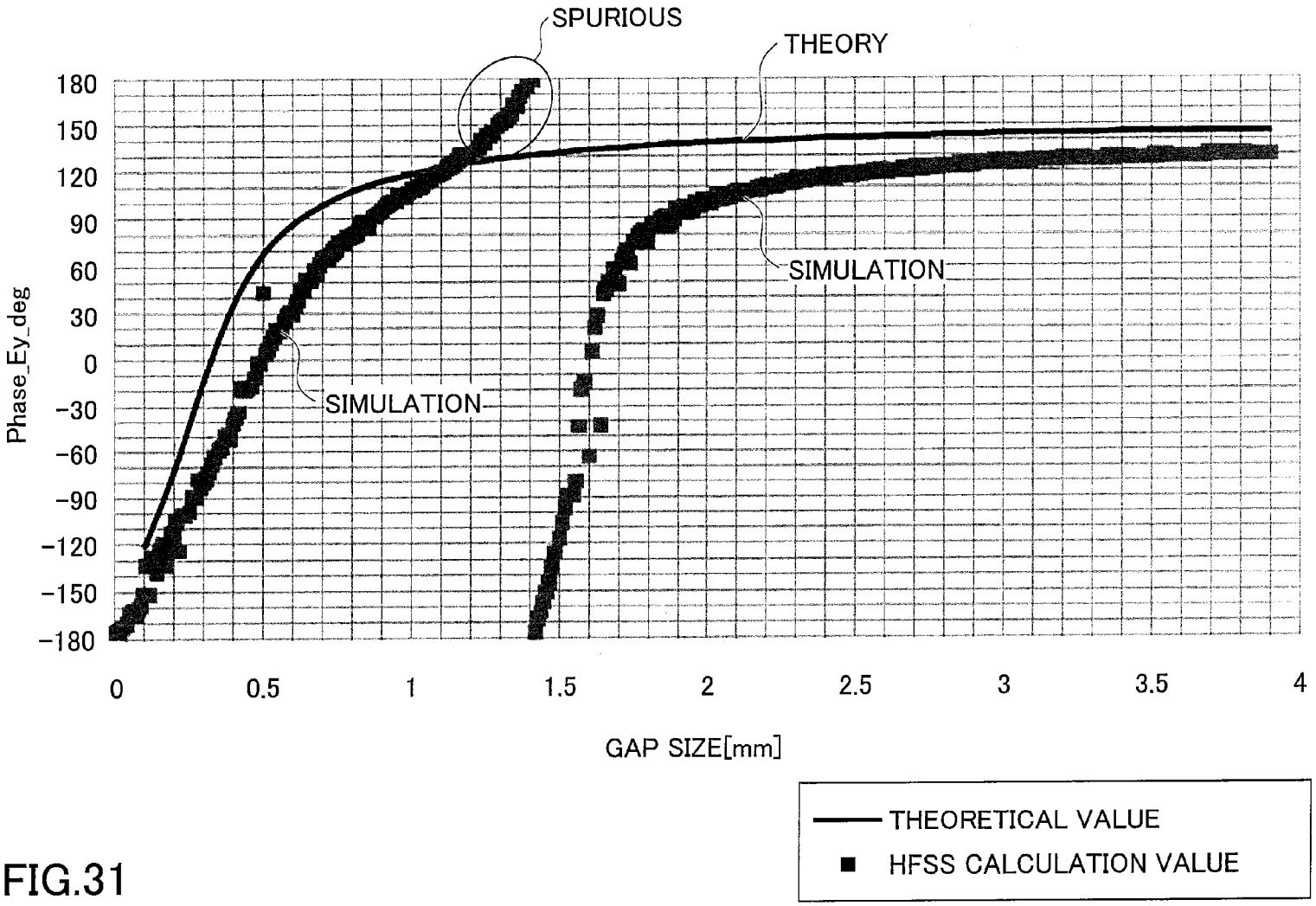
FIG. 31 is a diagram showing relationships between the reflection phase of the elements included in the reflectarray and the gap size, which are based on theory and based on a simulation, respectively.

FIG. 31 shows a result of the simulation for the relation between the reflection phase of the element included in the reflectarray such as shown in FIG. 23 and the gap size. As described above, the gap size corresponds to gx and gy in FIG. 23. For the current example, for simplicity, gx=gy is assumed. In FIG. 31, two graphs are shown. The graph of "theory" indicates the theoretical value of the reflection phase, which is derived as the argument or the phase angle (arg(Γ)) of the reflection coefficient Γ indicated in Formula (30). The graph of "simulation" indicates the result of the simulation of reflection phases from corresponding elements when a radio wave enters the elements arranged as shown in FIG. 23. The simulation result is calculated by the electromagnetic field analyzing tool (HFSS). In the simulation, the frequency of the radio wave is assumed to be 11 GHz, the thickness of the substrate is assumed to be 1 mm, the distance between the element is assumed to be 4 mm, which is slightly greater than 3.842 mm with which the resonance is induced, the incident angle $\theta_i$ is assumed to be 20 degrees, and the relative permittivity of the dielectric material is assumed to be 4.5.

In the graph of "simulation" in FIG. 31, the portion which is different from that of the graph of "theory" is referred to as the "spurious," the "spurious value," the "spurious portion," or the like. For the case of the graph of "theory," as the gap size increases from 0 to 1.9 mm, the reflection phase rapidly increases from −180 degrees until approximately 130 degrees. Subsequently, the reflection phase increases until 145 degrees at most, even if the gap size increases. Accordingly, when the design is made by using the graph of "theory," it is difficult to achieve a reflection phase from 145 degrees to 180 degrees. However, by investigating the relation between the reflection phase and the gap size by actually executing the simulation while assuming the reflectarray such as shown in FIG. 23, the graph of "simulation" has been obtained such that a portion of it does not coincide with that of the graph of "theory." For the case of the graph of "simulation," as the gap size increases from 0 to 1.4 mm, the reflection phase rapidly increases from −180 degrees until 180 degrees. When the gap size increases from 1.4 mm to 2.5 mm, the reflection phase rapidly increases from −180 degrees until approximately 120 degrees. After that, the reflection phase increases until 130 degrees at most, even if the gap size increases. In this manner, the phenomenon in which the graph of "theory" is significantly different from the actual result of the simulation is not known prior to filing this application, at least. Accordingly, with the frequency and the distance between the elements (strictly speaking, which is greater than that distance between elements) which induce the dual resonance, a reflection phase in any range from −180 degrees to +180 degrees can be achieved by selecting a gap size for achieving the desired reflection phase. By forming a reflectarray by such elements, a reflectarray having good reflection characteristics can be produced.

<4.3 Design Method>

Figure 32:
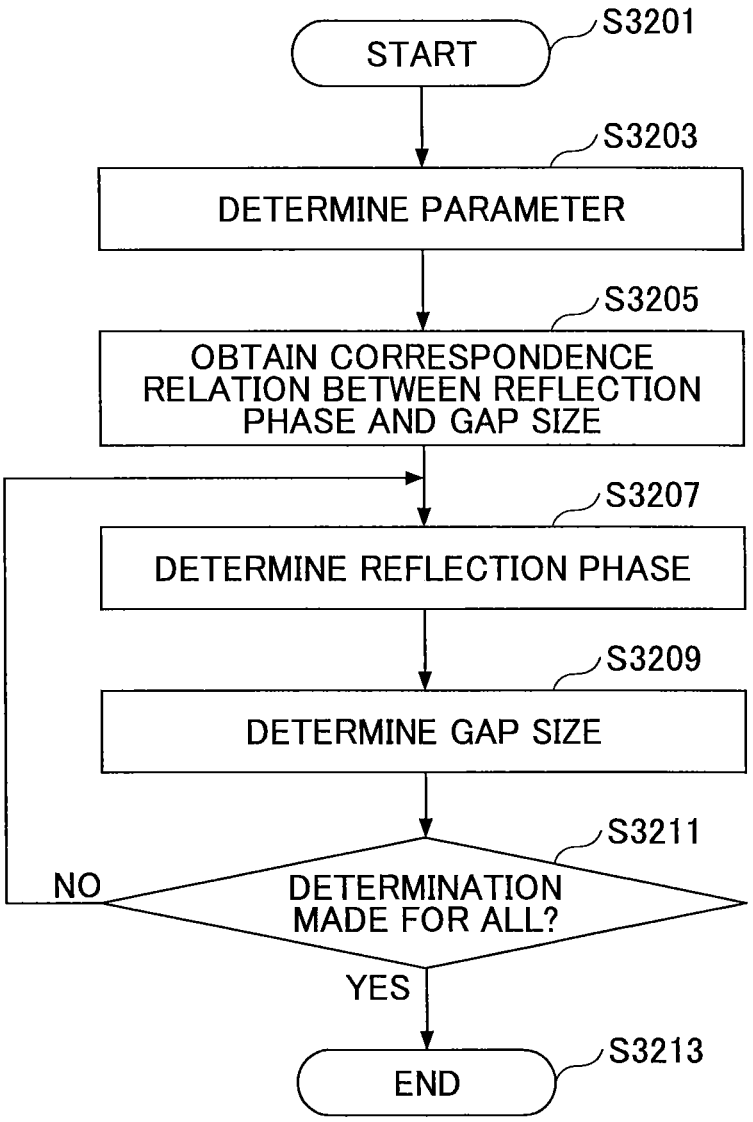
FIG. 32 is a flowchart showing a design procedure for determining a gap size between patches of elements included in the reflectarray.

Referring to FIG. 32, a design procedure is explained which is for determining the gap between the patches of the elements included in the reflectarray. FIG. 32 is a flowchart showing an example of such a design procedure. The flow stats at step S3201 and proceeds to step S3203.

At step S3201, values are determined for parameters which are to be determined in advance and for parameters which can be determined in advance. For example, the values are determined in advance, for example, for the design frequency, the thickness of the dielectric substrate, the relative permittivity of the dielectric substrate, the incident angle of the radio wave, and the reflection angle of the radio wave. According to these parameters, it is determined that what type of relationship is to be held between the reflection phase and the gap size. For the current example, a frequency that causes the dual resonance such as shown in FIGS. 24 and 25 is utilized, the distance between the elements is fixedly utilized, which is greater than the distance between the elements which cause the dual resonance such as shown in FIGS. 26-28. Consequently, the reflection phase demonstrates the characteristic of the dual resonance, with respect to the gap size.

At step S3203, data (a correspondence relation) is obtained, which indicates the relationship which is held between the reflection phase (the reflection phase for the case in which the radio wave enters the element and it is reflected) and the gap size. Specific examples of such data are data that indicates the correspondence relation such as shown in FIGS. 30 and 31. The data of such a correspondence relation is the graph in FIG. 30, or the graph of "simulation" in FIG. 31. Alternatively, data of the correspondence relation may be obtained by an experiment. In either case, a reflection phase is calculated or measured for each of the gap sizes for the case in which a radio wave enters a model structure with an incident angle of $\theta_i$. Here, the model structure includes many (in theory, which is an infinite number) elements which are arranged with certain gap sizes. By obtaining the reflection phases for various types of gap sizes, the data of the correspondence relation is obtained, such as shown in FIGS. 30 and 31. At step S3205, the reflection phase is obtained as a function of the gap size, and data representing the function is stored in a memory.

At step S3207, a reflection phase to be achieved by a specific element is determined. For the case of the graph of FIG. 30 or the graph of "simulation" of FIG. 31, two gap values exist, which is for achieving a specific value of the reflection phase (which is a reflection phase in the range from −180 degrees to 130 degrees for the example shown in FIGS. 30 and 31). Contrary to this, only one gap value exists, which is for achieving another specific value of the reflection phase (which is a reflection phase in the range from 130 degrees to 180 degrees for the example shown in FIGS. 30 and 31). For example, there are two gap sizes for achieving the reflection phase of 0 degrees, which are approximately 0.5 mm and approximately 1.6 mm. In this case, any one of the gap sizes may be utilized. However, for example, the value which is closer to the graph of "theory" may be used. For the reflection phase which is not derived from the graph of "theory" (the spurious portion which is surrounded by a round frame in FIG. 31), only one gap size exists for achieving that value. Thus, that value is used as it is. As described above, in the graph that is obtained by the simulation, the portion that is separated from the graph of "theory" is referred to as the "spurious," the "spurious value," the "spurious portion," or the like.

At step S3209, the gap size corresponding to the reflection phase to be achieved by a specific element is determined in accordance with the data of the correspondence relation which is stored in the memory. The size of the patch is derived from the determined gap size and the assumed predetermined distance between the elements. For example, a reflection phase of an element disposed at the origin of the reflectarray is determined, and the gap size for achieving the reflection phase is determined for the element #0 at the origin.

At step S3211, a determination is made as to whether the gap size is determined for all the elements. When there is an element for which the gap size is not determined, the flow returns to step S3207, and the reflection phase and the gap size is determined for the remaining elements. For example, after the gap size of the element at the origin is determined, the reflection phase to be achieved by the element #1 adjacent to the element at the origin is determined. The gap size corresponding to the reflection phase is obtained by referring to the correspondence relationship which is stored in the memory, and it is determined as the gap size of the element #1. Subsequently, the gap sizes of all the elements are repeatedly determined in the same manner. When a determination is made at step S3211 that the gap size is determined for all the elements, the flow proceeds to step S3213, and it is terminated.

In this manner, the procedure to determine the gap size of the specific element in accordance with the correspondence relation obtained in advance is repeated for each of the plurality of elements, so that the specific element achieves the suitable specific reflection phase. Namely, by repeating the procedure for determining the reflection phase, the position of the element (the position vector), and the gap size, the specific gap size of each of the elements are determined.

The gap size between the patches of the elements included in the reflectarray which is on the xy plane may be achieved by the structure such as shown in FIGS. 4 and 5, or may be achieved by the structure such as shown in FIGS. 8-11.

<4.4 Difference as to Whether a Spurious Portion is Utilized>

Figure 33:
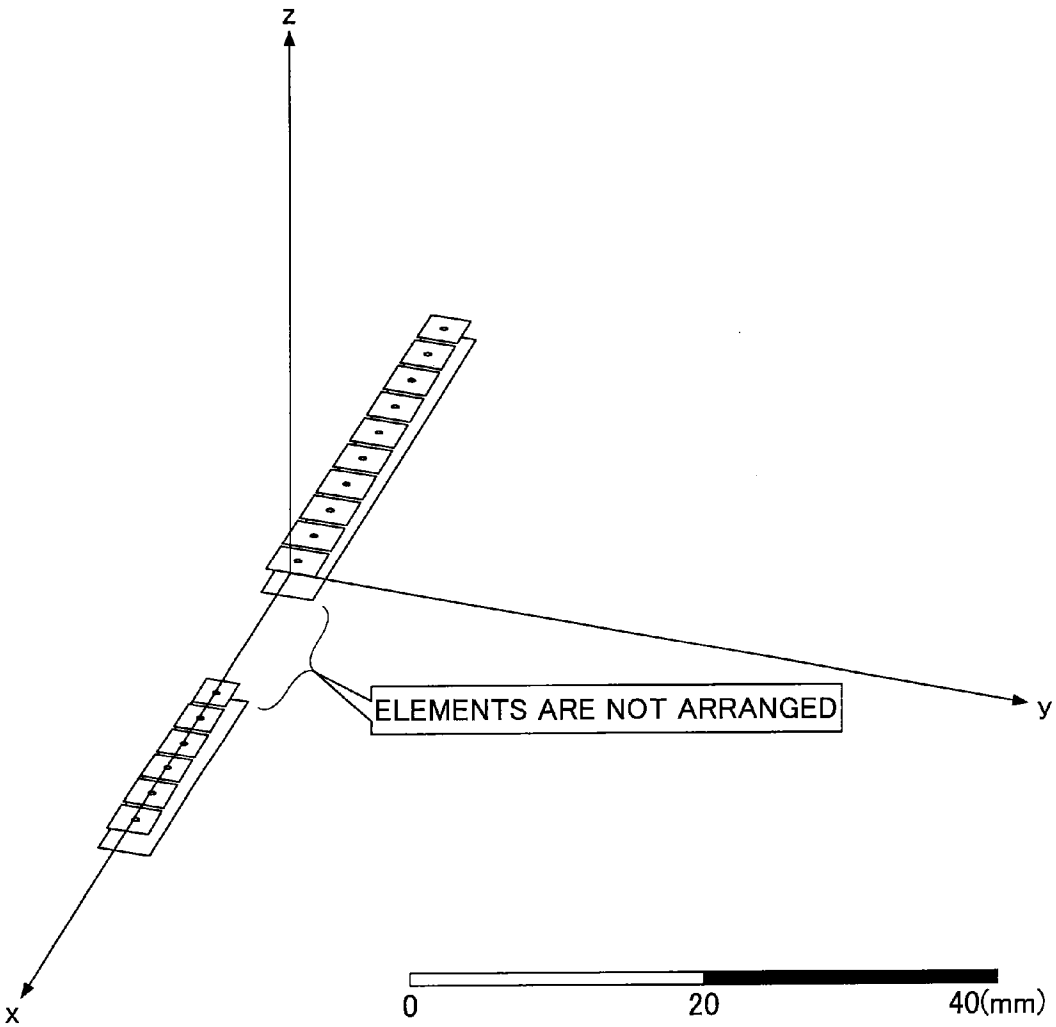
FIG. 33 is a diagram showing a portion of the reflectarray corresponding to one period for a case in which it is designed without using a spurious portion.
Figure 34:
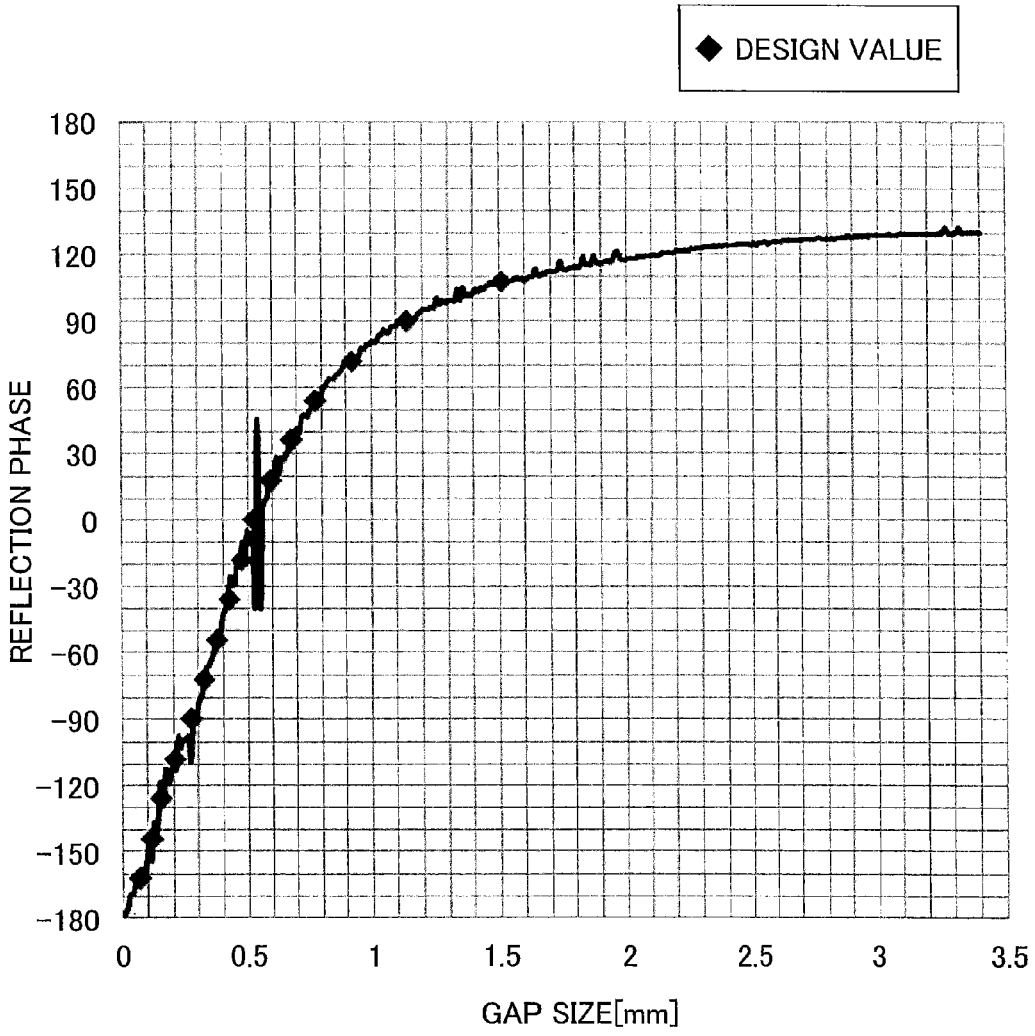
FIG. 34 is a diagram showing 16 combinations of the gap sizes and the reflection phases which are adopted for a simulation in the graph of the "theory" in FIG. 31.

Next, for design of the reflectarray, there is considered a difference between the case in which the spurious portion such as shown in FIG. 31 is utilized and the case in which it is not used. FIG. 33 shows a portion (for one period) of a reflectarray, which is designed without using the spurious portion in FIG. 33, namely, which is designed by using the graph of "theory" in FIG. 31. In the reflectarray, it is assumed that, in the y-axis direction, 40 pieces of such a portion are arranged, and in the x-axis direction, 2 pieces of such a portion are arranged. The reflectarray is assumed to have a length of 140 mm in the x-axis direction, and a length of 140 mm in the y-axis direction. In the x-axis direction, 16 pieces of elements are arranged, but no elements are arranged at the region in the middle corresponding to four pieces of elements. This region corresponds to a region in the graph of "theory," in which the reflection phase may not be achieved. FIG. 34 shows 16 pieces of combinations of the gap size and the reflection phase (the design values), which are adopted for the simulation in the graph of "theory" in FIG. 31. For this design example, the distance between the elements is 3.5 mm. The example of the numerical value is utilized, with which the dual resonance may not occur. For the depicted example, a reflection phase from 130 degrees to 180 degrees may not be achieved. FIG. 35 shows the correspondence relation between the gap size and the reflection phase for 16 pieces of elements. As depicted, the reflection phase varies from 0 degrees by once per 18 degrees. However, since four types of reflection phases may not be achieved in the graph of "theory," which are plus and minus 180 degrees, 162 degrees, 144 degrees, and 126 degrees, respectively, the columns are left blank for the corresponding gap sizes. This corresponds to the region of the reflectarray shown in FIG. 33, in which no elements are formed.

Figure 36:
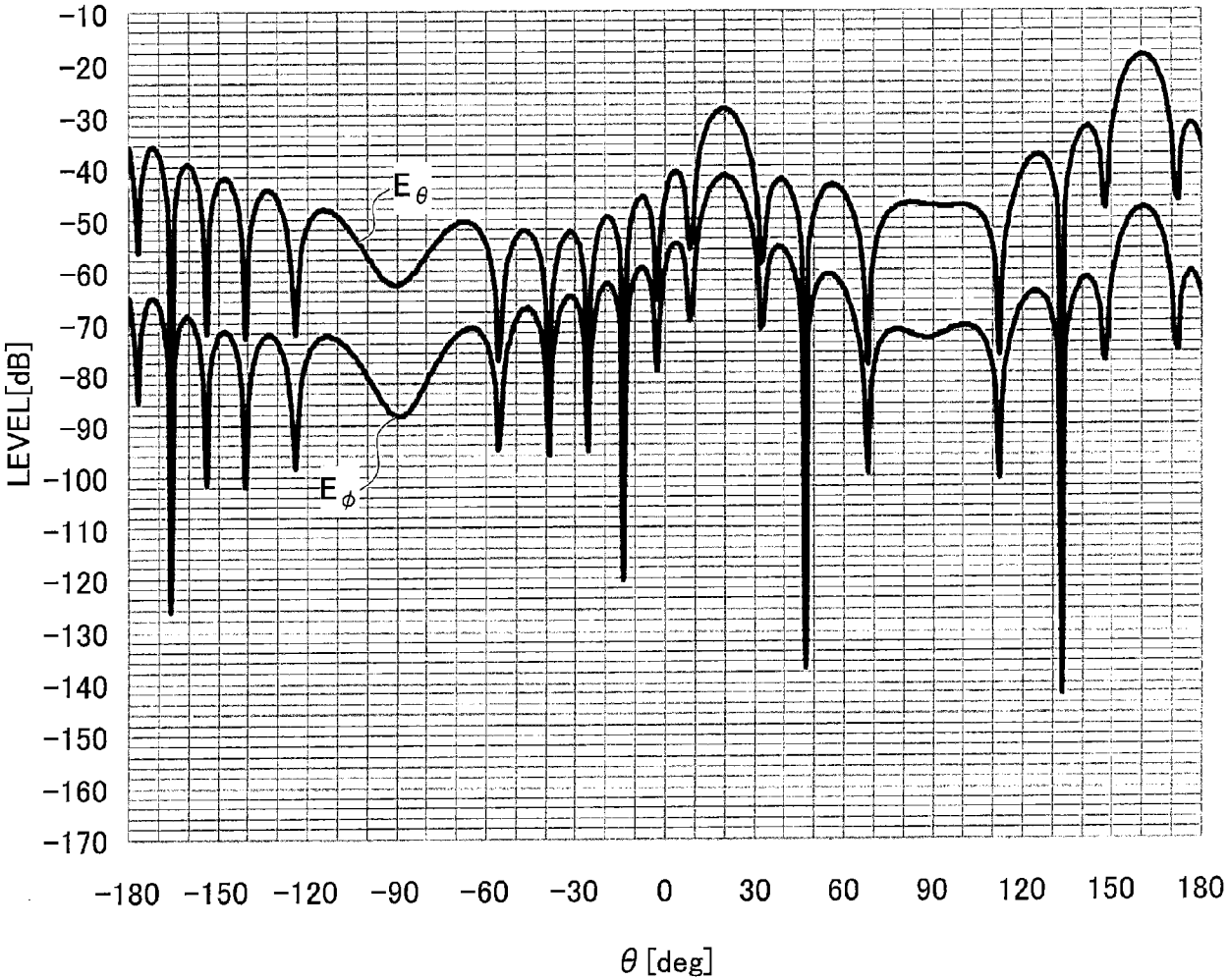
FIG. 36 is a diagram showing a result of a simulation in which a radio wave of 11 GHz enters the reflectarray and the radio wave is reflected in a vacuum ($\phi$=90 degrees)
Figure 37:
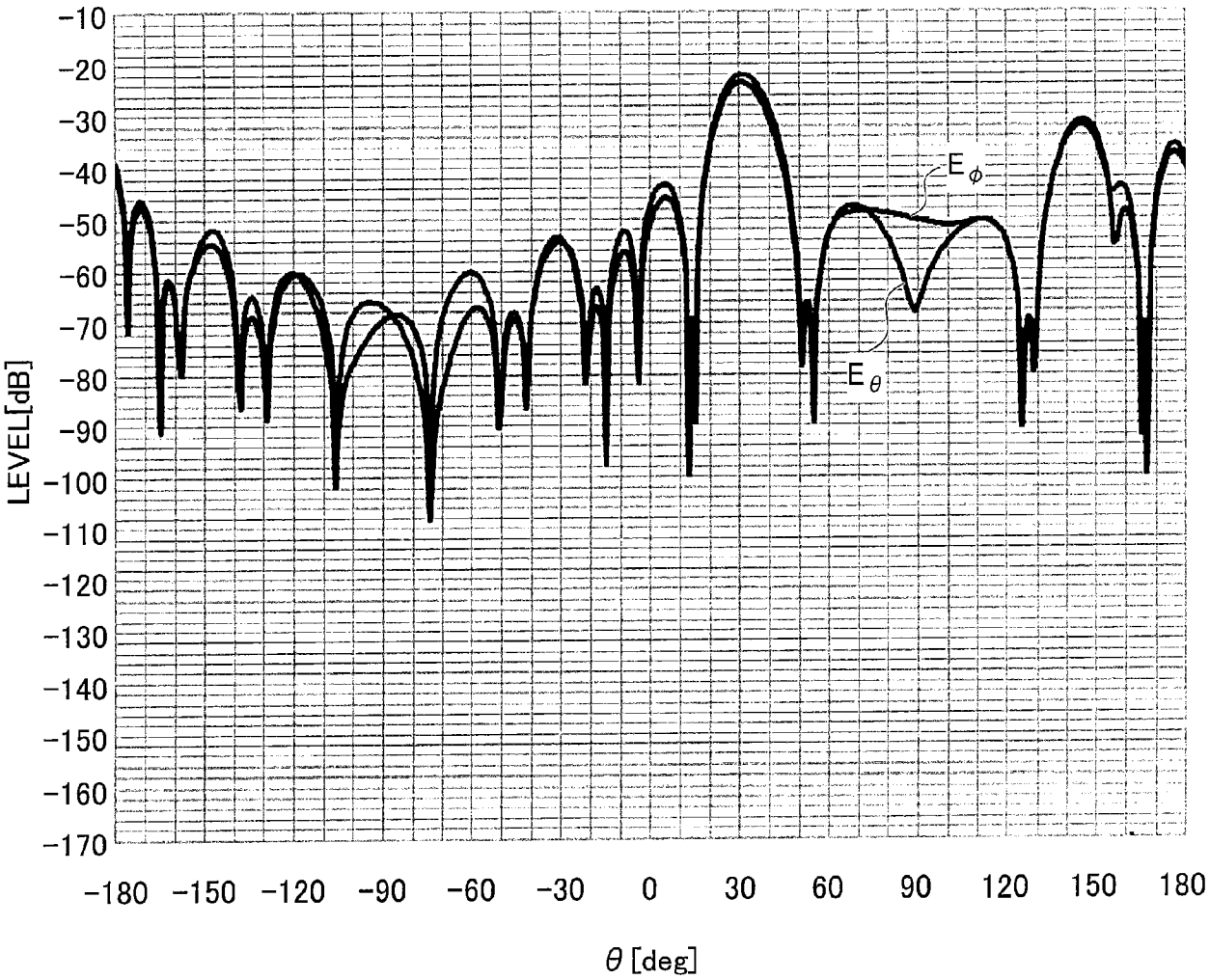
FIG. 37 is a diagram showing a result of a simulation in which a radio wave of 11 GHz enters the reflectarray and the radio wave is reflected in a vacuum ($\phi$=41 degrees (desired direction))

FIGS. 36 and 37 show a result of the simulation for a case in which a radio wave of 11 GHz enters such a reflectarray and it is reflected in a vacuum. The argument of the incident wave with respect to the z-axis is $\theta_i$=20 degrees, and the argument with respect to the x-axis is $\phi_i$=270 degrees. The argument of the reflected wave in the desired direction with respect to the z-axis is $\theta_r$=31 degrees, and the argument with respect to the x-axis is $\phi_r$=41 degrees. Namely, as explained in <2. Causing an incident wave to be reflected in any direction>, the reflectarray is designed, so that the reflected wave may not exist in a plane including the incident wave and the specular reflected wave. FIG. 36 shows an intensity level of the reflected wave in the yz plane ($\phi_r$=90 degrees) as a variable of the argument θ with respect to the z-axis. In the figure, the graph of $\in_\theta$ represents the θ directional component when an electric field vector of a reflected wave is represented in the (r, θ, ϕ) polar coordinates, and the graph of $E_\phi$ represents the ϕ directional component when the electric field vector of the reflected wave is represented in the (r, θ, ϕ) polar coordinates. Since the incident angle $\theta_i$=20 degrees, the peak at θ=20 degrees represents a component of specular reflection. FIG. 37 also shows an intensity level of the reflected wave together with the argument with respect to the z-axis. However, it is different in a point that it is the intensity level on the plane at ϕ=41 degrees. For the case of the current example, since the desired direction is $\theta_r$=31 degrees and $\phi_r$=41 degrees, it is a plane including the desired direction. As depicted, a peak occurs at θ=31 degrees. This shows that the level of the radio wave is strong in the desired direction.

Figure 38:
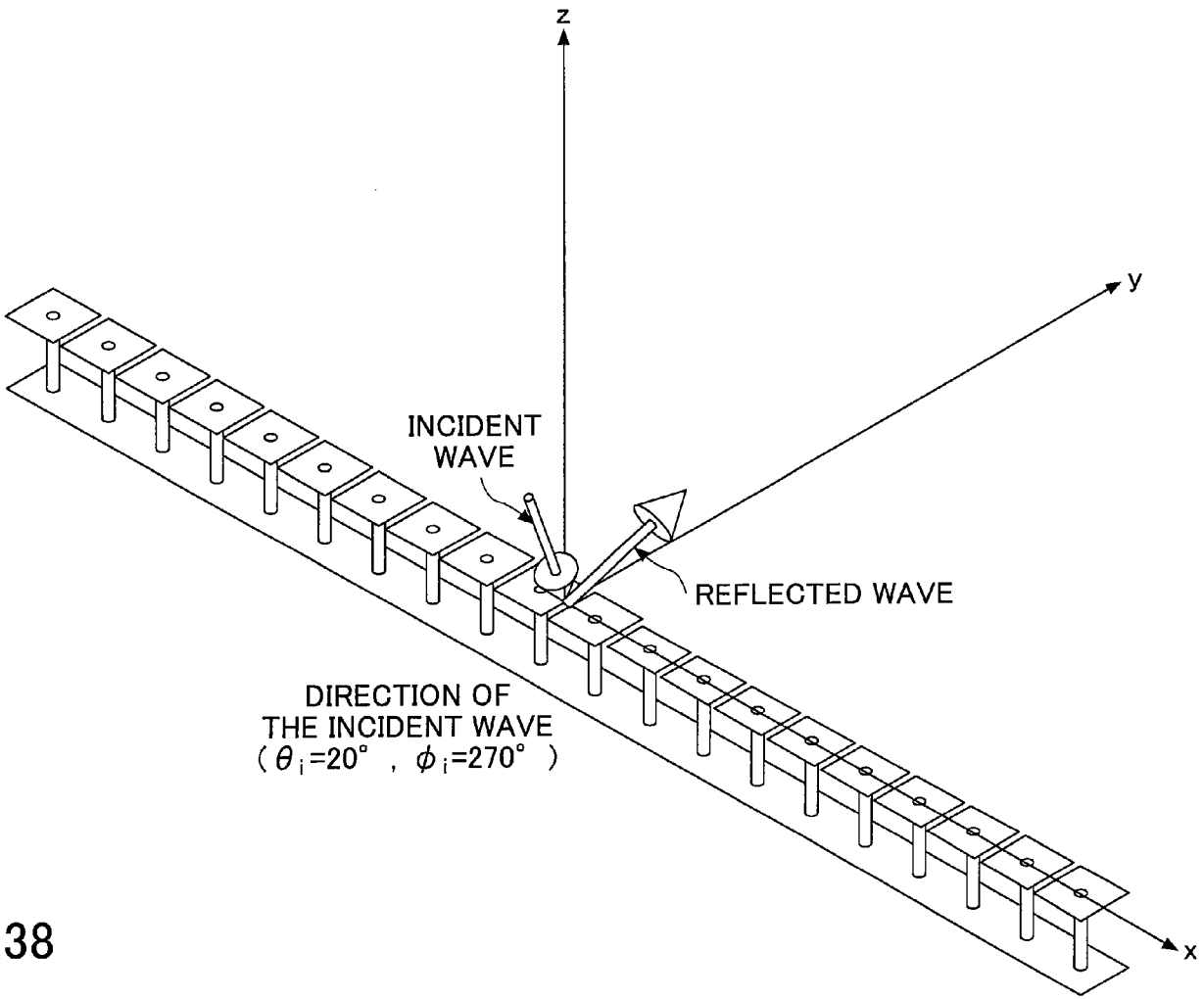
FIG. 38 shows a portion of the reflectarray corresponding to one period for a case in which it is designed by using the spurious portion.
Figure 39:
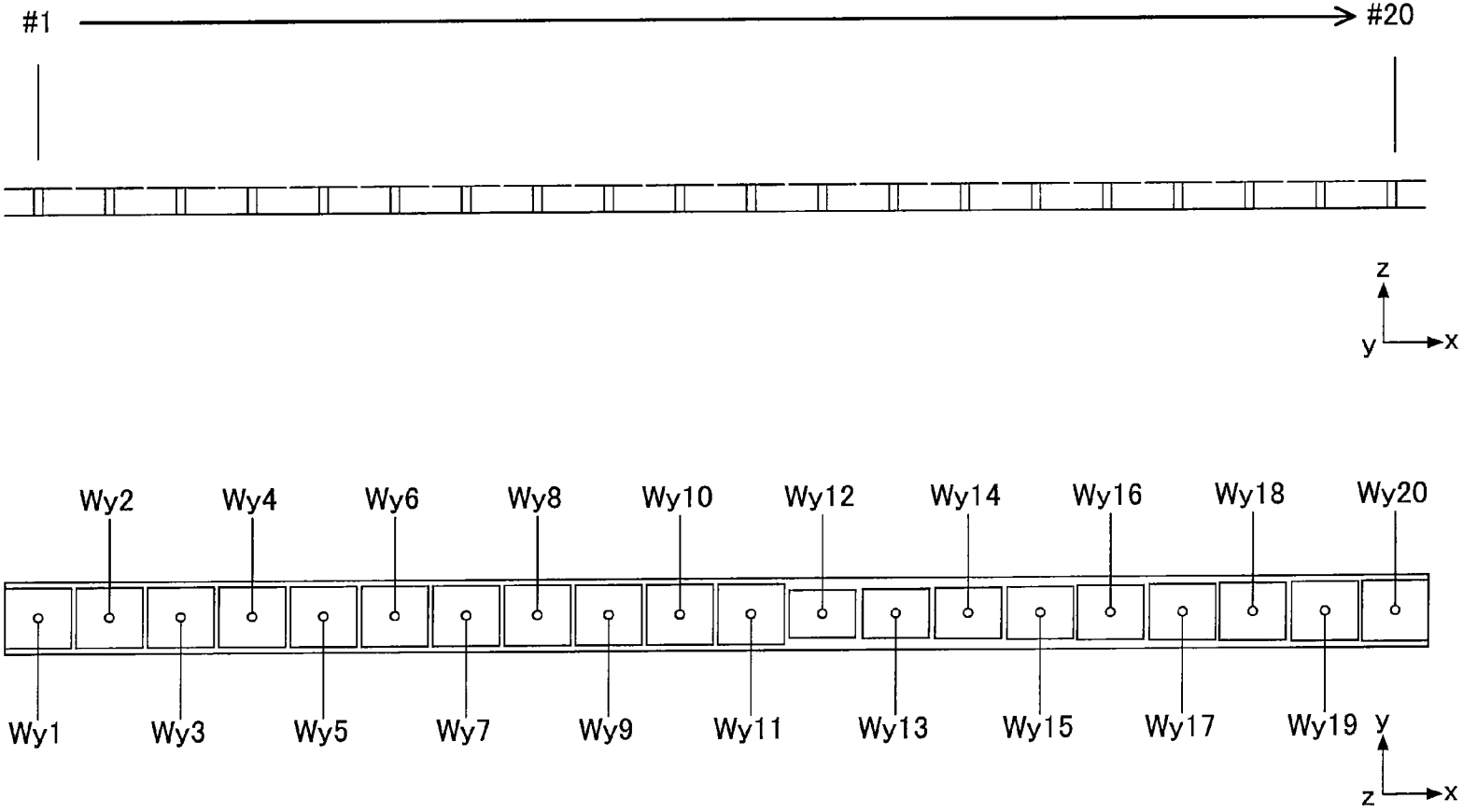
FIG. 39 is a diagram showing a side view (an upper side) and a plane view (a lower side) of one period of the reflectarray.
Figure 40:
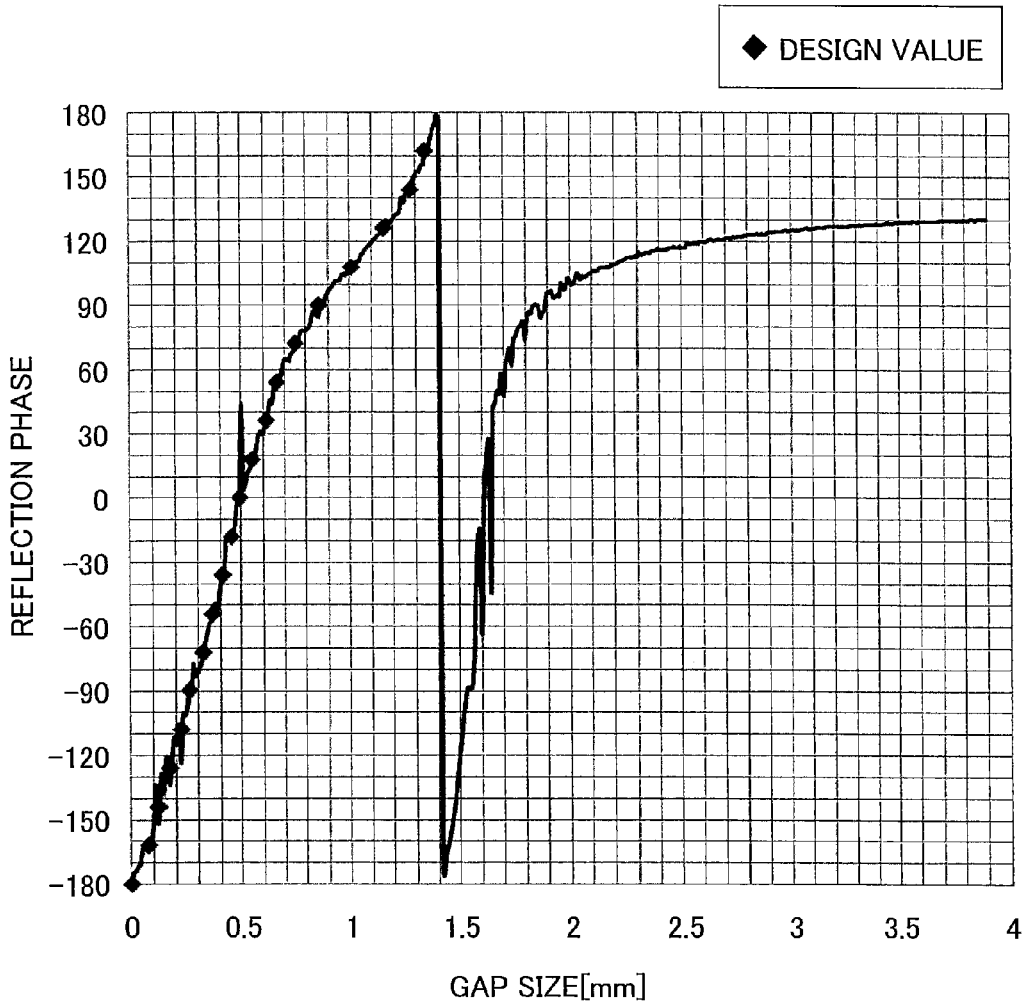
FIG. 40 is a diagram showing 20 combinations of the gap sizes and the reflection phases, which are adopted for a simulation in the graph of the "simulation" in FIG. 31.

FIG. 38 shows a portion of (one period of) a reflectarray for a case in which it is designed by using the spurious portion, namely, for a case it is designed based on a graph of "simulation" of FIG. 31. The reflectarray is assumed such that, in the y-axis direction, 40 pieces of such a portion are arranged, and in the x-axis direction, 2 pieces of such a portion are arranged. The reflectarray has a length of 140 mm in the x-axis direction, and a length of 140 mm in the y-axis direction. Unlike the structure which is shown in FIG. 33, in the x-axis, all 20 pieces of elements are arranged. There are no regions in which no elements are formed. FIG. 39 shows a side view (upper side) and a plane view (lower side) of the one sequence (for one period) of the reflectarray shown in FIG. 38. FIG. 40 shows 20 combinations (design values) of the gap size and the reflection phase, which are adopted for the simulation in accordance with the graph of "simulation" in FIG. 31. FIG. 41 shows a correspondence relation between the gap size and the reflection phase for 20 pieces of elements, in the form of a table. As depicted, the reflection phase varies from 0 degrees once per 18 degrees. All types of reflection phases are achieved, which include −162 degrees, and −180 degrees.

Figure 42:
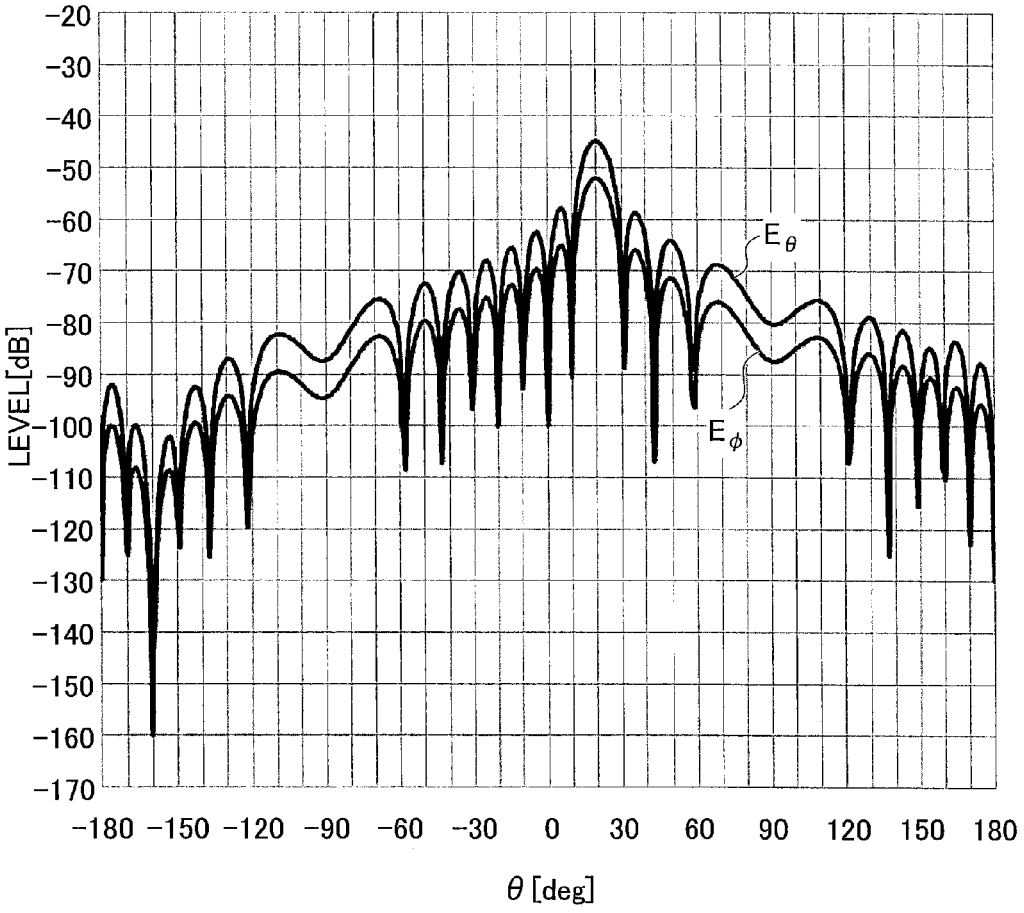
FIG. 42 is a diagram showing a result of a simulation for a case in which a radio wave of 11 GHz enters the reflectarray and the radio wave is reflected in a vacuum ($\phi$=90 degrees)
Figure 43:
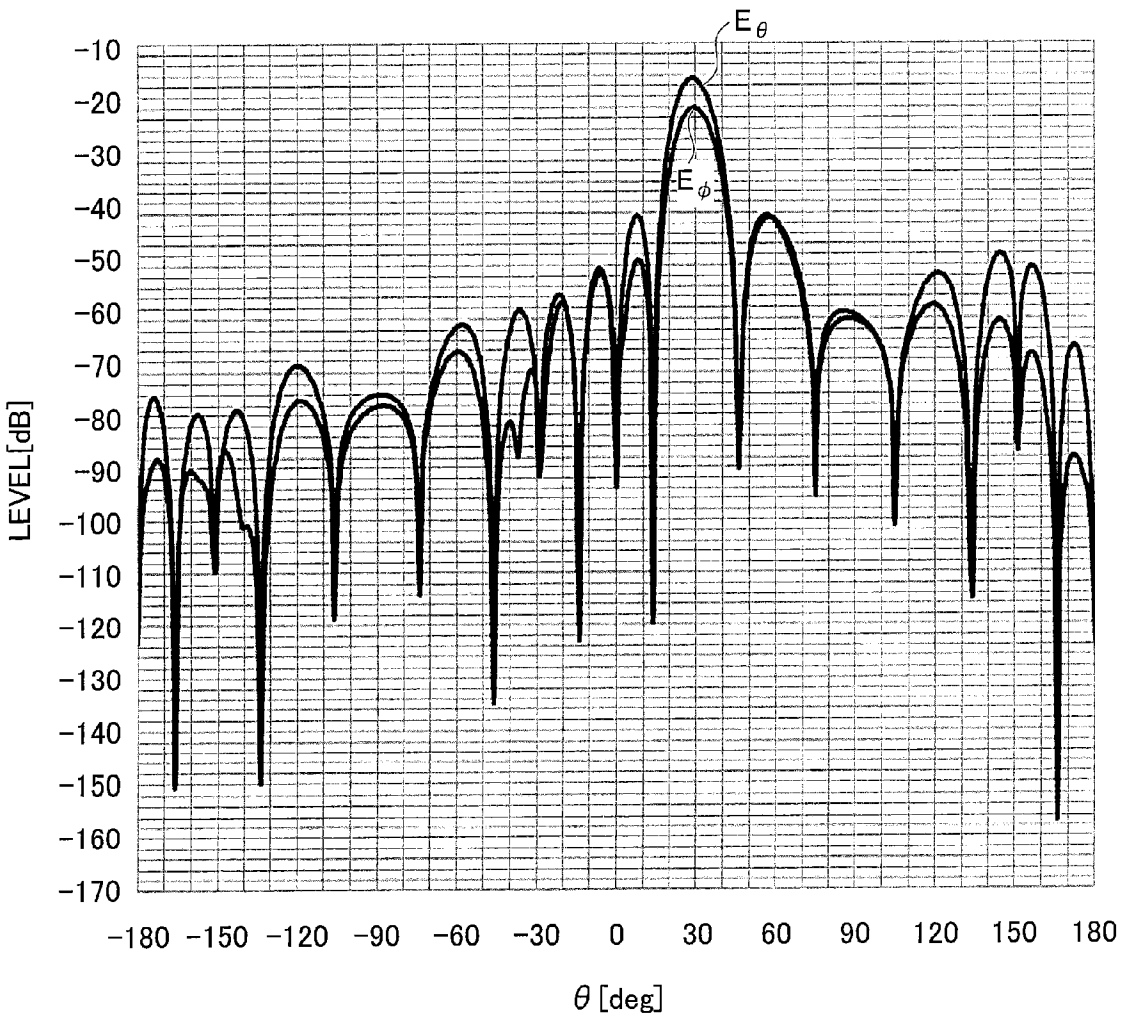
FIG. 43 is a diagram showing a result of a simulation for a case in which a radio wave of 11 GHz enters the reflectarray and the radio wave is reflected in a vacuum ($\phi$=45 degrees)

FIGS. 42 and 43 show a result of the simulation for the case in which a radio wave of 11 GHz enters such a reflectarray in a vacuum, and it is reflected. The argument of the incident wave with respect to the z-axis is $\theta_i$=20 degrees, and the argument with respect to x-axis $\phi_i$=270 degrees. The argument of the reflected wave in the desired direction with respect to the z-axis is $\theta_r$=29 degrees, and the argument with respect to the x-axis is $\phi_r$=45 degrees. Namely, as explained in <2. Causing the incident wave to reflect in any direction>, the reflectarray is designed so that the reflected wave may not exist on the plane including the incident wave and the specular reflected wave. FIG. 42 indicates an intensity level of the reflected wave on the yz plane ($\phi_r$=90 degrees) relative to the argument θ with respect to the z-axis. In the figure, the graph of $E_\theta$ indicates the θ directional component when an electric field vector of the reflected wave is expressed in the (r, θ, ϕ) polar coordinates, and the graph of $E_\phi$ indicates the ϕ directional component when an electric field vector of the reflected wave is expressed in the (r, θ, ϕ) polar coordinates. Since the incident angle is $\theta_i$=20 degrees, the peak at θ=20 degrees represents a component of the specular reflection. The unnecessary radio wave in the direction other than the specular reflection direction (a side lobe or a grating lobe) is regulated to be small. In this regard, it is different from the example shown in FIG. 36, in which such an unnecessary radio wave occurs with a high level. Similar to FIG. 42, FIG. 43 shows the intensity level of the reflected wave together with the argument with respect to the z-axis. However, it is different in a point that it is the intensity level on the plane of ϕ=45 degrees. For the current example, the desired direction is $\theta_r$=29 degrees and $\phi_r$=45 degrees. Thus, it is a plane including the desired direction. As depicted, a peak occurs at θ=29 degrees, which indicates that the level of the radio wave in the desired direction is strong. For the depicted example, an unnecessary radio wave (a side lobe or a grating lobe) in the direction other than the desired direction (θ=29 degrees) is regulated to be small. In this regard, it is different from the example shown in FIG. 37, in which such an undesired radio wave occurs with a high level. In this manner, according to the embodiment, by utilizing the spurious portion such as shown in FIG. 31, a reflectarray can be achieved which has a good reflection characteristic.

<5. Multi-Beam Reflectarray>

Next, there is considered a multi-beam reflectarray which reflects an incident wave in a plurality of desired directions. The multi-beam reflectarray according to the embodiment includes a plurality of elements arranged in a matrix form in the x-axis direction and in the y-axis direction. The multi-beam reflectarray reflects the incident wave in a first desired direction by a plurality of elements belonging to a first region. The multi-beam reflectarray reflects the incident wave in a second desired direction by a plurality of elements belonging to a second region. Each of the plurality of elements may be any element that can reflect a radio wave. Typically, each of the plurality of elements is an element having the mushroom-like structure. As a method of reflecting the incident wave in the desired direction, any one of the method explained in <2. Phase difference control> can be utilized. For example, both the first region and the second region can reflect the incident wave by <2.1 One-dimensional phase difference control>. In this case, both the first region and the second region may reflect the incident wave by the "method of causing the reflection phase to vary only in the x-axis direction (or in the y-axis direction)." Alternatively, the first region may reflect the incident wave by the "method of causing the reflection phase to vary only in the x-axis direction," and the second region may reflect the incident wave by the "method of causing the reflection phase to vary only in the y-axis direction." Alternatively, both the first and second regions may reflect the incident wave by <2.2 Two-dimensional phase difference control>. Alternatively, the first region may reflect the incident wave by <2.1 One-dimensional phase difference control>, and the second region may reflect the incident wave by <2.2 Two-dimensional phase difference control>.

Figure 51:
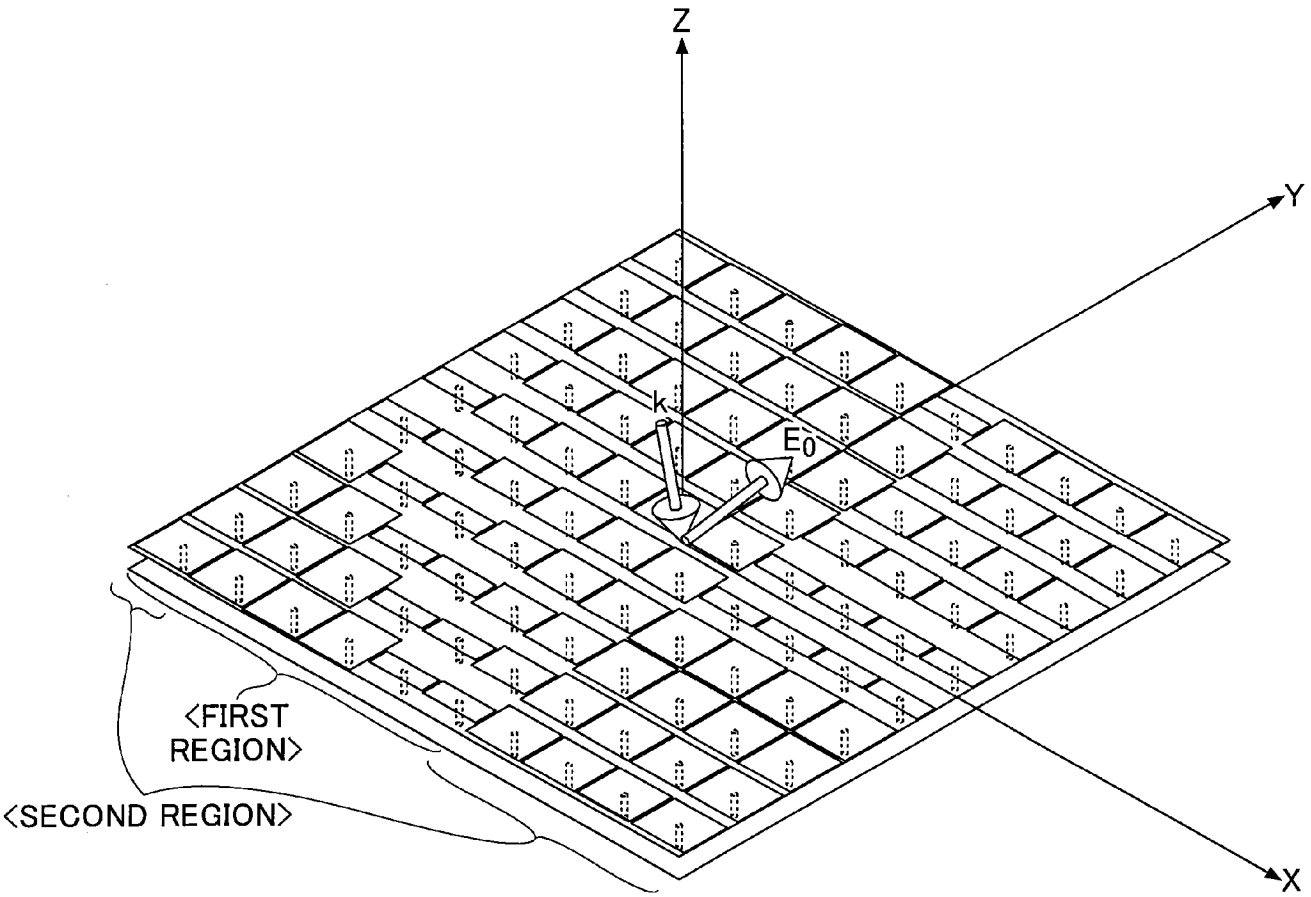
FIG. 51 is a diagram showing a unit structure included in a multi-beam reflectarray.

FIG. 51 shows a unit structure or a basic structure, which was utilized for the simulation of the multi-beam reflectarray. In the depicted unit structure, 10 pieces of elements are arranged in the x-axis direction, and 10 pieces of elements are arranged in the y-axis direction. The elements are arranged in a matrix form. Among the 10 sequences arranged in parallel with the y-axis, the elements of the 6 sequences in an ascending order in the x-coordinate (from the first sequence to the sixth sequence) belong to the first region. Among the 10 sequences arranged in parallel with the y-axis, the elements of the first sequence having the smallest x-coordinate and the elements of the seventh to tenth sequences belong to the second region. Accordingly, the elements of the first sequence are shared between the first region and the second region. For the simulation, it was assumed that many unit structures were arranged on the xy plane. Here, k indicates the direction of the incident wave, and E0 indicates the direction of the reflected wave. In the simulation, the following parameter values were utilized.

frequency of the incident wave=11 GHz direction of the incident wave ($\theta_i$, $\phi_i$)=(10 degrees, 270 degrees)

first desired direction ($\theta_{r1}$, $\phi_{r1}$)=(81 degrees, 52 degrees)

second desired direction ($\theta_{r2}$, $\phi_{r2}$)=(29 degrees, 45 degrees)

distance between the elements $\Delta x=\Delta y=4.5$ mm a ratio between the reflection phases of the elements adjacent in the x-axis direction and in the y-axis direction $\gamma$ ($=\Delta\alpha_x/\Delta\alpha_y$)=1 a number of dividing one period $\kappa=10$

FIG. 52 shows the reflection phases which are to be achieved by the corresponding elements included in the unit structure shown in FIG. 51. Among the 10 sequences arranged in parallel with the y-axis, the elements of the six sequences in the ascending order in the x-coordinate (from the first sequence to the sixth sequence) belong to the first region. Among the 10 sequences arranged in parallel with the y-axis, the elements of the first sequence having the smallest x-coordinate and the elements of the seventh to the tenth sequences belong to the second region. For the depicted example, the first region reflects the incident wave by <2.2 Two-dimensional phase difference control>. Accordingly, the reflection phase varies once per 36 degrees in both the x-axis direction and the y-axis direction. The second region reflects the incident wave by <2.1 One-dimensional phase difference control (method in which the reflection phase only depends on $\Delta y$)>. Accordingly, the reflection phase varies once per 36 degrees in the y-axis direction, but it does not vary in the x-axis direction.

FIG. 53 shows the gap sizes which can be used for achieving the reflection phases of the corresponding elements shown in FIG. 52. The gap size is the size of the distance between the patches of the neighboring elements. Each of the elements includes a ground plate, a patch, and a via which is disposed between them.

By repeatedly arranging the unit structure shown in FIGS. 51 and 52 in the x-axis direction and in the y-axis direction, a multi-beam reflectarray having a desired size can be obtained. FIG. 54 shows a situation in which two unit structures shown in FIGS. 51 and 52 are arranged in the x-axis direction and two unit structure shown in FIG. 52 are arranged in the y-axis direction. Actually, more than four unit structures may be arranged. In the depicted example, by focusing on the elements of the two sequences which are the boundary of the unit structures and which are neighboring to the boundary of the first region (the portion which is surrounded by a frame), it can be found that the reflection phases of the elements of the two sequences arranged along the y-axis direction (whose x-coordinates are 40.5 and 45, respectively) are equal to each other. In the depicted example, one sequence of the elements belonging to the first region also belongs to the second region, and these sequences of the elements achieve the corresponding same reflection phases. Accordingly, in the unit structure in which the elements are arranged in 10 rows and 10 columns, the elements corresponding to the six columns function as the first region to reflect the incident wave in the first desired direction, and the elements corresponding to the five columns function as the second region to reflect the incident wave in the second desired direction. By sharing one sequence of elements in the unit structure between the first region and the second region, the reflection in an unnecessary direction other than the first and second desired directions (the side lobe or the grating lobe) can be regulated, and thereby the reflection characteristic can be improved.

In the example explained by referring to FIGS. 51 to 54, one sequence of the elements in the unit structure is shared between the first and second regions. However, it is not required for the embodiment. One or more sequences of elements may be shared between the first and second regions. Additionally, it is not required that one or more sequences of elements shared between the first and second regions form a boundary of the unit structure (namely, the first region is formed by a plurality of contiguous sequences and the second region is formed by another plurality of contiguous sequences). The plurality of sequences forming the first and second regions may be contiguous, or discrete.

The effect of the multi-beam reflectarray according to the embodiment is explained. First, there is considered a multi-beam reflectarray according to related art, which reflects an incident wave in a first desired direction ($\alpha_1$) and a second desired direction ($\alpha_2$). Here, in the present application, the "related art" is not necessarily known art, and the invention preceding to the present invention may correspond to the "related art." For the case of this multi-beam reflectarray, a design period of an element array is determined by a common multiple of a first period of an element array for reflecting the incident wave in the first desired direction ($\alpha_1$) and a second period of an element array for reflecting the incident wave in the second desired direction ($\alpha_2$).

Figure 55:
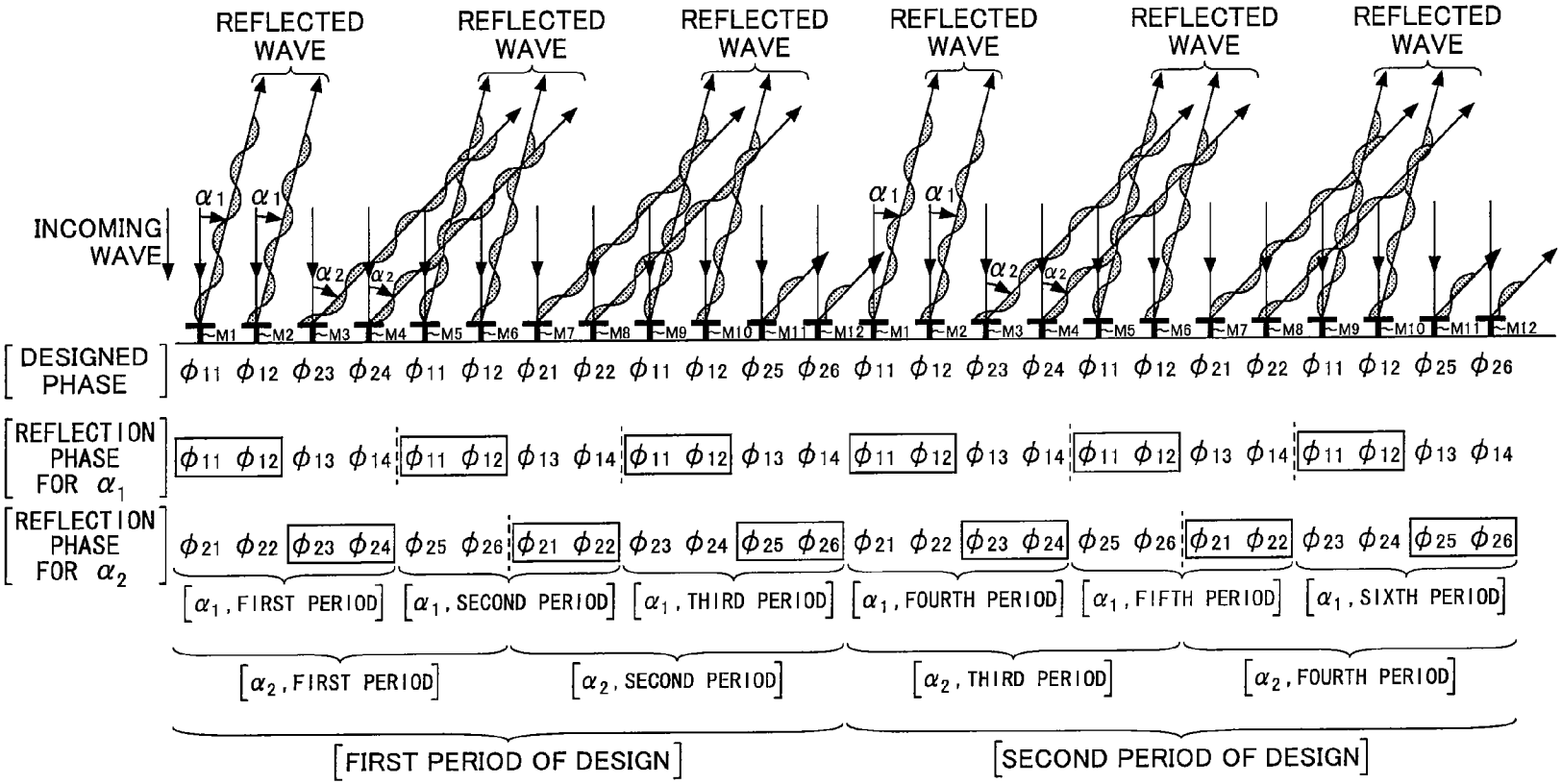
FIG. 55 is a diagram showing a multi-beam reflectarray according to related art.

FIG. 55 shows a multi-beam reflectarray according to such related art. The depicted multi-beam reflectarray includes two or more sets of 12 pieces (in general, which is N pieces) of elements from element M1 to M12, which are arranged in the y-axis direction. The structures which are the same as the 12 pieces of elements (in general, which is N pieces) are repeatedly or periodically arranged in the y-axis direction and in the x-axis direction. Each of the elements is a suitable element that can reflect a radio wave. For the depicted example, each of the elements has a mushroom-like structure. The radio wave arrives from the infinity direction of the z-axis, and the radio wave is reflected by each of the elements, and thereby the reflected wave is formed. When each of $n_k$ pieces of elements achieves a reflection phase, which is different from that of the neighboring element by $\Delta\phi=360/n_k$ degrees, the radio wave is reflected with a reflection angle of $\theta_r=\sin^{-1}[(\lambda\Delta\phi)/(2\pi\Delta y)]$. Here, k is a wave number, and it is equal to $2\pi/\lambda$. $\lambda$ is a wavelength of the radio wave. $\Delta y$ is a distance between the neighboring elements. For example, for reflection phases $\phi_{11}$, $\phi_{12}$, $\phi_{13}$, and $\phi_{14}$ of 4 pieces of elements, when the phase difference $\Delta\phi_1$ ($=|\phi_{1i}-\phi_{1i+1}|$) is equal to 360/4=90 degrees, the radio wave is reflected with a reflection angle of $\alpha_1=\sin^{-1}[(\lambda\Delta\phi_1)/(2\pi\Delta y)]$. Further, for reflection phases $\phi_{21}$, $\phi_{22}$, $\phi_{23}$, $\phi_{24}$, $\phi_{25}$, and $\phi_{26}$ of 6 pieces of elements, when the phase difference $\Delta\phi_2(=|\phi_{2i}-\phi_{2+1}|)$ is equal to 360/6=60 degrees, the radio wave is reflected with a reflection angle of $\alpha_2=\sin^{-1}[(\lambda\Delta\phi_2)/(2\pi\Delta y)]$.

In FIG. 55, as indicated as the "design phase," the reflection phases by the elements M1 and M2 are set to be the values $\phi_{11}$ and $\phi_{12}$ with respect to the first reflection angle $\alpha_1$, the reflection phases by the elements M3 and M4 are set to be the values $\phi_{23}$ and $\phi_{23}$ with respect to the first reflection angle $\alpha_2$, the reflection phases by the elements M5 and M6 are set to be the values $\phi_{11}$ and $\phi_{12}$ with respect to the first reflection angle $\alpha_1$, the reflection phases by the elements M7 and M8 are set to be the values $\phi_{21}$ and $\phi_{22}$ with respect to the first reflection angle $\alpha_2$, the reflection phases by the elements M9 and M10 are set to be the values $\phi_{11}$ and $\phi_{12}$ with respect to the first reflection angle $\alpha_1$, and the reflection phases by the elements M11 and M12 are set to be the values $\phi_{25}$ and $\phi_{26}$ with respect to the first reflection angle $\alpha_2$. For the depicted example, the element array including the 12 pieces of elements includes a first element group for reflecting the radio wave in the direction the first reflection angle $\alpha_1$, and a second element group for reflecting the radio wave in the direction of the second reflection angle $\alpha_2$. Accordingly, when a radio wave enters such an element array, one portion is reflected in the direction of the first reflection angle $\alpha_1$ by the first element group, and one portion is reflected in the direction of the second reflection angle $\alpha_2$ by the second element group. In this manner, a multi-beam reflect array can be achieved which reflects the incident wave in the directions of $\alpha_1$ and $\alpha_2$, respectively.

In this manner, for the case of the multi-beam reflectarray according to the related art, the period of the structure which causes the reflection in the first desired direction ($\alpha_1$) (the number of the elements in the first element group=4) is different from the period of the structure which causes the reflection in the second desired direction ($\alpha_2$) (the number of the elements in the second element group=6). Accordingly, it may be required to form the one period of the design by the common multiples of them. For the depicted example, one period of the design has a length of 12 elements. FIG. 55 shows 24 elements, which corresponds to 2 periods of the design.

For the depicted example, in the first period ($\alpha_2$, the first period) with respect to the second desired direction ($\alpha_2$), the reflection phases having the values of $\phi_{23}$ and $\phi_{24}$ are achieved by the elements M3 and M4. The reflection phases whose values are the same as those of the reflection phases occur in the second period of the design in the fourth period ($\alpha_2$, the fourth period) with respect to the second desired direction ($\alpha_2$). In the control with respect to the second desired direction ($\alpha_2$), in addition to the proper radiation direction which occurs when the reflection phase is in phase for the distance of the 6 elements, a beam may occur in the radiation direction which occurs when the reflection phase is in phase for the distance of the 18 elements.

Figure 56:
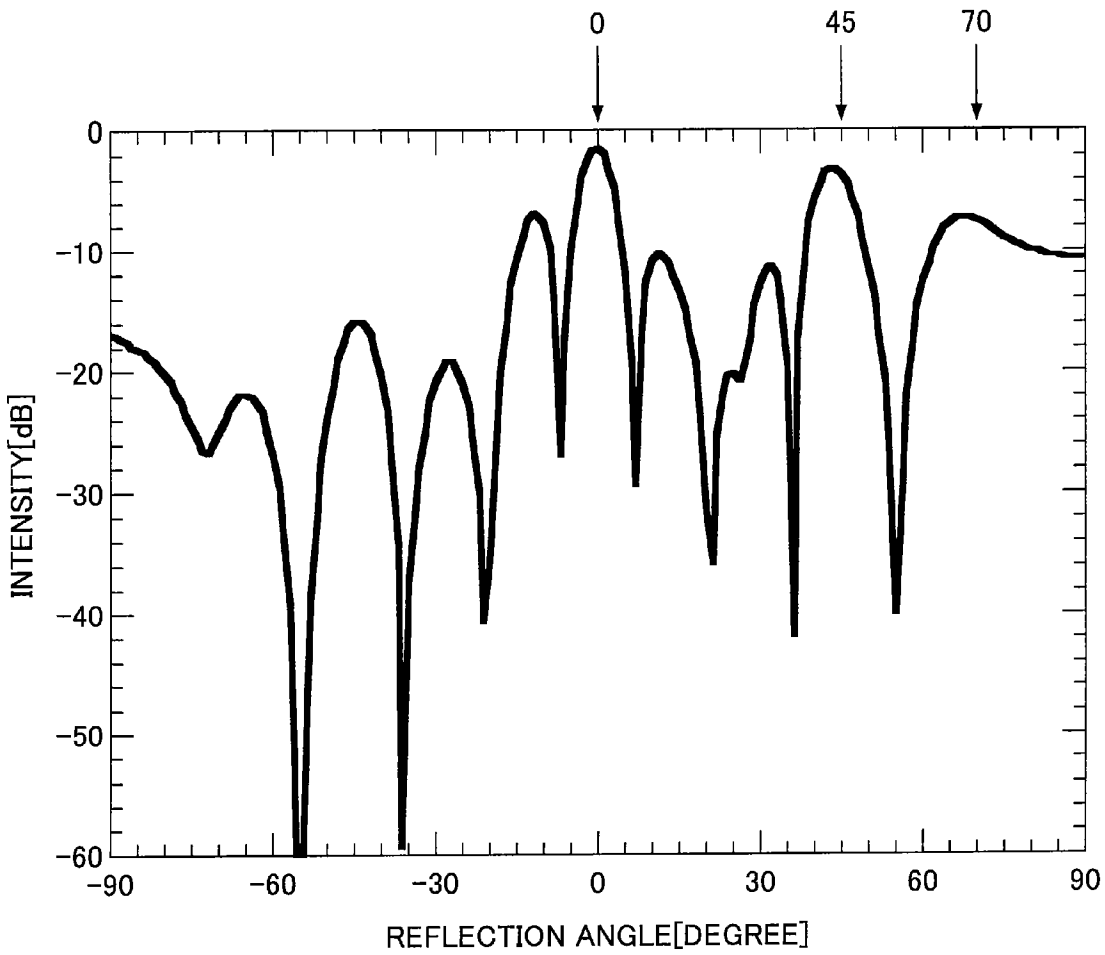
FIG. 56 is a diagram showing a far radiation field of the reflected wave.

Since the phase may be aligned for the period other than the desired period, in addition to the desired direction ($\alpha_1$=45 degrees, $\alpha_2$=70 degrees), unnecessary lobes occur in a specular reflection direction (0 degrees), and in another direction. FIG. 56 shows a far radiation field. It shows the intensity of the reflected wave along with the reflection angle. In the simulation, the first reflection angle was assumed to be $\alpha_1$=70 degrees, and the second reflection angle was assumed to be $\alpha_2$=45 degrees. A strong beam also occurs in the direction of 0 degrees. However, this shows the effect of the specular reflection caused by the ground plate, etc.

Among the control angle A, the distance between the elements Δy, and the phase difference $\Delta\phi_A$, the following formula holds.

$$\Delta y=\Delta\phi_A\cdot\lambda/(2\pi\cdot\sin(A))$$

For the case in which the phase is aligned for the period other than the desired period, for example, the reflection phase is to be in phase when the distance between the elements is Δy. However, a phenomenon occurs such that the reflection phase is in phase for the first time when the distance between the elements is 3Δy. In this case, an unnecessary lobe may occur in the direction of $\sin(\Delta\phi_A\cdot\lambda/(2\pi\cdot 3\lambda))$. Specifically, even if a design is made for A=70 degrees, a side lobe may occur in the direction of 28 degrees.

Contrary to this, for the case of the multi-beam reflectarray according to the embodiment, not only for the element group in the first desired direction ($\alpha_1$), but also for the element group of the second desired direction ($\alpha_2$), the phase differences in the y-axis direction are the same −36 degrees, and one period is formed by 10 elements. Accordingly, by forming a multi-beam reflectarray by using the periodic array, a desired in-phase relation may be formed for all the elements. Namely, the multi-beam reflectarray can be formed, so that the same phase occurs for every desired one period=the distance of 10 elements. Further, for the case of the multi-beam reflectarray according to the embodiment, a predetermined element sequence is shared between the structure for the first desired direction ($\alpha_1$) and the structure for the second desired direction ($\alpha_2$).

Figure 57:
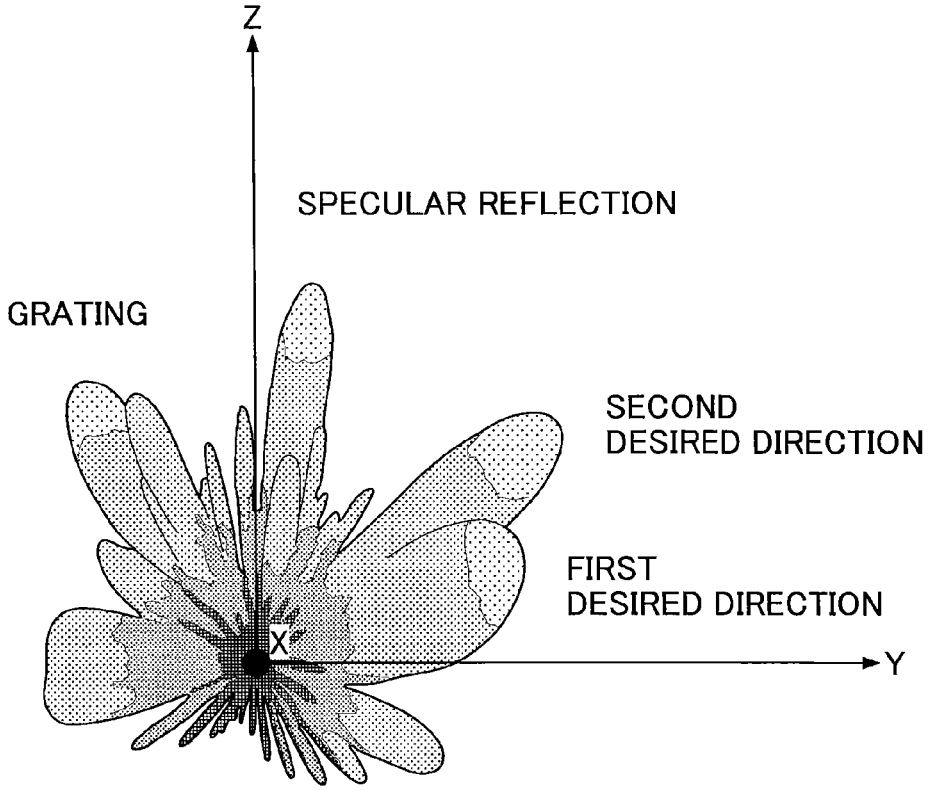
FIG. 57 is a diagram showing the reflected waves by the multi-beam reflectarray.
Figure 58:
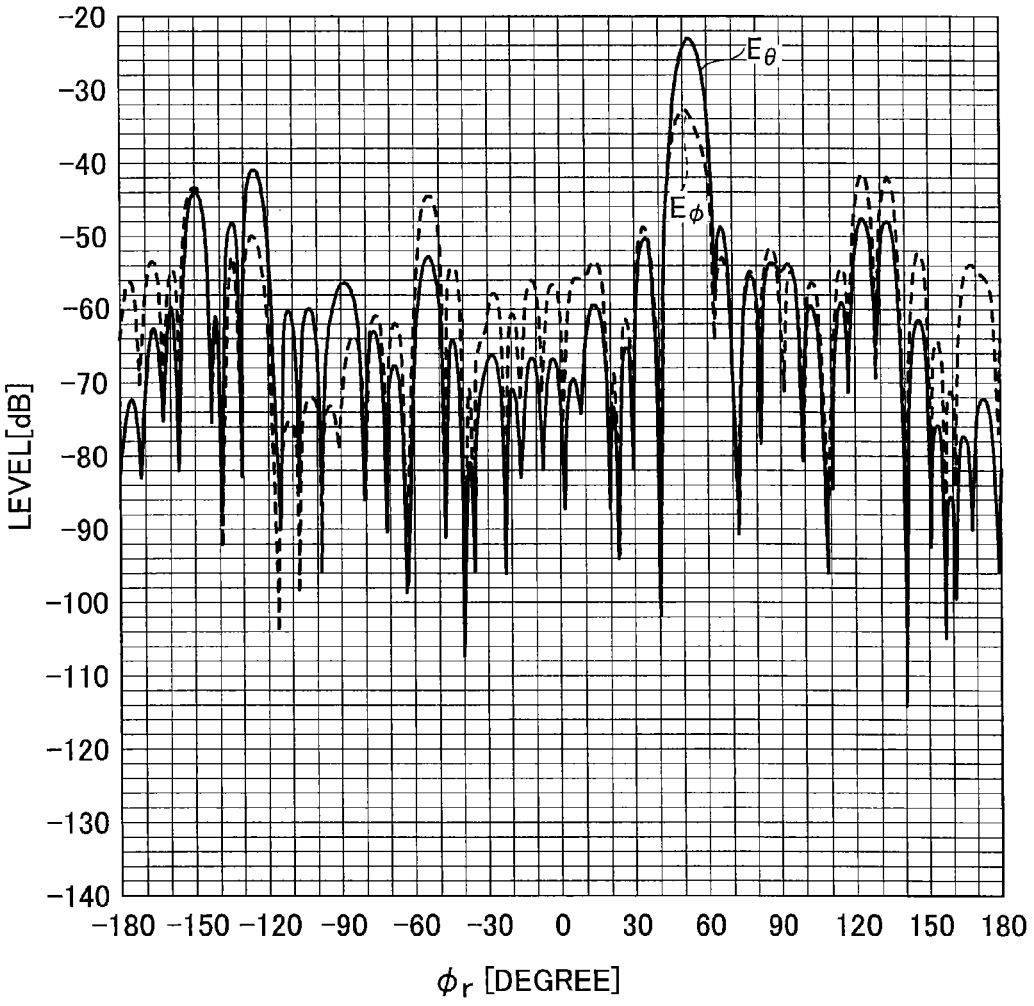
FIG. 58 is a diagram showing a level of the reflected wave.

FIG. 57 shows a reflected wave by the multi-beam reflectarray according to the embodiment. As depicted, the reflected waves are strongly formed in the first and second desired directions.

As described above, in the method according to the related art, since the design frequency is set to be the common multiple of the periods of the corresponding beams, the synchronization can be achieved only at the design period. Thus, the synchronization may only be achieved for the first time at the distance between the elements (e.g., n times Δy) which is different from the designed value (e.g., Δy). Consequently, a side lobe may occur in the undesired direction. Contrary to this, according to the present invention, the design parameter may not be a common multiple of the periods. Namely, the multi-beams can be achieved by its original period. Accordingly, a side lobe in the undesired direction may be reduced.

By the above-described embodiment, the following items are disclosed.

(1.1) A reflectarray including a plurality of elements arranged in a first axial direction and in a second axial direction, the second axial direction being perpendicular to the first axial direction, wherein the reflectarray reflects an incident wave in a desired direction, the desired direction not included in a plane including the incident wave and a specular reflection wave, wherein a phase of a reflected wave by one element among the plurality of elements differs from a phase of the reflected wave by an element adjacent to the one element in the first axial direction by a predetermined value, and the phase of the reflected wave by the one element among the plurality of elements is equal to a phase of the reflected wave by an element adjacent to the one element in the second axial direction.

(1.2) In the above-described reflectarray, an absolute value of a second axial directional component of an incident unit vector along a traveling direction of the incident wave may be equal to an absolute value of the second axial directional component of a reflection unit vector along a traveling direction of the reflected wave.

(1.3) In the above-described reflectarray, each of the plurality of elements may include, at least, a ground plate and a patch, and a gap between the patches of the elements may gradually vary in the first axial direction.

(1.4) In the above-described reflectarray, each of the plurality of elements may be formed by a mushroom-like structure.

(2.1) A method of designing a reflectarray that reflects an incident wave in a desired direction, the method includes a step of obtaining, when a radio wave having a predetermined frequency enters a structure in which a plurality of elements is arranged while evenly spaced apart by a predetermined element distance, a reflection phase of an element as a function of a gap size between patches of the neighboring elements, and storing a correspondence relation between the reflection phase and the gap size in a memory; and a step of executing, for each of the plurality of elements included in the reflectarray, a determination of the gap size of a specific element in accordance with the correspondence relation, so that the specific element among the plurality of elements included in the reflectarray reflects the radio wave with a specific reflection phase, wherein the correspondence relation between the reflection phase and the gap size indicates that there are reflection phases having the same value for two gap sizes, which are prior to and subsequent to a predetermined gap size, respectively, wherein, when the radio wave enters the structure in which the element distances and the gap sizes between the corresponding neighboring elements are constant, and when the reflection phase of a reflected wave is expressed as a function of a frequency, there are the reflection phases having the same value for two frequencies, which are prior to and subsequent to the predetermined frequency, respectively, and wherein, when the radio wave having the predetermined frequency enters the structure in which the gap sizes between the patches of the corresponding neighboring elements are constant, and the radio wave is reflected, and when the reflection phase of the reflected wave is expressed as a function of an element distance, there are reflection phases having the same value for two element distances, which are prior to and subsequent to the predetermined element distance.

(2.2) A reflectarray that reflects an incident wave in a desired direction, the reflectarray including a plurality of elements arranged in a first axial direction and in a second axial direction, wherein the first axial direction is perpendicular to the second axial direction, and the plurality of elements reflects the incident wave, wherein a phase of a reflected wave by one element among the plurality of elements differs from a phase of the reflected wave by an element adjacent to the one element in the first axial direction by a predetermined value, and the phase of the reflected wave by the one element among the plurality of elements is equal to a phase of the reflected wave by an element adjacent to the one element in the second axial direction, and wherein gap sizes between patches of a predetermined plural number of elements arranged in the first axial direction gradually vary from a minimum value to a maximum value, and the phases of the reflected wave by the predetermined plural number of elements vary in a range of 360 degrees by the predetermined value per once.

(2.3) In the above-described reflectarray, each of the plurality of elements may be formed by a mushroom-like structure.

(3.1) A multi-beam reflectarray including a plurality of elements arranged in a matrix formed in a first axial direction and in a second axial direction, wherein the multi-beam reflectarray reflects an incident wave in a first desired direction by a plurality of elements belonging to a first region, and the multi-beam reflectarray reflects the incident wave in a second desired direction by a plurality of elements belonging to a second region, wherein, in at least one of the first region and the second region, a phase of a reflected wave by one element differs from a phase of the reflected wave by an element adjacent to the one element in the first axial direction by a predetermined value, and the phase of the reflected wave by the one element is equal to a phase of the reflected wave by an element adjacent to the one element in the second axial direction.

(3.2) A multi-beam reflectarray including a plurality of elements arranged in a matrix formed in a first axial direction and in a second axial direction, wherein the multi-beam reflectarray reflects an incident wave in a first desired direction by a plurality of elements belonging to a first region, and the multi-beam reflectarray reflects the incident wave in a second desired direction by a plurality of elements belonging to a second region, wherein, in at least one of the first region and the second region, a ratio between a phase difference of reflected waves by corresponding elements neighboring in the first axial direction ($\Delta\alpha_1$) and a phase difference of the reflected waves by corresponding elements neighboring in the second axial direction ($\Delta\alpha_2$) is a predetermined value, and the $\Delta\alpha_1$ and the $\Delta\alpha_2$ are divisors of an integral multiple of 360 degrees ($2\pi$ radians).

(3.3) A multi-beam reflectarray including a plurality of elements arranged in a matrix formed in a first axial direction and in a second axial direction, wherein the multi-beam reflectarray reflects an incident wave in a first desired direction by a plurality of elements belonging to a first region, and the multi-beam reflectarray reflects the incident wave in a second desired direction by a plurality of elements belonging to a second region, wherein, in a first region, a phase of a reflected wave by one element differs from a phase of the reflected wave by an element adjacent to the first axial direction by a predetermined value, and the phase of the reflected wave by the one element is equal to a phase of the reflected wave by an element adjacent to the one element in the second axial direction, and wherein, in the second region, a ratio between a phase difference of the reflected waves by elements neighboring in the first axial direction ($\Delta\alpha_1$) and a phase difference of the reflected waves by elements neighboring in the second axial direction ($\Delta\alpha_2$) is another predetermined value, and $\Delta\alpha_1$ and $\Delta\alpha_2$ are divisors of an integral multiple of 360 degrees ($2\pi$ radians).

(3.4) In the above-described multi-beam reflectarray, an element belonging to predetermined one or more sequences among the plurality of elements arranged in the matrix form may belong to both the first region and the second region.

(3.5) In the above-described multi-beam reflectarray, each of the plurality of elements may include, at least, a ground plate and a patch, and gaps between the patches of the corresponding elements may gradually vary in the first axial direction.

(3.6) In the above-described multi-beam reflectarray, each of the plurality of elements may be formed by a mushroom-like structure.

(3.7) In the above-described multi-beam reflectarray, a structure corresponding to one period in the first axial direction of the multi-beam reflectarray may be formed by a predetermined number of elements arranged in the first axial direction with the phase difference of the reflected waves by the elements neighboring in the first axial direction ($\Delta\alpha_1$), and a structure corresponding to one period in the second axial direction of the multi-beam reflectarray may be formed by a predetermined number of elements arranged in the second axial direction with the phase difference of the reflected waves by the elements neighboring in the second axial direction ($\Delta\alpha_2$).

(4.1) A reflectarray that reflects an incident wave in a desired direction, wherein the reflectarray includes a plurality of elements arranged in an x-axis direction and in a y-axis direction, and the plurality of elements reflects the incident wave, wherein, a ratio between a phase difference of reflected waves by corresponding elements neighboring in the x-axis direction ($\Delta\alpha_x$) among the plurality of elements and a phase difference of the reflected waves by corresponding elements neighboring in the y-axis direction ($\Delta\alpha_y$) among the plurality of elements is a predetermined value, and $\Delta\alpha_x$ and $\Delta\alpha_y$ are divisors of an integral multiple of 360 degrees ($2\pi$ radians).

(4.2) In the above-described reflectarray, each of the plurality of elements may include, at least, a ground plate and a patch, and gaps between the patches of the corresponding elements may gradually vary in the x-axis direction.

(4.3) In the above-described reflectarray, each of the plurality of elements may be formed by a mushroom-like structure.

(4.4) In the above-described reflectarray, $\Delta\alpha_x$ may be equal to $k_0\Delta x(\sin\theta_i\cos\phi_i-\sin\theta_r\cos\phi_r)$, and $\Delta\alpha_y$ may be equal to $k_0\Delta y(\sin\theta_i\sin\phi_i-\sin\theta_r\sin\phi_r)$, wherein $k_0$ may be a wave number of the radio wave, $\Delta x$ may be a distance between the neighboring elements in the x-axis direction, $\Delta y$ may be a distance between the neighboring elements in the y-axis direction, $\theta_i$ may be an argument of the incident wave with respect to a z-axis, $\phi_i$ may be an argument of the incident wave with respect to the x-axis, $\theta_r$ may be an argument of the reflected wave with respect to the z-axis, and $\phi_r$ may be an argument of the reflected wave with respect to the x-axis.

(4.5) In the above-described reflectarray, $\sin\theta_r$ may be $2\pi/(k_0\Delta x\kappa\cos\phi_r)$, and $\tan\phi_r$ may be $1/\gamma+(k_0\Delta x\kappa\sin\theta_i)/(2\pi)$, wherein the $\kappa$ may be a divisor of 360, and the $\gamma$ may be the predetermined number of the ratio.

Hereinabove, the reflectarray is explained by the embodiment. However, the present invention is not limited to the above-described embodiment, and various modifications and improvements may be made within the scope of the present invention. For example, the present invention may be applied to any suitable reflectarray that reflects an incident wave in any direction. Specific examples of numerical values are used in order to facilitate understanding of the invention. However, these numerical values are simply illustrative, and any other appropriate values may be used, except as indicated otherwise. Specific examples of the formulae are used in order to facilitate understanding of the invention. However, these formulae are simply illustrative, and any other appropriate formulae that derive the similar result may be used, except as indicated otherwise. The separations of the items are not essential to the present invention. Depending on necessity, subject matter described in two or more items may be combined and used, and subject matter described in an item may be applied to subject matter described in another item (provided that they do not contradict). A boundary of a functional unit or a processing unit in the functional block diagram may not necessarily correspond to a boundary of a physical component. An operation by a plurality of functional units may be physically executed by a single component, or an operation of a single functional unit may be physically executed by a plurality of components. The present invention is not limited to the above described embodiment, and various variations, modifications, alterations, and substitutions and so on are included in the present invention, without departing from the spirit of the present invention.

The present international application is based on and claims the benefit of priority of Japanese Patent Application No. 2012-170319, filed on Jul. 31, 2012, Japanese Patent Application No. 2012-170320, filed on Jul. 31, 2012, Japanese Patent Application No. 2012-186988, filed on Aug. 27, 2012, and Japanese Patent Application No. 2012-186989, filed on Aug. 27, 2012, the entire contents of Japanese Patent Application No. 2012-170319, Japanese Patent Application No. 2012-170320, Japanese Patent Application No. 2012-186988, and Japanese Patent Application No. 2012-186989 are hereby incorporated by reference.

The invention claimed is:

1. A reflectarray comprising:

a plurality of elements arranged in a first axial direction and in a second axial direction that is perpendicular to the first axial direction, wherein the plurality of elements reflect an incident wave, and the reflectarray reflects the incident wave in a desired direction that is not included in a plane including the incident wave and a specular reflected wave, each of the plurality of elements is formed of a mushroom-like structure that includes at least a rectangular patch that is separated from a ground plate by a predetermined distance, the rectangular patch having a single layer structure, the ground plate having a single layer structure, the rectangular patch including a first edge along the first axial direction, and a second edge along the second axial direction, at least one of (i) a gap between the rectangular patches of the plurality of elements, (ii) a size of the rectangular patch, and a (iii) a distance between the elements, is set, the first edges of the plurality of rectangular patches arranged in the first axial direction having a common length, and the second edges of the plurality of rectangular patches having respective lengths that gradually vary along the first axial direction, so that a phase of a reflected wave by a specific element of the plurality of elements satisfies a first condition and a second condition, the first condition is such that the phase of the reflected wave by the specific element differs, by a predetermined value, from a phase of a reflected wave by an element adjacent to the specific element in the first axial direction, while the phase of the reflected wave by the specific element is equal to a phase of a reflected wave by an element adjacent to the specific element in the second axial direction, the second condition is such that an absolute value of a component in the second axial direction of an incident unit vector along a traveling direction of the incident wave is equal to an absolute value of a component in the second axial direction of a reflection unit vector along a traveling direction of the reflected wave, and while assuming that a position vector $r_{mn}$ of an element of the plurality of elements located at an m-th position in the first axial direction and an n-th position in the second axial direction is $r_{mn}=(m\Delta x, n\Delta y, 0)$; that, in $(r, \theta, \phi)$ polar coordinates, the incident wave arrives from a direction defined by $\theta=\theta_i$ and $\phi=\phi_i$, and the reflected wave propagates in a direction defined by $\theta=\theta_r$ and $\phi=\phi_r$; and that $\Delta x=\Delta y$=a non-zero constant, the second condition is satisfied by adjusting the second edge along the second axial direction of the rectangular patch of the element of the plurality of elements located at the m-th position in the first axial direction and the n-th position in the second axial direction so that a reflection phase $\alpha_{mn}=k_0m\Delta x(\sin\theta_i\cos\phi_i-\sin\theta_r\cos\phi_r)$ is achieved by the element of the plurality of elements located at the m-th position in the first axial direction and the n-th position in the second axial direction, where $k_0$ is a wave number $(2\pi/\lambda)$ of the incident wave, and $\lambda$ is a wavelength of the incident wave.

2. The reflectarray according to claim 1, wherein the plurality of elements are arranged in a matrix form in the first axial direction and in the second axial direction, a plurality of elements belonging to a first region of the reflectarray reflects the incident wave in a first desired direction, and a plurality of elements belonging to a second region of the reflectarray reflects the incident wave in a second desired direction, in the first region, a phase of the reflected wave by one element differs from a phase of the reflected wave by an element adjacent to the one element in the first axial direction by the predetermined value, and the phase of the reflected wave by the one element is equal to a phase of the reflected wave by an element adjacent to the one element in the second axial direction, and in the second region, a ratio between a phase difference of the reflected waves from corresponding elements neighboring in the first axial direction ($\Delta\alpha_1$) and a phase difference of the reflected waves from corresponding elements neighboring in the second axial direction ($\Delta\alpha_2$) is another predetermined value, and the phase difference of the reflected waves from the corresponding elements neighboring in the first axial direction and the phase difference of the reflected waves from the corresponding elements neighboring in the second axial direction are divisors of an integral multiple of 360 degrees, which is $2\pi$ radians.

* * * * *